US007946863B2

(12) United States Patent
Loch et al.

(10) Patent No.: US 7,946,863 B2
(45) Date of Patent: May 24, 2011

(54) CIRCUIT PROTECTION BLOCK

(75) Inventors: Vern Loch, Prior Lake, MN (US); Bryan Kennedy, Norcross, GA (US); John Stasny, Lake Elmo, MN (US); Rodney J. Lasky, New Hope, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 12/429,850

(22) Filed: Apr. 24, 2009

(65) Prior Publication Data

US 2009/0269954 A1 Oct. 29, 2009

Related U.S. Application Data

(60) Provisional application No. 61/048,091, filed on Apr. 25, 2008, provisional application No. 61/081,919, filed on Jul. 18, 2008.

(51) Int. Cl.
*H01R 4/66* (2006.01)

(52) U.S. Cl. ..... 439/108

(58) Field of Classification Search ..... 439/108, 439/676, 76.1, 929; 361/56, 104, 58, 91.1
See application file for complete search history.

(56) References Cited

U.S. PATENT DOCUMENTS

| | | | |
|---|---|---|---|
| D215,545 | S | 10/1969 | Huska |
| 4,086,648 | A | 4/1978 | Hines et al. |
| 4,345,294 | A | 8/1982 | Forberg et al. |
| 4,420,200 | A | 12/1983 | Forberg et al. |
| 4,420,892 | A | 12/1983 | Braun et al. |
| D273,104 | S | 3/1984 | Cousins |
| 4,434,542 | A | 3/1984 | Forberg et al. |
| 4,502,088 | A | 2/1985 | Baumbach |
| 4,547,034 | A | 10/1985 | Forberg et al. |
| 4,594,635 | A | 6/1986 | Scheithauer et al. |
| 4,626,955 | A | 12/1986 | Cwirzen |
| 4,642,723 | A | 2/1987 | Achtnig et al. |

(Continued)

FOREIGN PATENT DOCUMENTS

| | | |
|---|---|---|
| CA | 1333409 | 12/1994 |

(Continued)

OTHER PUBLICATIONS

Methods of ADSL delivery, KRONE, 2 pages, (Publicly known at least as early as Nov. 22, 2002).

(Continued)

*Primary Examiner* — Jean F Duverne
(74) *Attorney, Agent, or Firm* — Merchant & Gould P.C.

(57) ABSTRACT

A protection block and method of use are disclosed. The protection block includes a rectangular housing having a front, a rear, and top, bottom, left, and right sides. The protection block also includes a plurality of sockets arranged in a two-dimensional array in the front of the housing, each of the plurality of sockets associated with two pairs of opposed, normally open contacts. Each of the plurality of sockets is arranged to receive an overvoltage protection plug that separately connects each of the two pairs of contacts. The protection block also includes a plurality of electrical connections in a second discrete region of the block separate from the first discrete region, the plurality of electrical connections electrically connected to the contacts. The protection block also includes a grounding bar associated with one or more of the sockets and positioned for electrical connection to a ground connection of an overvoltage protection plug when inserted into a socket.

19 Claims, 62 Drawing Sheets

U.S. PATENT DOCUMENTS 4,649,456 A 3/1987 De Luca et al.
4,741,711 A 5/1988 Singer, Jr.
4,759,726 A 7/1988 Naylor et al.
4,846,735 A 7/1989 Teichler et al.
4,871,330 A 10/1989 Muller et al.
4,882,748 A 11/1989 Meyerhoefer
4,887,183 A 12/1989 Biederstedt et al.
4,958,253 A 9/1990 Gilberts et al.
4,964,160 A 10/1990 Traube et al.
4,986,768 A 1/1991 Bramkamp et al.
5,033,974 A 7/1991 Biederstedt et al.
5,086,368 A 2/1992 Gerke et al.
5,130,881 A * 7/1992 Hilland ..... 361/56
5,155,649 A 10/1992 Hung et al.
5,155,650 A 10/1992 Pitsch et al.
5,157,580 A 10/1992 Hegner et al.
5,163,855 A 11/1992 Gerke et al.
5,172,295 A 12/1992 Hegner et al.
5,187,634 A 2/1993 Pitsch et al.
5,248,953 A 9/1993 Hönl
5,299,088 A 3/1994 Hönl et al.
5,341,269 A 8/1994 Hayward et al.
5,357,568 A 10/1994 Pelegris
5,365,395 A * 11/1994 Callaway ..... 361/56
5,369,543 A 11/1994 Bonnesen et al.
5,371,648 A 12/1994 Bonvallat
D354,940 S 1/1995 Speiser et al.
5,398,152 A 3/1995 Borkowicz et al.
5,410,443 A 4/1995 Pelegris
5,455,856 A 10/1995 Story
5,494,461 A 2/1996 Bippus et al.
5,546,267 A 8/1996 Frederiksen et al.
5,551,889 A 9/1996 Kozel et al.
5,555,153 A 9/1996 Frederiksen et al.
5,574,614 A 11/1996 Busse et al.
5,574,615 A 11/1996 Busse et al.
5,596,475 A 1/1997 Figueiredo et al.
5,627,721 A 5/1997 Figueiredo et al.
5,641,312 A 6/1997 Bippus et al.
5,808,849 A 9/1998 Storbeck
D402,628 S 12/1998 Canuto et al.
5,846,099 A * 12/1998 Hiruma et al. ..... 439/620.17
5,883,953 A 3/1999 Pelegris
5,910,877 A 6/1999 Paske et al.
5,923,238 A 7/1999 Polzehl et al.
5,936,821 A 8/1999 Busse et al.
5,999,412 A 12/1999 Busse et al.
6,068,503 A 5/2000 Gerke et al.
D429,690 S 8/2000 Fristedt
6,144,659 A 11/2000 Nye et al.
6,151,392 A * 11/2000 Castonguay et al. ..... 379/437
6,266,223 B1 7/2001 Curry
6,266,348 B1 7/2001 Gross et al.
6,272,219 B1 8/2001 De Bruycker et al.
6,302,723 B1 10/2001 Baum et al.
6,341,973 B1 1/2002 Endo
6,371,780 B1 4/2002 Aponte et al.
6,426,961 B1 7/2002 Nimmagadda
6,445,560 B1 9/2002 Bobert et al.
6,470,074 B2 10/2002 Teixeria
D472,877 S 4/2003 Jaag
6,570,765 B2 * 5/2003 Behling et al. ..... 361/720
6,574,309 B1 6/2003 Chea, Jr. et al.
6,603,850 B1 8/2003 Stahl et al.
6,654,223 B1 11/2003 Bippus et al.
6,657,966 B1 12/2003 Kramarczyk et al.
6,735,293 B2 5/2004 Doherty et al.
6,778,525 B1 8/2004 Baum et al.
6,785,325 B1 8/2004 Liu et al.
6,798,866 B1 9/2004 Tennyson et al.
6,826,280 B1 11/2004 Sajadi et al.
6,898,280 B1 5/2005 Dombkowski et al.
6,914,976 B2 7/2005 Bloemen
6,932,624 B1 * 8/2005 Hoopes et al. ..... 439/76.1
6,977,922 B2 12/2005 Blanset et al.
6,979,205 B2 * 12/2005 Hoopes et al. ..... 439/76.1
6,980,725 B1 12/2005 Swieconek
7,008,243 B2 3/2006 Mueller et al.
D523,819 S 6/2006 Christianson et al.
7,147,412 B2 12/2006 Davis
7,155,004 B1 12/2006 Kennedy et al.
D535,618 S 1/2007 Hu et al.
7,175,468 B1 2/2007 Chang
7,271,991 B2 * 9/2007 Hoopes ..... 361/119
7,409,053 B1 8/2008 Kennedy et al.
7,411,769 B2 * 8/2008 Schimanski et al. ..... 361/91.1
7,412,052 B2 8/2008 Kennedy et al.
D591,691 S 5/2009 Baker et al.
7,684,557 B2 3/2010 Kennedy et al.
7,742,397 B2 6/2010 Kennedy et al.
D620,896 S 8/2010 Petersen
2002/0111077 A1 8/2002 Keenum
2002/0118820 A1 8/2002 Sinclair et al.
2002/0168054 A1 11/2002 Klos et al.
2004/0042510 A1 3/2004 Bremer et al.
2004/0095956 A1 5/2004 Henderson et al.
2004/0246644 A1 12/2004 Sato et al.
2004/0259396 A1 12/2004 Mueller et al.
2005/0094466 A1 5/2005 Archer et al.
2008/0032566 A1 2/2008 Walter et al.
2008/0204963 A1 8/2008 Baker et al.
2009/0296303 A1 12/2009 Petersen

FOREIGN PATENT DOCUMENTS

DE 37 28 368 C1 11/1988
DE 100 01 553 A1 8/2001

OTHER PUBLICATIONS

KRONE-ADSL Service Delivery, White Paper, 8 Pages, Jan. 2003.

* cited by examiner 58
58
58

CIRCUIT PROTECTION BLOCK

CROSS-REFERENCE TO RELATED APPLICATIONS

This application claims priority to U.S. Provisional Patent Application No. 61/048,091, filed Apr. 25, 2008, as well as U.S. Provisional Patent Application No. 61/081,919, filed Jul. 18, 2008. The disclosure of each of these applications is hereby incorporated by reference in its entirety.

TECHNICAL FIELD

The present disclosure relates generally to circuit protection in communications systems; more particularly, the present disclosure relates to a circuit protection block, such as can be used in conjunction with a small form factor circuit protection device.

BACKGROUND

Telecommunications systems generally include connection and disconnection systems, through which various types of telecommunications equipment are interconnected. Such systems generally require electrical protection, such as to prevent overvoltage and overcurrent events from damaging equipment, as can occur in the case of lightning strikes, power surges, or other electrical events. Various types of gas tube and solid state overvoltage protection components exist and are used in these telecommunications systems.

In large telecommunications systems, protection blocks are used to ensure that overvoltage or overcurrent events do not damage telecommunications circuits. These protection blocks receive individual protection elements, which plug into the block to protect individual circuits. Existing protection devices include 5-pin voltage protection devices that include solid state or gas tube overvoltage protection for telecommunications circuitry. These existing devices are inserted into a 5-pin protection block in a 100-element array, resulting in a protection block that is approximately 7.9 inches by approximately 5.8 inches in size (and can be of a variety of depths). This dimension is known for use in a protection block known as a "307 block", which is used in telecommunications cabinets and other arrangements for mounting purposes. When used in existing telecommunications systems, a large number of these blocks are used, to protect a large number of signal lines.

In certain systems, a piece of equipment used for connection of telecommunications systems is referred to herein as a connection block, sometimes referred to as a "Krone-style connector block", such as those manufactured by ADC GmbH, formerly Krone GmbH. These connection blocks provide an array of punch-down connection locations useable for individual wire pairs, and include circuit protection locations in a single linear array. However, because Krone-style connector blocks include circuit protection locations along the array of punch-down connection locations, they are not space-efficient circuit protection devices for large signal arrays in large, high density telecommunications systems.

SUMMARY

The present disclosure relates generally to protection block useable with small form-factor overvoltage protection plugs. The protection block includes a dense, two dimensional array of circuit protection locations, while remaining within dimensions reserved for protection blocks in a telecommunications system.

According to a first aspect, a protection block is disclosed. The protection block includes a rectangular housing having a front, a rear, and top, bottom, left, and right sides. The protection block also includes a plurality of sockets arranged in a two-dimensional array in the front of the housing, each of the plurality of sockets associated with two pairs of opposed, normally open contacts. Each of the plurality of sockets is arranged to receive an overvoltage protection plug that separately connects each of the two pairs of contacts. The protection block also includes a plurality of electrical connections in a second discrete region of the block separate from the first discrete region, the plurality of electrical connections electrically connected to the contacts. The protection block also includes a grounding bar associated with one or more of the sockets and positioned for electrical connection to a ground connection of an overvoltage protection plug when inserted into a socket.

According to a second aspect, a method of protecting a telecommunications circuit is disclosed. The method includes mounting a protection block in a telecommunications system, the protection block including a plurality of sockets in a first discrete region and arranged in a two-dimensional array, each of the plurality of sockets associated with two pairs of normally open contacts, wherein each of the plurality of sockets is arranged to receive an overvoltage protection plug that separately connects each of the two pairs of contacts. The method also includes electrically connecting telecommunications wires to pins of the protection block arranged in a second discrete region separate from the first discrete region and associated with one of the plurality of sockets. The method further includes inserting an overvoltage protection plug into the socket, thereby connecting the normally open contacts and activating and protecting a circuit associated with the socket and the telecommunications wires.

According to a third aspect, a protection block is disclosed. The protection block includes a rectangular housing formed from a base and a cover and having a front, a rear, and top, bottom, left, and right sides. The protection block also includes a plurality of sockets arranged in a two-dimensional array in the front of the housing, where each of the plurality of sockets is associated with two opposed pairs of normally open contacts, and each of the plurality of sockets is arranged to receive an overvoltage protection plug that separately connects each of the pairs of contacts. The protection block also includes a plurality of pins extending from the rear of the housing, each of the plurality of pins electrically connecting to a contact. The protection block further includes a plurality of grounding bars, each of the plurality of grounding bars associated with one or more of the sockets and positioned for electrical connection to a ground connection of an overvoltage protection plug when the overvoltage protection plug is inserted into one of the plurality of sockets. The pins associated with the two opposed pairs of normally open contacts of a socket are electrically connected to differential signal wires of a telecommunications circuit.

DETAILED DESCRIPTION

Figure 1:
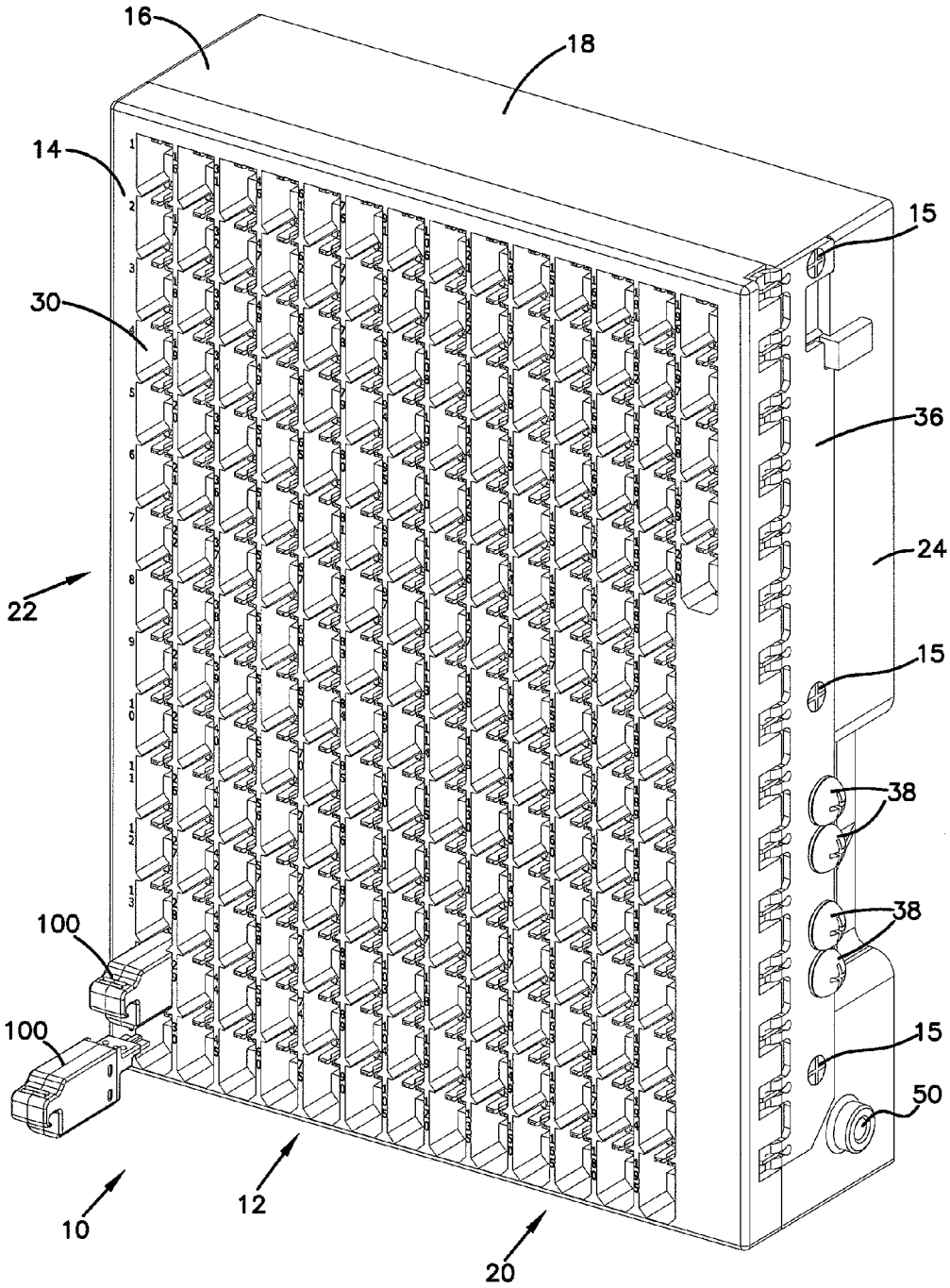
FIG. 1 is a front perspective view of a protection block having an overvoltage protection plug inserted into a first socket and a second overvoltage protection plug aligned with a second socket.
Figure 2:
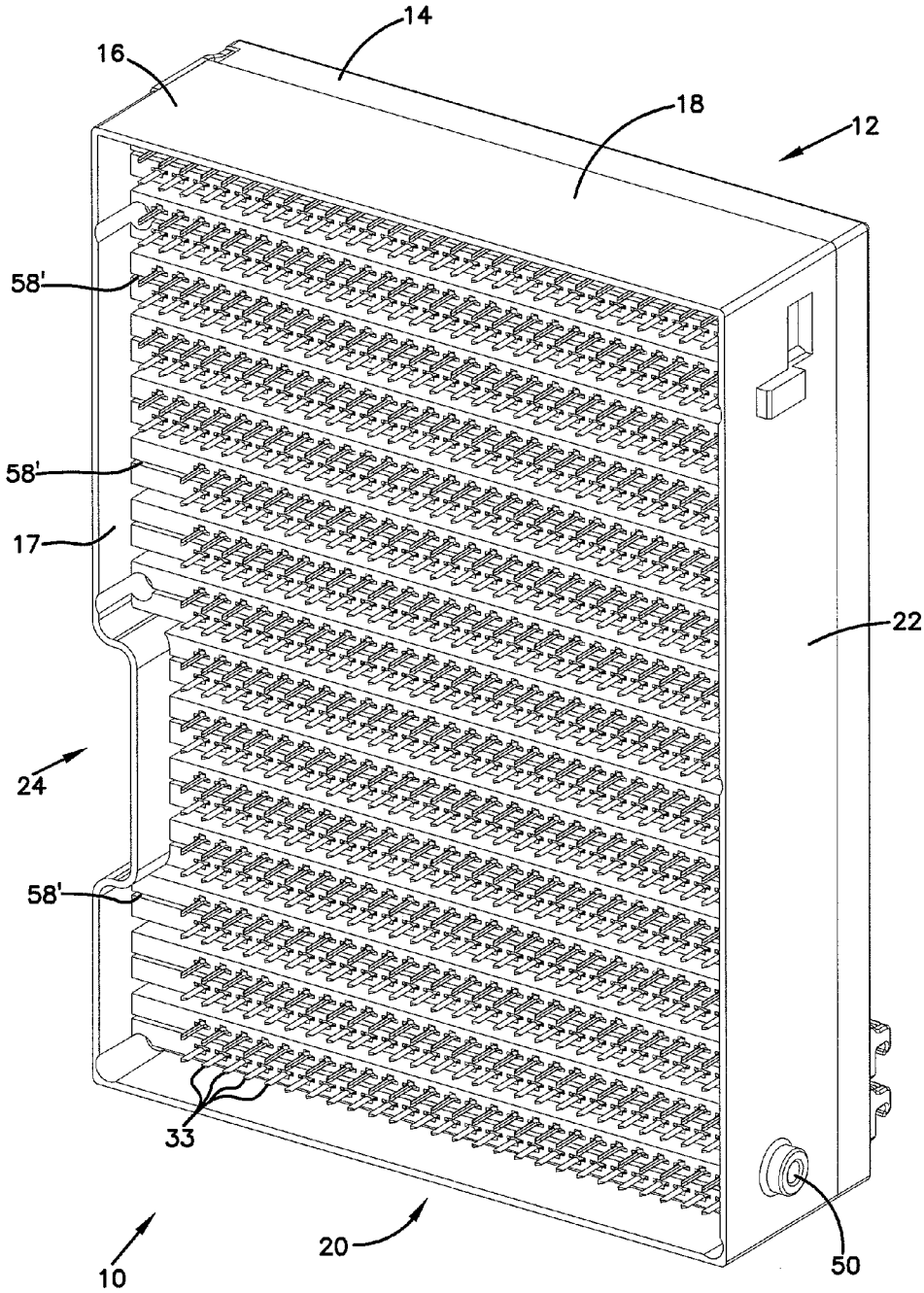
FIG. 2 is a rear perspective view of the protection block of FIG. 1.
Figure 3:
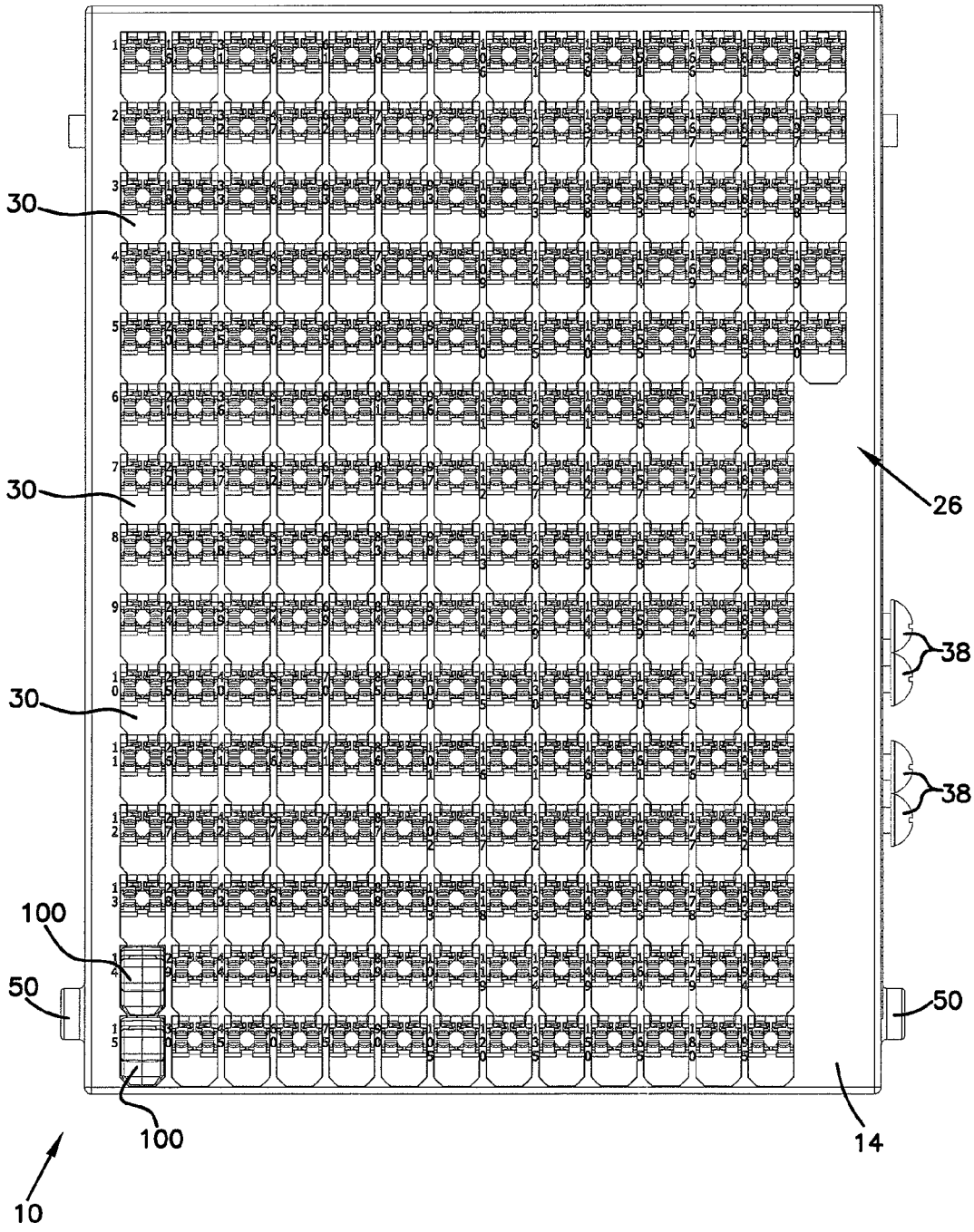
FIG. 3 is a front plan view of the protection block of FIG. 1.

Referring to FIGS. 1-7, a protection block 10 is described which can be used in telecommunications circuitry to provide a high connection density protection for telecommunications systems. The protection block 10 can be used in a variety of telecommunications panels or other telecommunications signal distribution circuits. In certain embodiments, the protection block 10 can be used in place of a standard 5-pin protection block, as previously described.

The protection block 10 includes a housing 12 formed from a cover 14 and a base 16. The housing 12 is generally rectangular, having a top side 24, a bottom side 22, left and right sides 18, 20, respectively, and a front 26 and rear 28. The housing is preferably sized to fit into a protection block mounting structure (not shown). In the embodiment shown, the housing 12 is approximately 7.9 inches by 5.8 inches in size. The overall depth of the protection block 10 can vary within the limitations set by the enclosure in which the block is placed; in the embodiment shown, the block 10 is approximately 2.17 inches deep. These dimensions can vary in other embodiments of the present disclosure.

Figure 4:
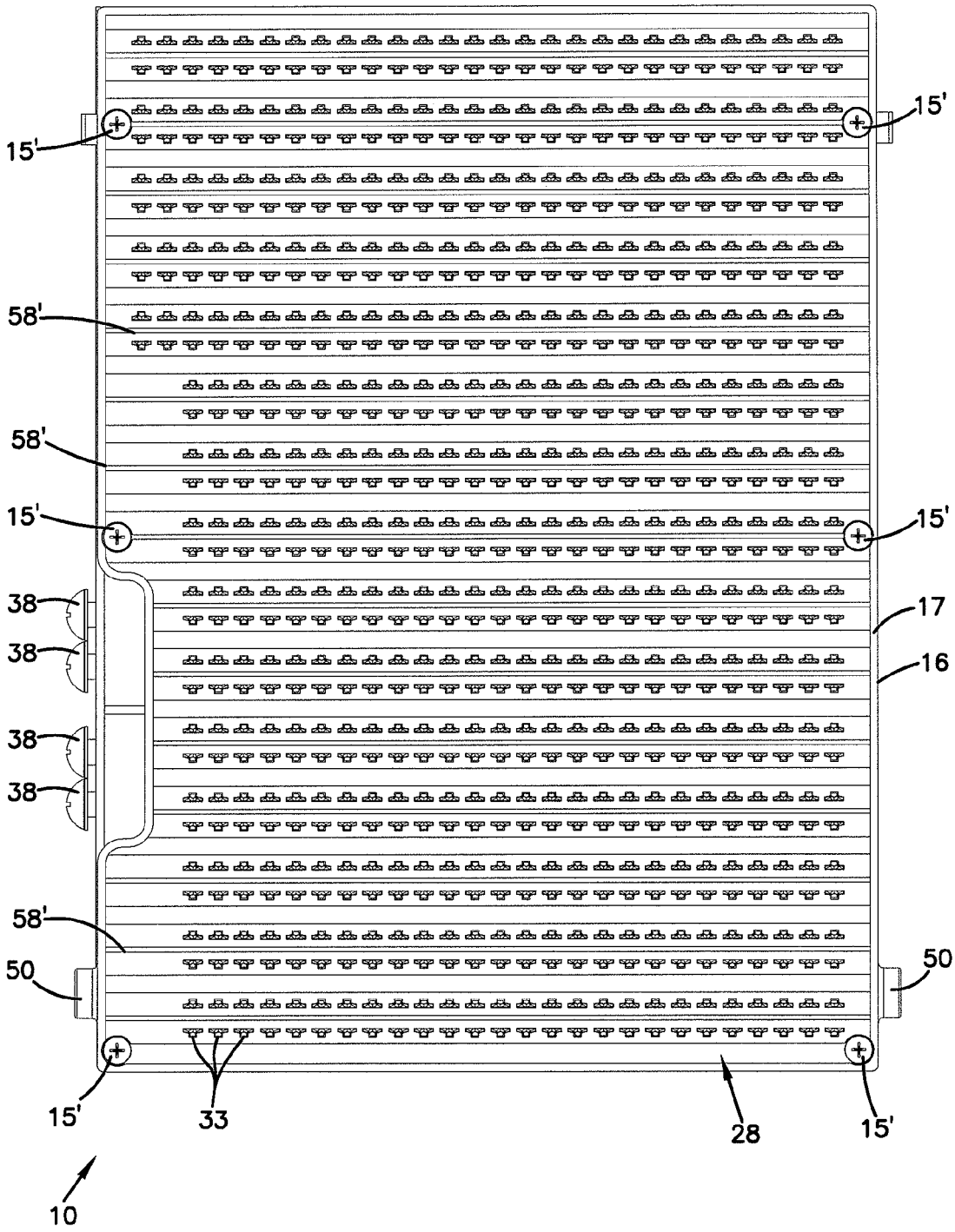
FIG. 4 is a rear plan view of the protection block of FIG. 1.
Figure 5:
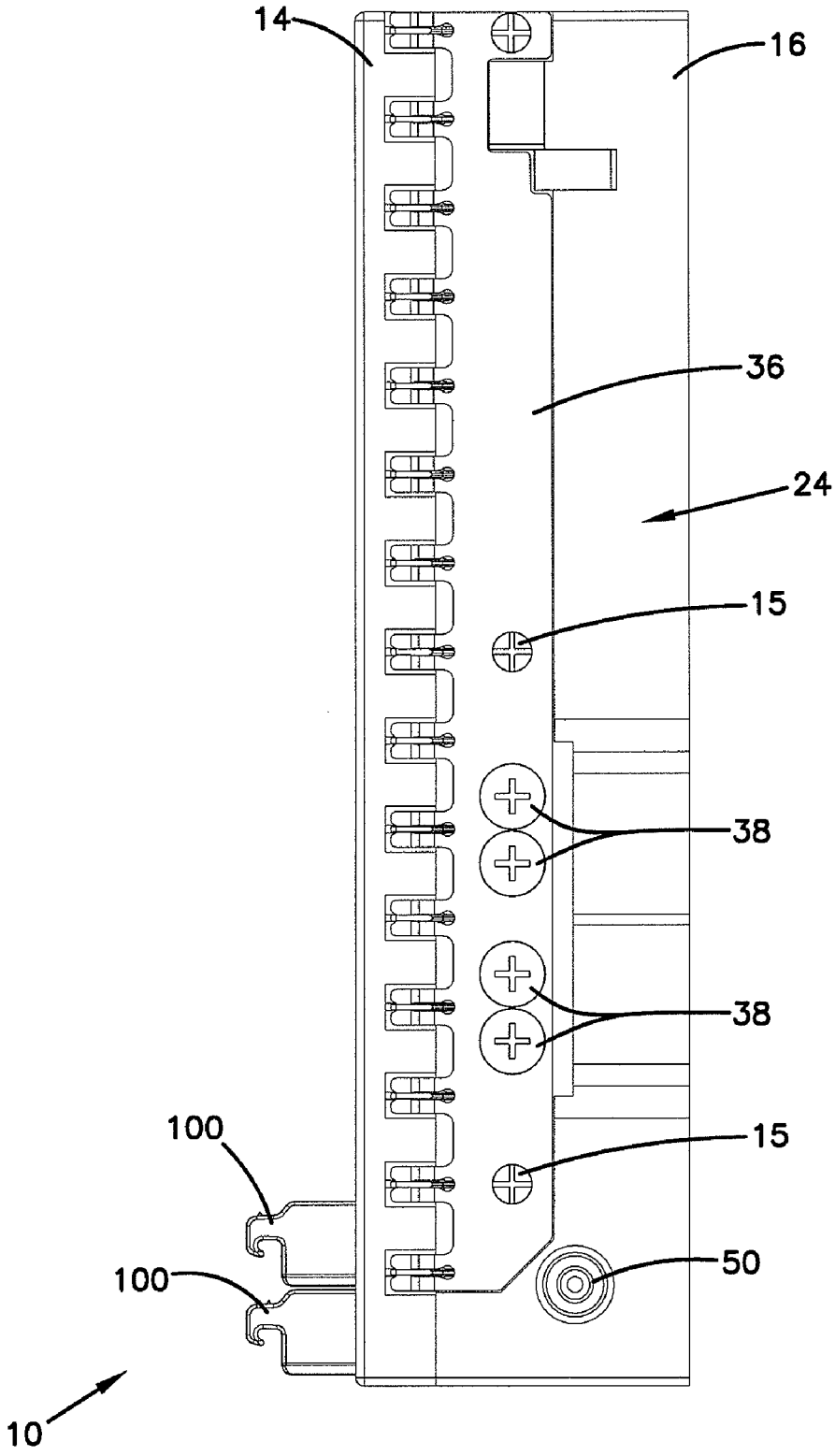
FIG. 5 is a right side plan view of the protection block of FIG. 1.
Figure 6:
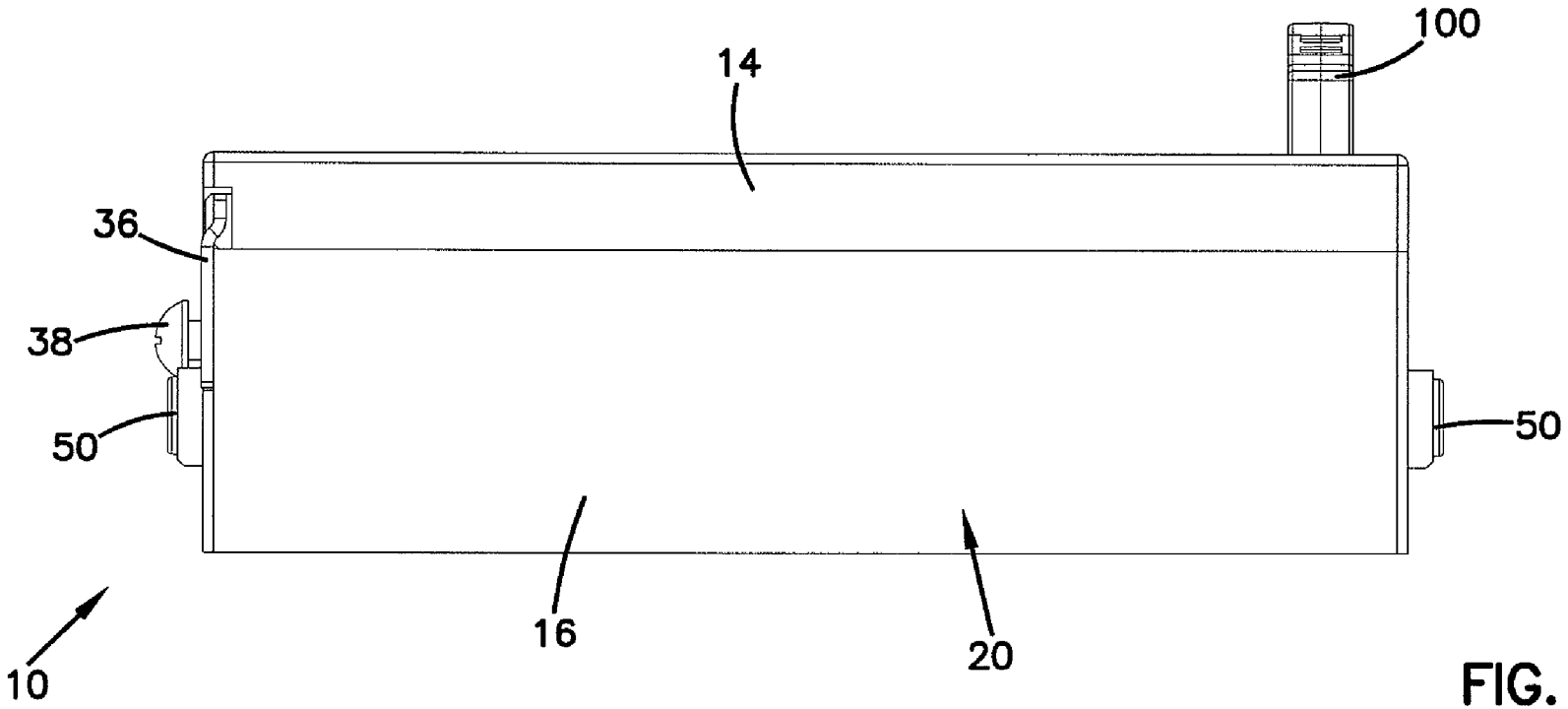
FIG. 6 is a top side plan view of the protection block of FIG. 1, on a left side adjacent the side shown in FIG. 5.
Figure 7:
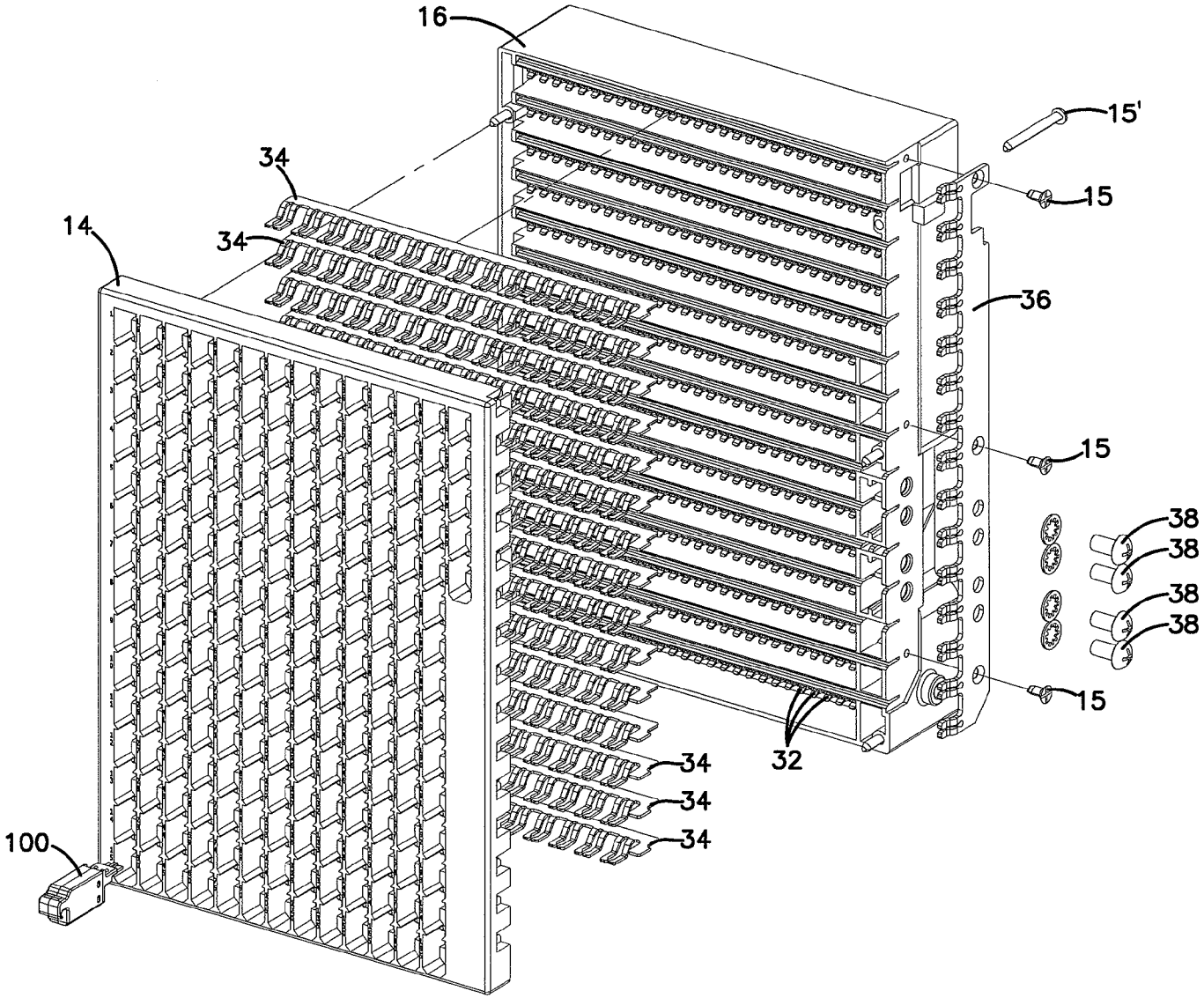
FIG. 7 is a front exploded perspective view of the protection block of FIG. 1.
Figure 8:
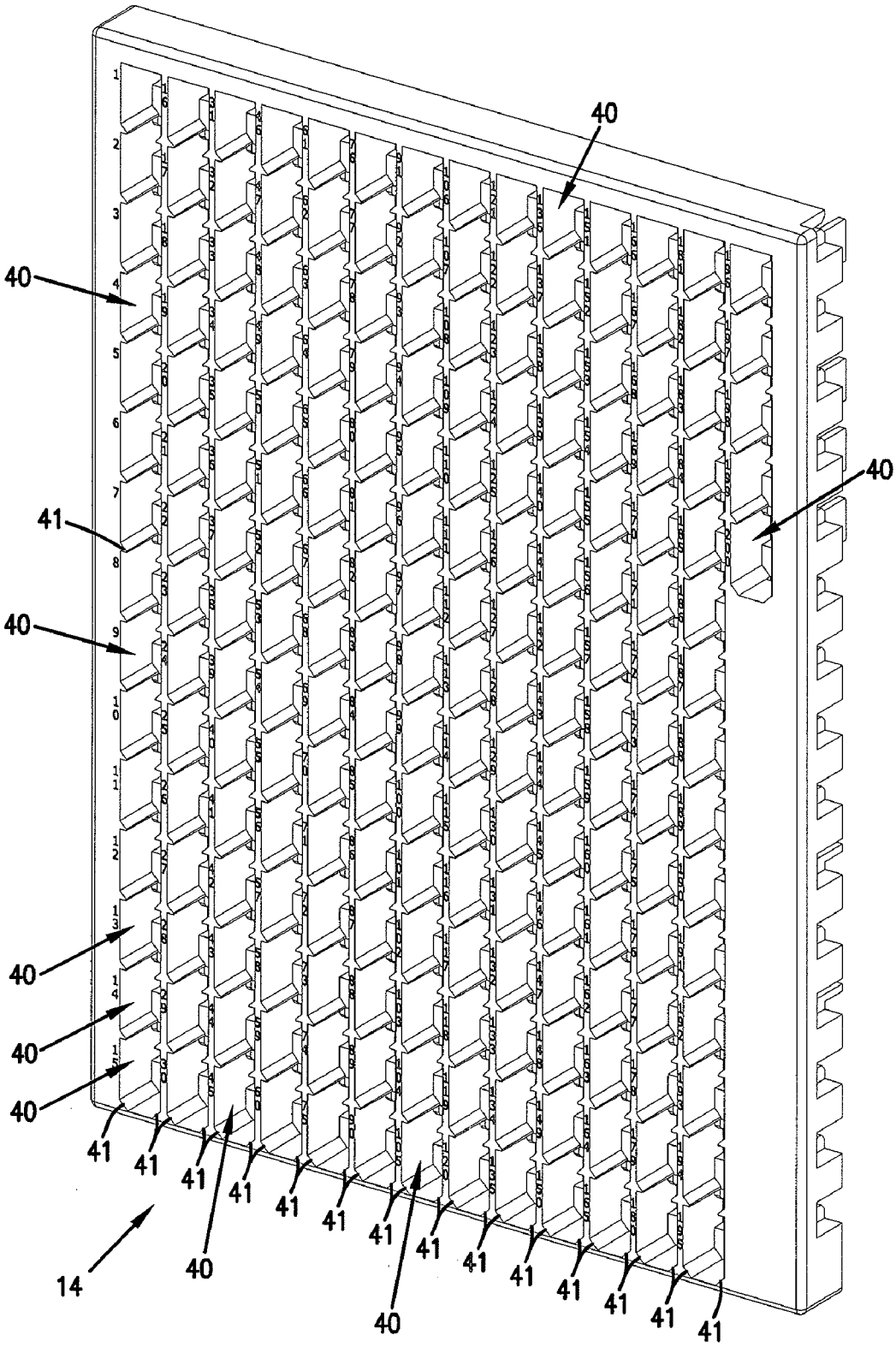
FIG. 8 is a front perspective view of a cover used to define the sockets in the protection block of FIG. 1.
Figure 9:
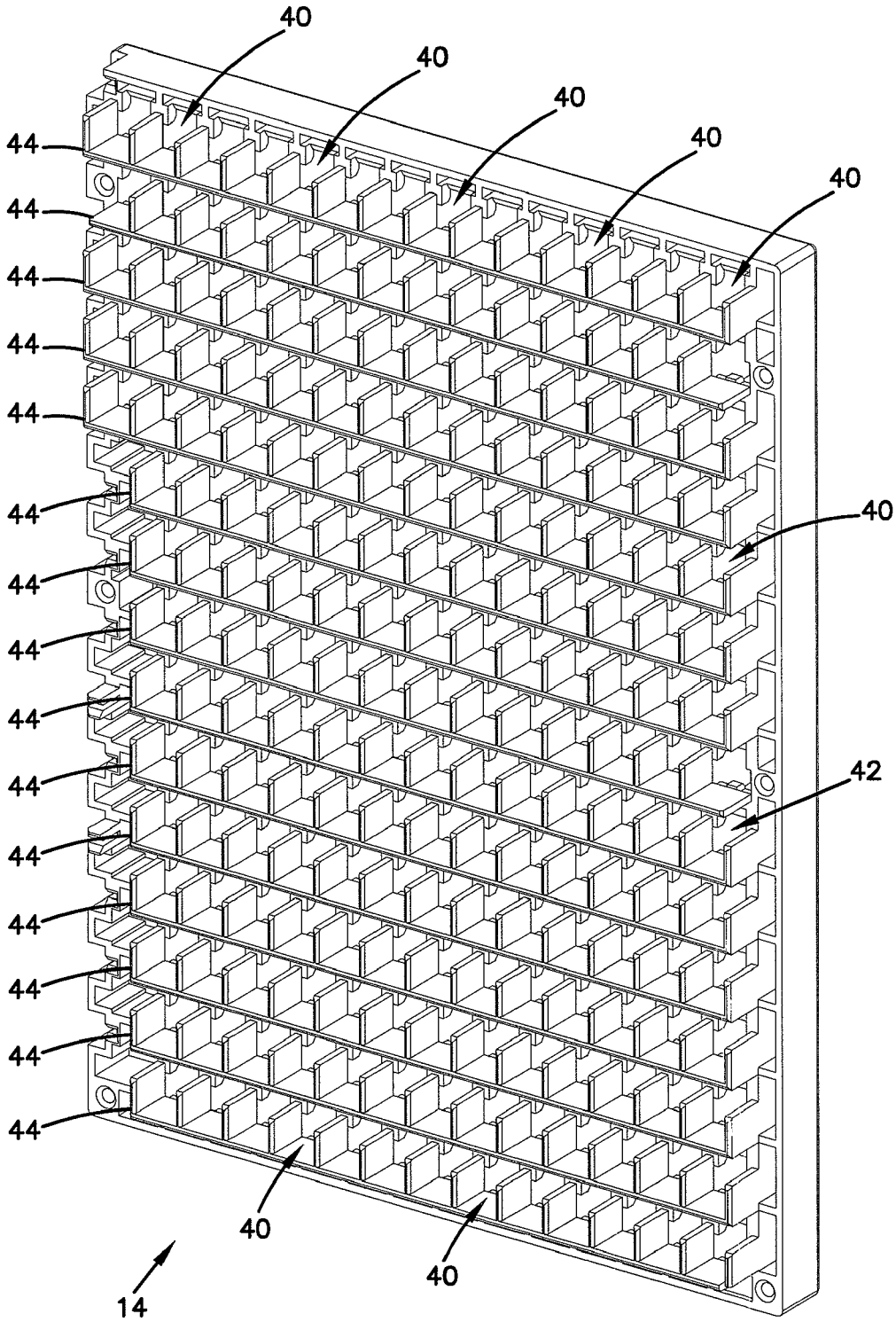
FIG. 9 is a rear perspective view of the cover of FIG. 8.
Figure 10:
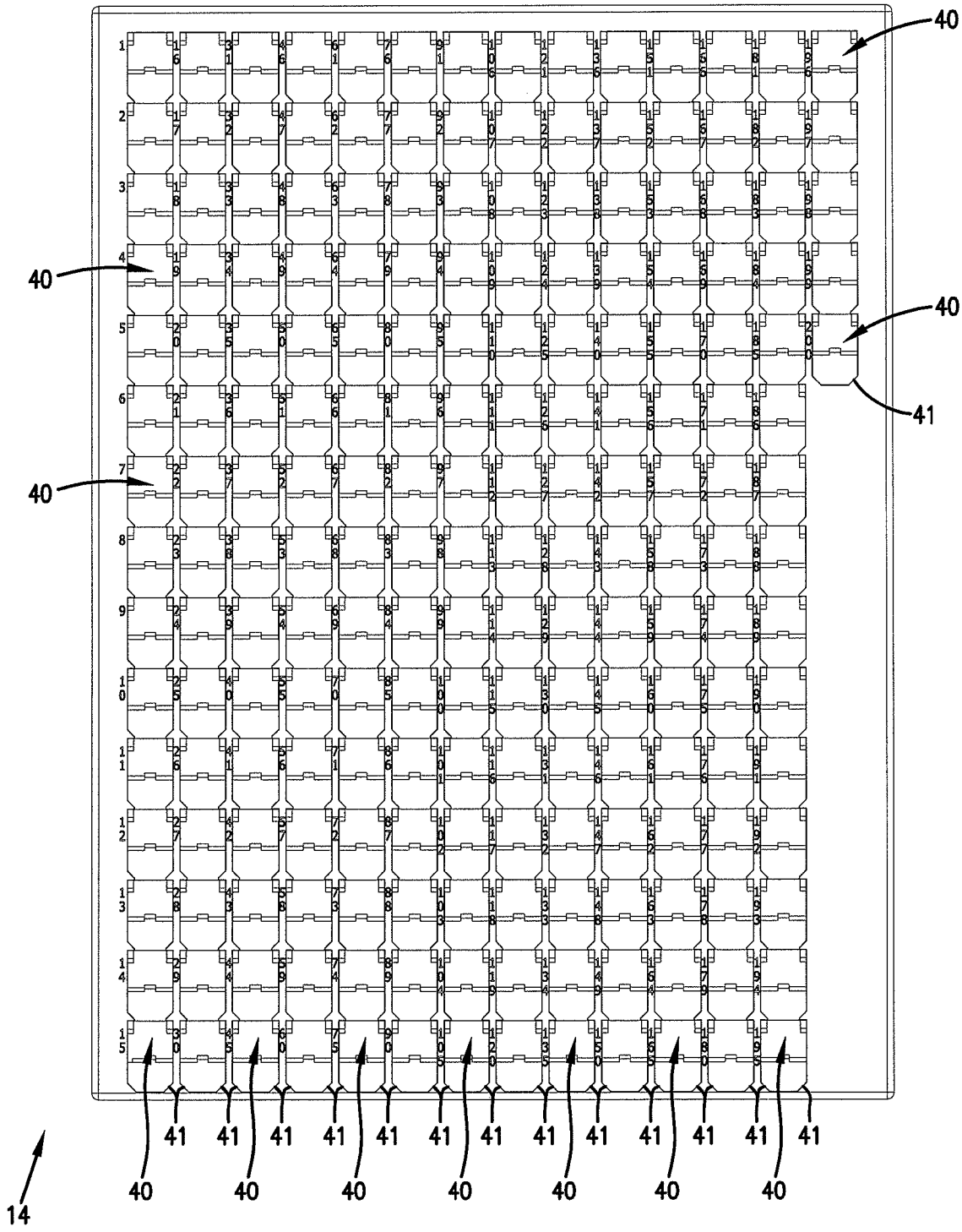
FIG. 10 is a front plan view of the cover of FIG. 8.
Figure 11:
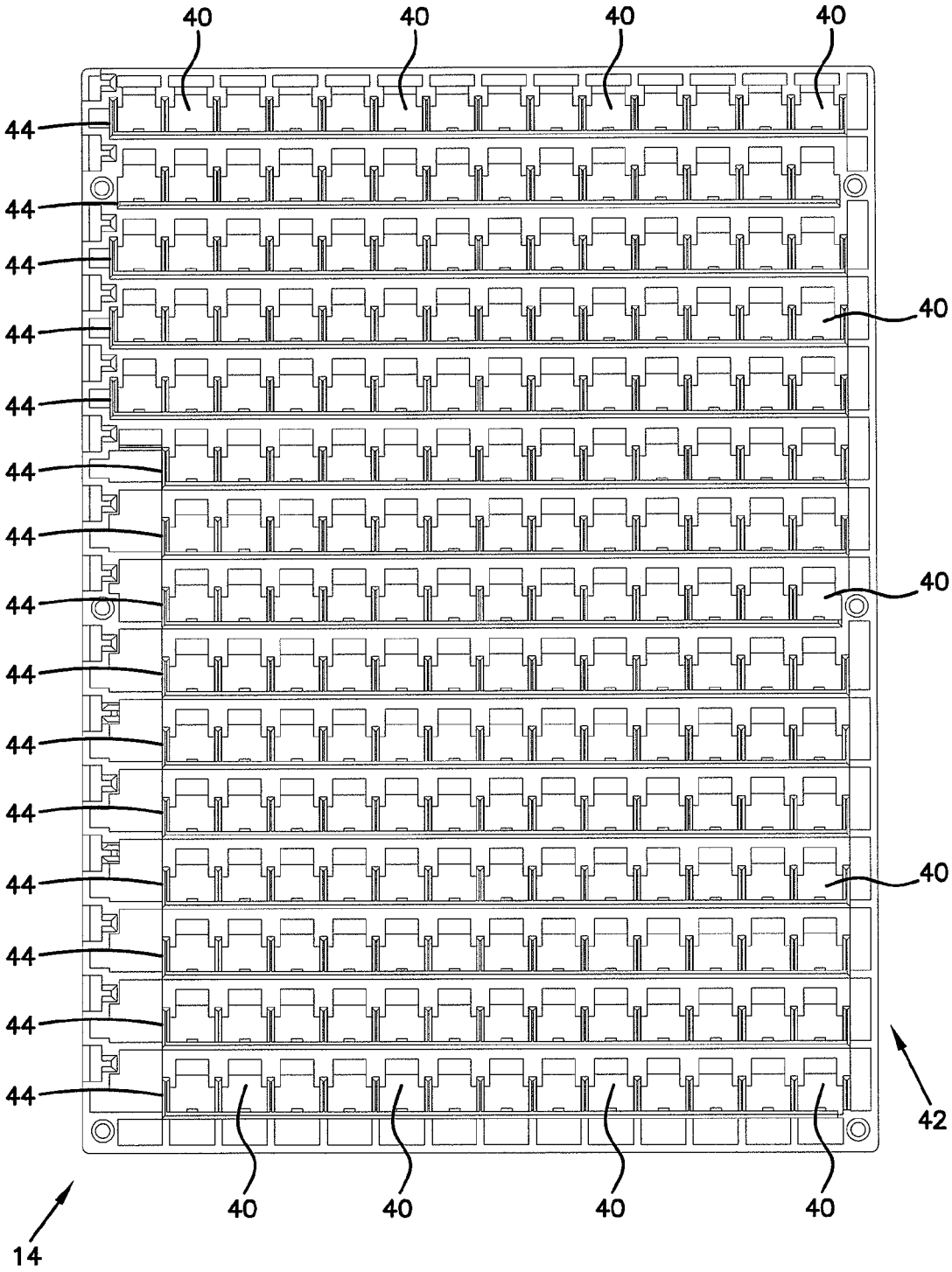
FIG. 11 is a rear plan view of the cover of FIG. 8.
Figure 14:
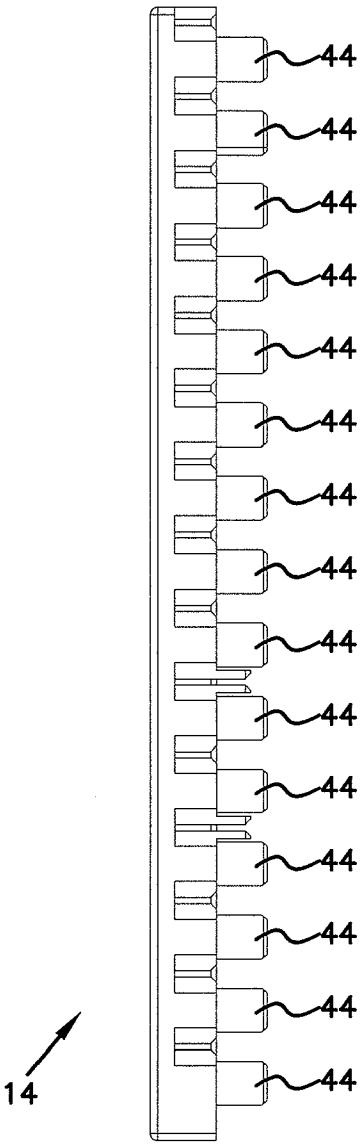
FIG. 14 is a right side plan view of the cover of FIG. 8.
Figure 12:
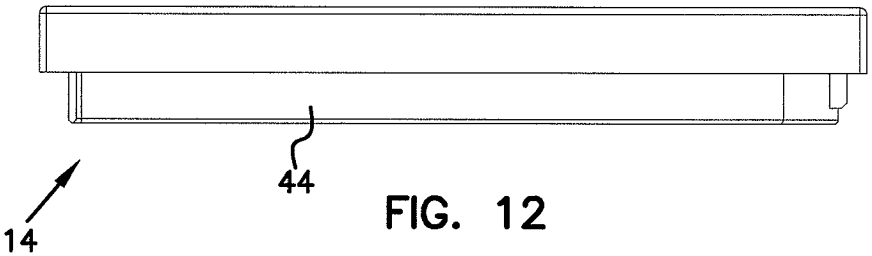
FIG. 12 is a top side plan view of the cover of FIG. 8.
Figure 13:
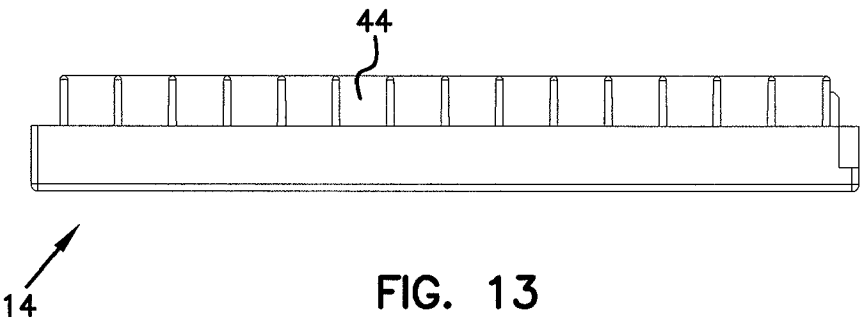
FIG. 13 is a bottom side plan view of the cover of FIG. 8.

The cover 14 is connected to the base 16 by a plurality of connectors, shown as screws 15, which are inserted through the base 16 and into the cover 14 to form the housing 12 from the two components. Additional screws 15' can be inserted through the base 16 (as shown in FIG. 4) and into the cover 14 from the rear 28 of the block 10. The screws 15' can be shaped and sized differently from the screws 15, based on the dimension and thickness of the cover 14 and base 16. Additional details regarding the cover 14 and base 16 are discussed below in conjunction with FIGS. 8-14 and 15-21, respectively.

The housing 12 includes a plurality of sockets 30, each of which is arranged to accept an overvoltage protection plug 100. The sockets 30 are formed through the front side 26 of the cover 14, and allow access to contacts 32 mounted in the base 16 of the block. The sockets 30 are generally arranged in a first discrete region, in the embodiment shown taking the form of a two-dimensional array including linear rows extending from the bottom 22 of the block 10 to the top 24 of the block. In the embodiment shown, the protection block 10 accepts 200 overvoltage protection plugs 100, inserted into the sockets 30 through the cover 14. Additional sockets can be included in the system as well.

Figure 37:
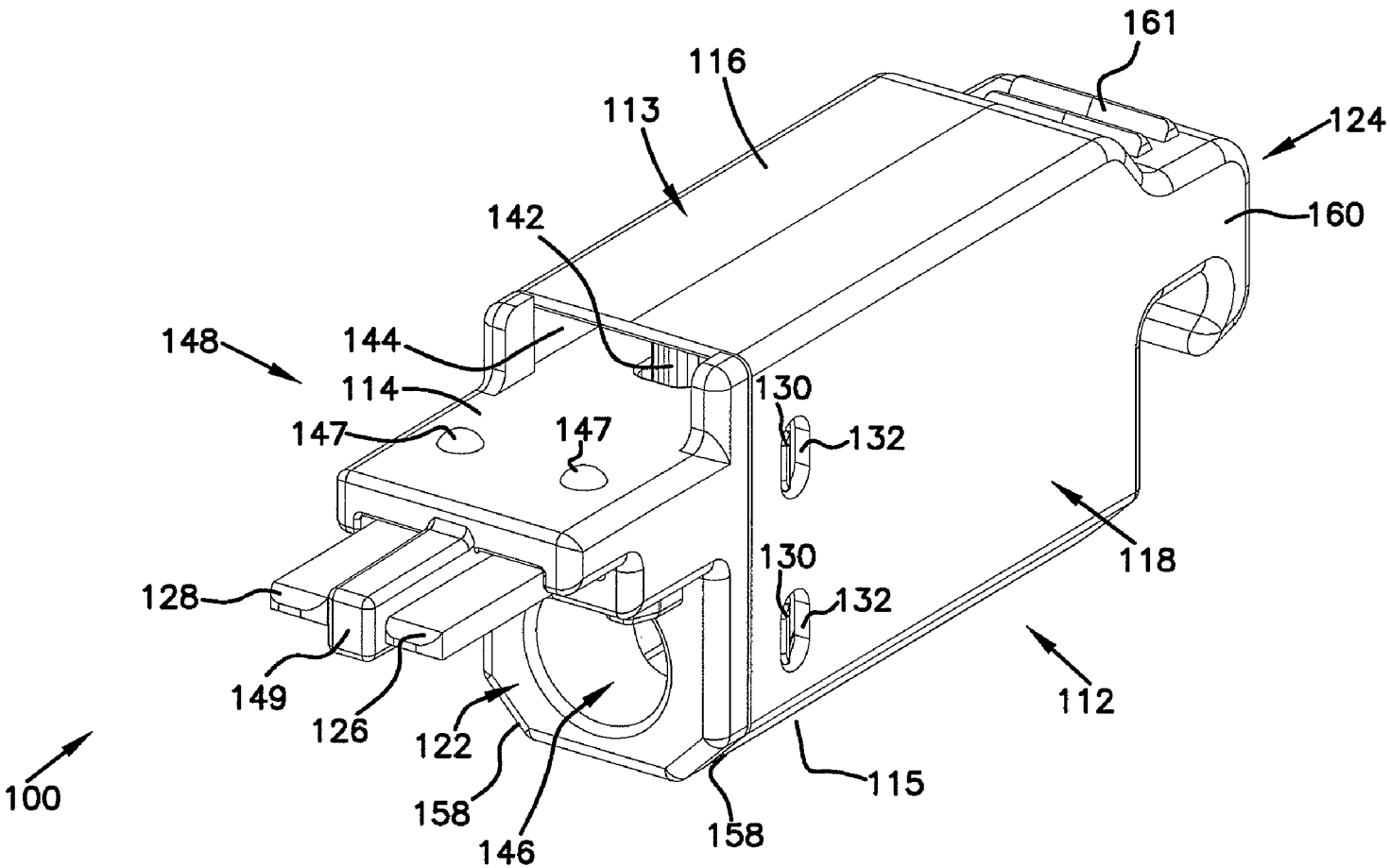
FIG. 37 is a right side perspective view of an overvoltage protection plug, in accordance with a possible embodiment of the present disclosure.
Figure 38:
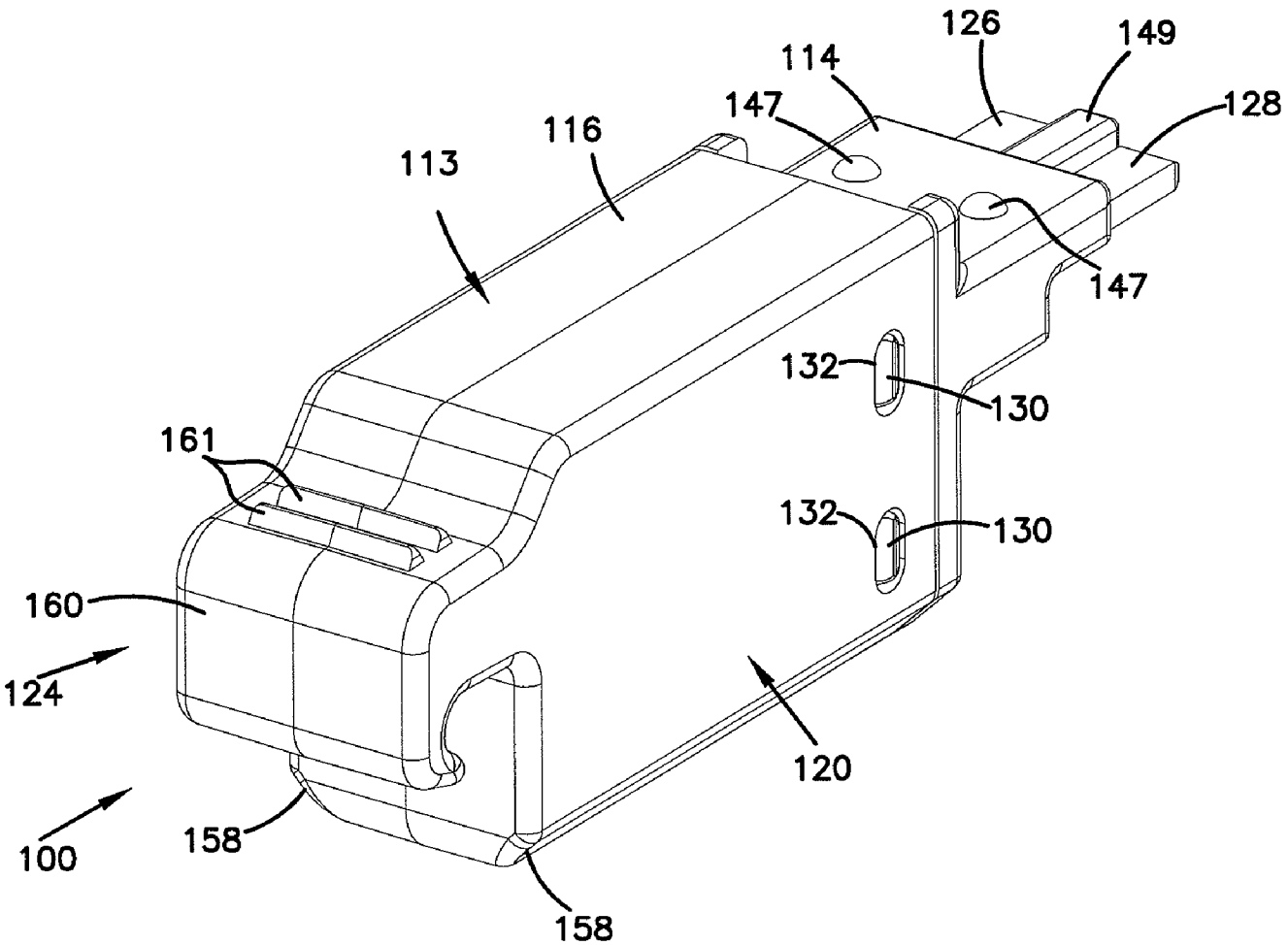
FIG. 38 is a left side perspective view of the overvoltage protection plug of FIG. 37.
Figure 39:
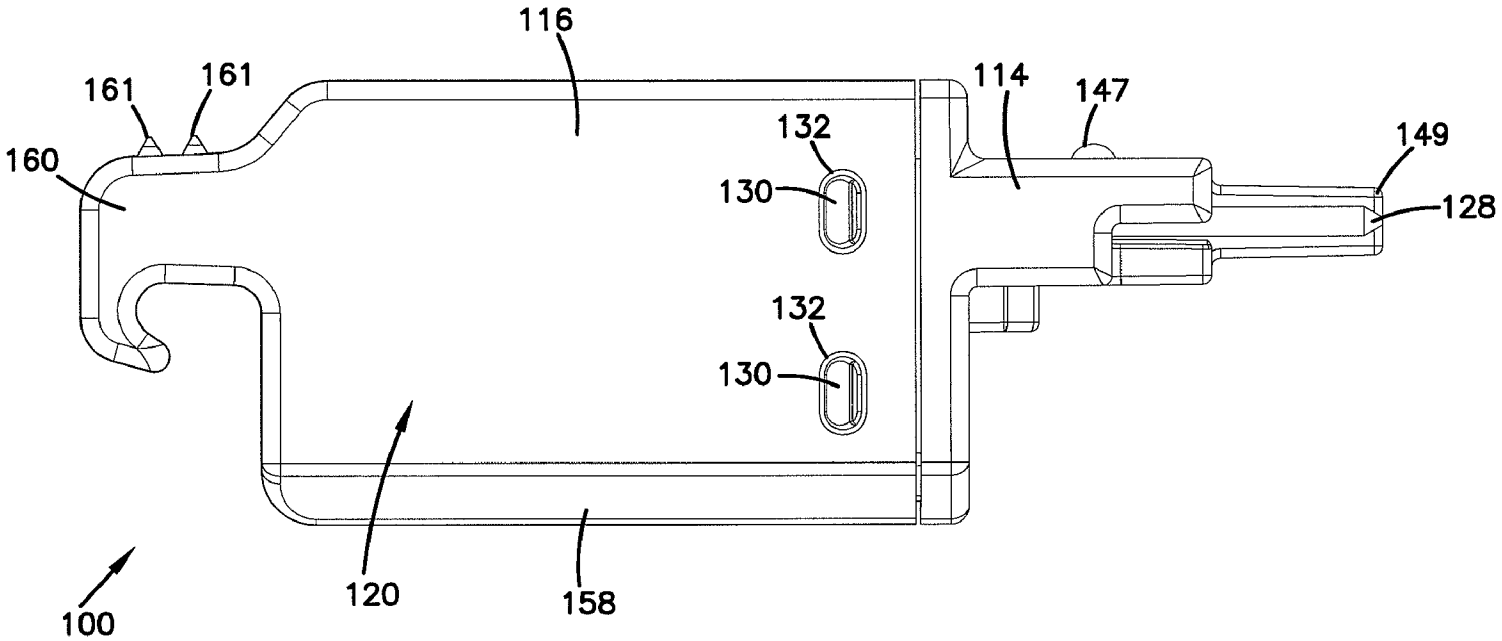
FIG. 39 is a left side plan view of the overvoltage protection plug of FIG. 37.
Figure 40:
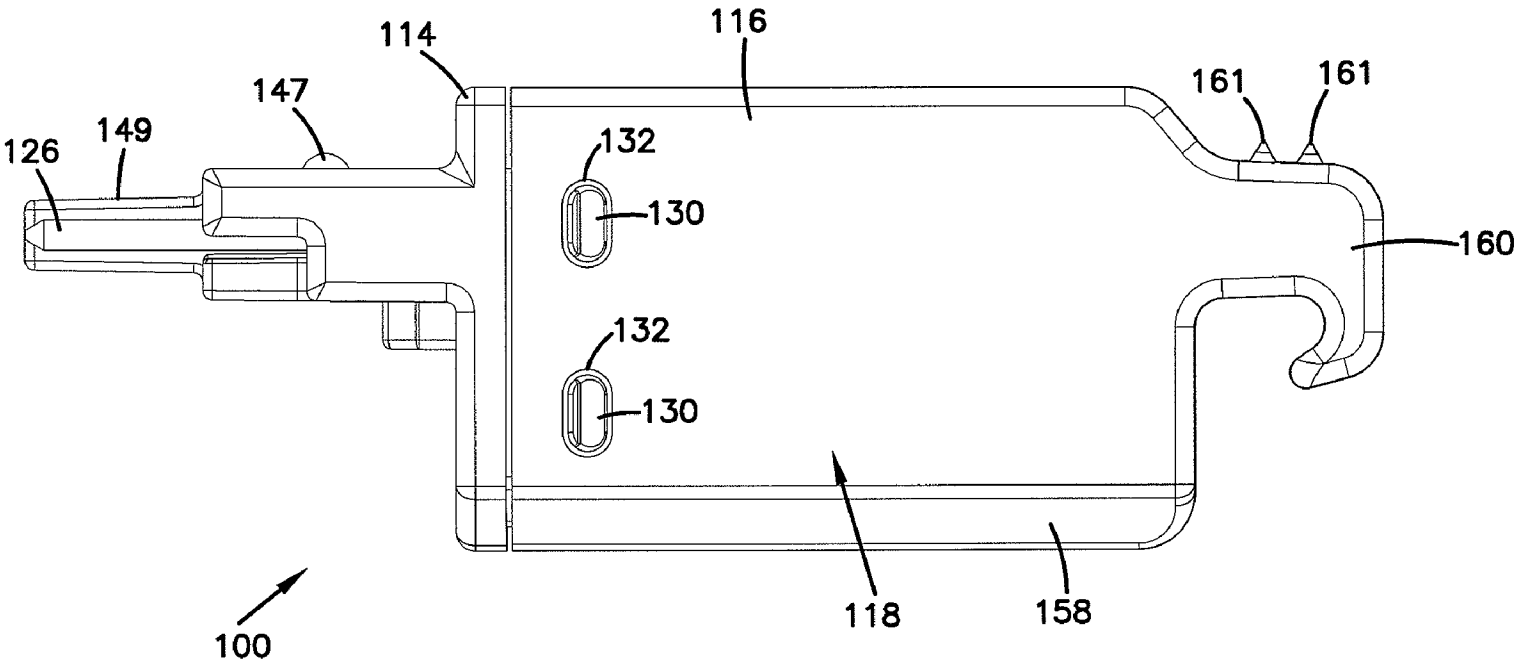
FIG. 40 is a right side plan view of the overvoltage protection plug of FIG. 37.
Figure 41:
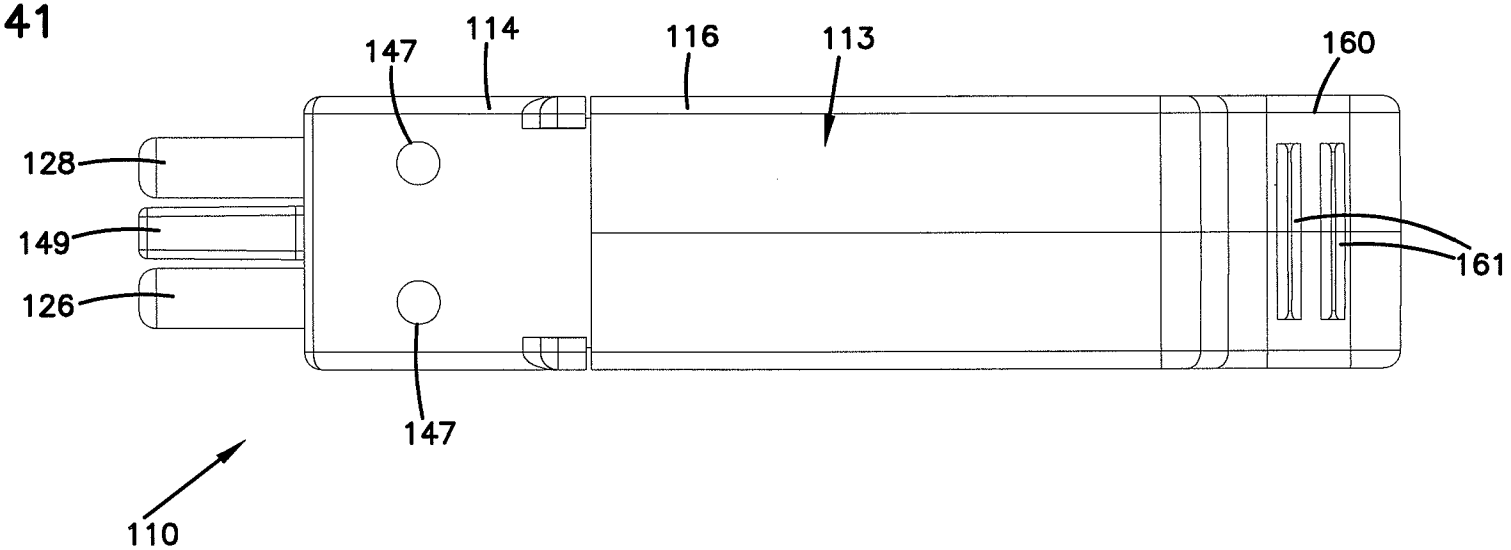
FIG. 41 is a top plan view of the overvoltage protection plug of FIG. 37.
Figure 42:
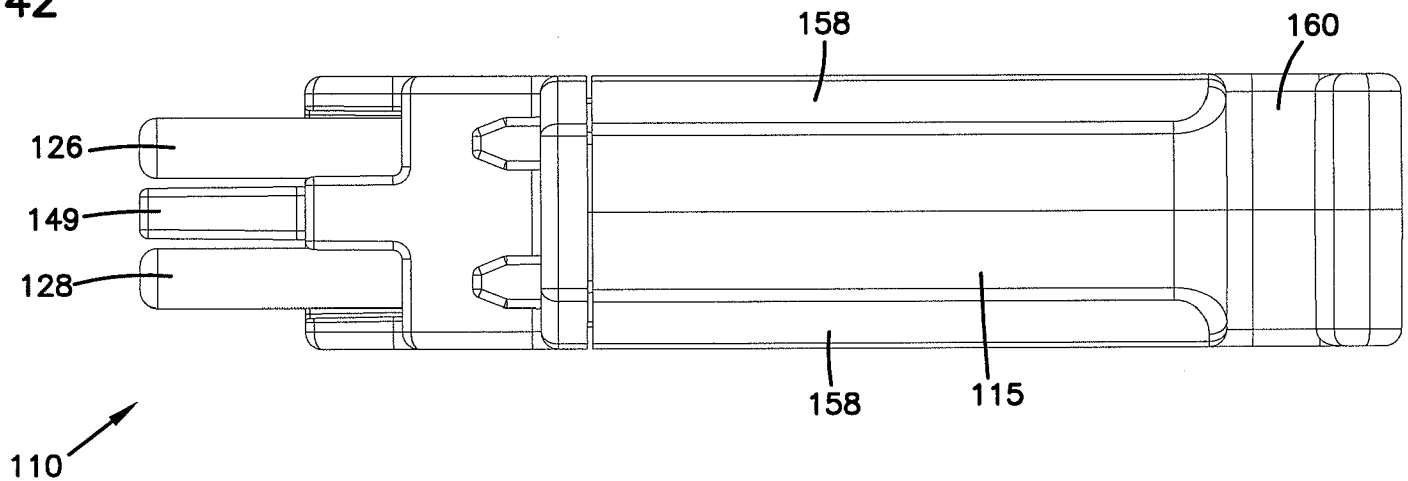
FIG. 42 is a bottom plan view of the overvoltage protection plug of FIG. 37.
Figure 44:
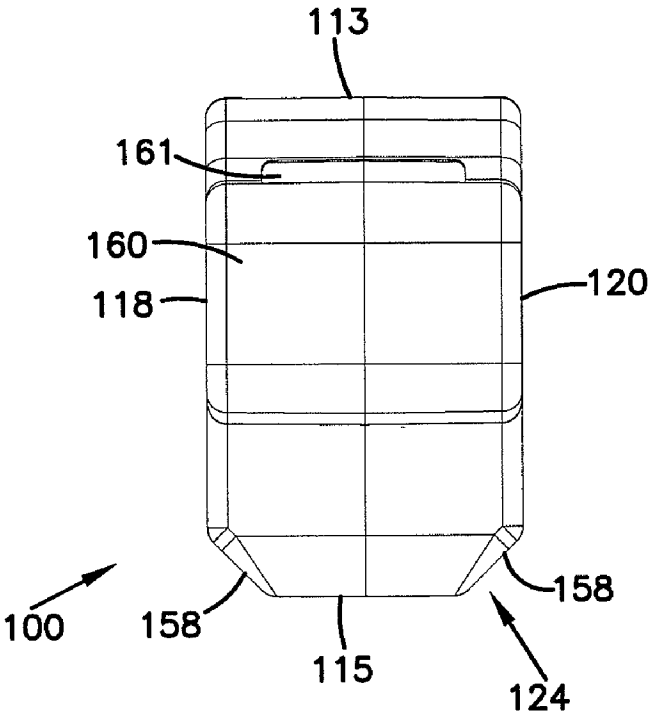
FIG. 44 is a handle-side plan view of the overvoltage protection plug of FIG. 37.
Figure 43:
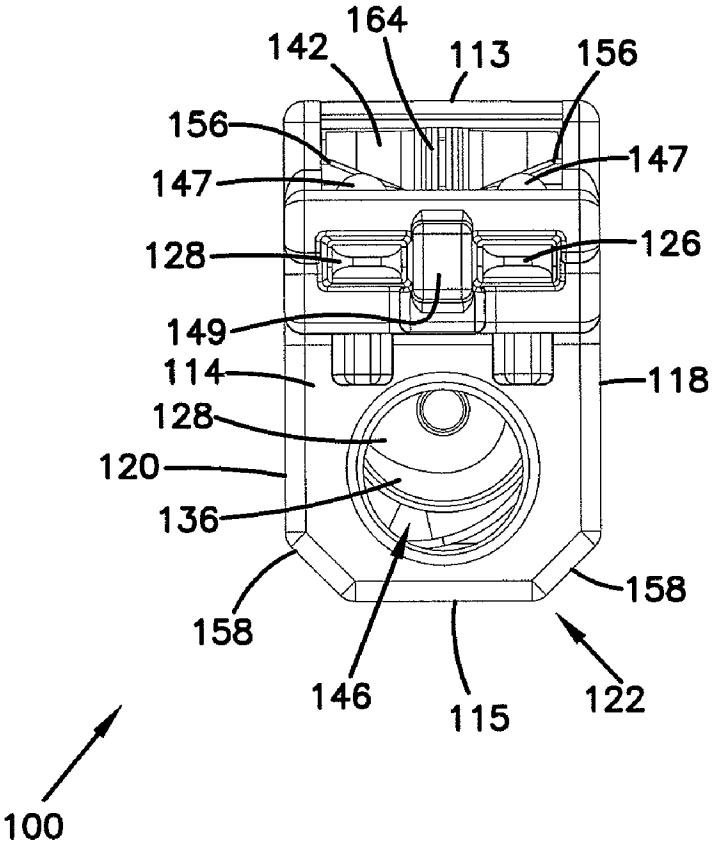
FIG. 43 is an insertion side plan view of the overvoltage protection plug of FIG. 37.
Figure 45:
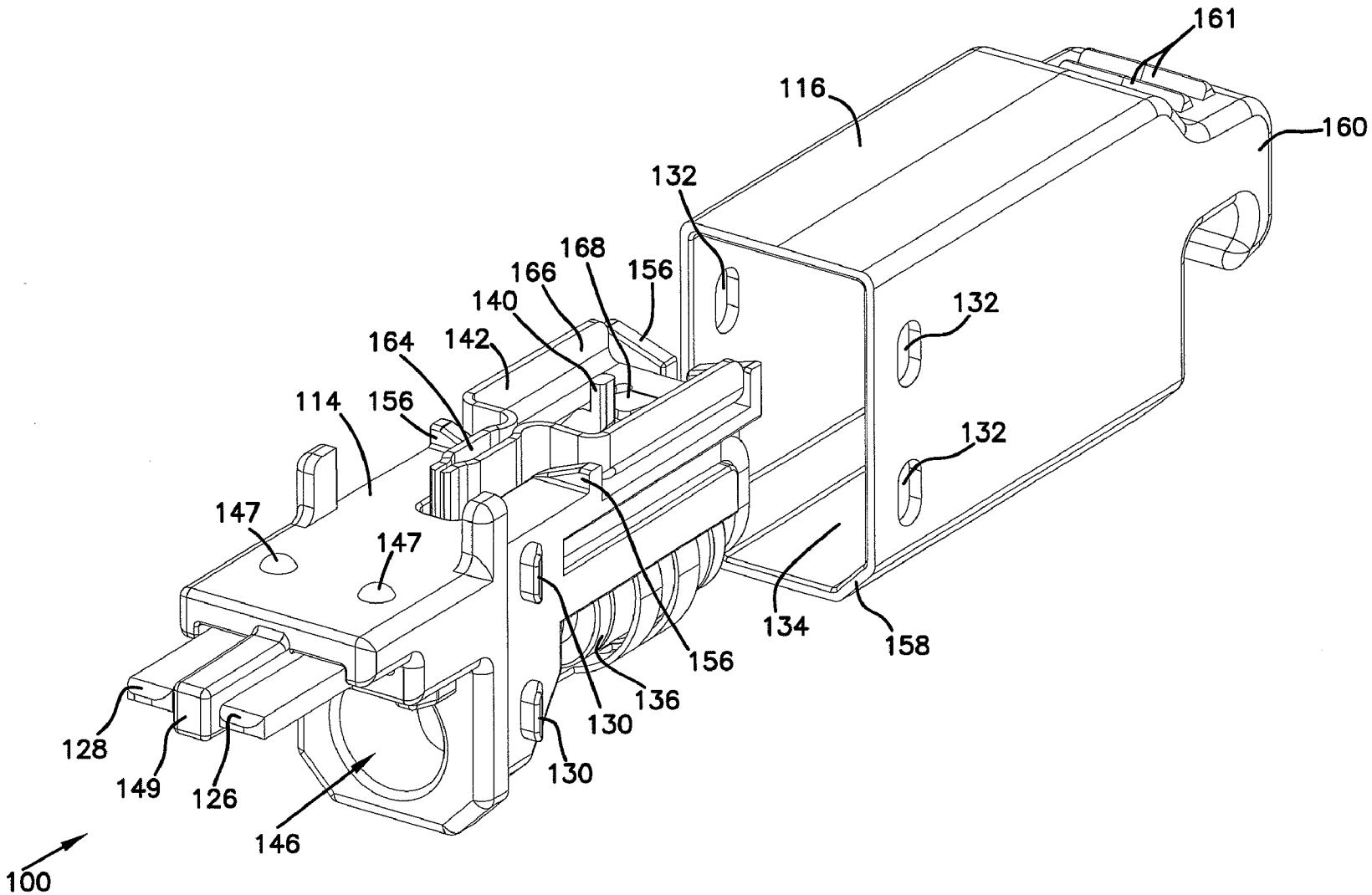
FIG. 45 is a right side partially exploded view of the overvoltage protection plug of FIG. 37, illustrating insertion of a chassis into a housing.
Figure 46:
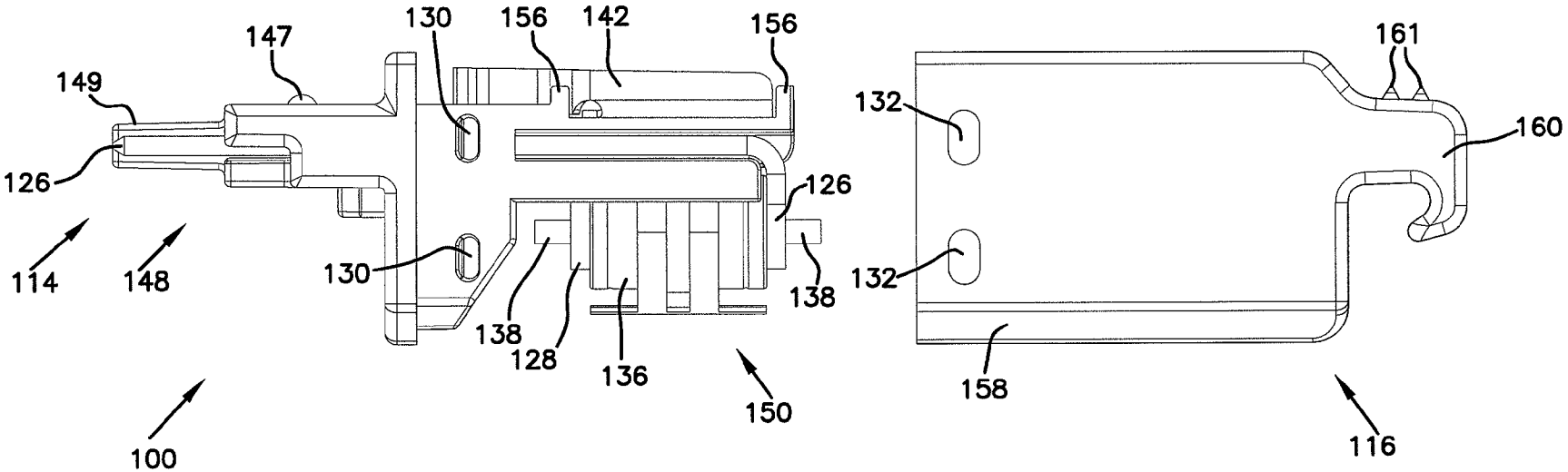
FIG. 46 is a right side plan view of the overvoltage protection plug of FIG. 45.
Figure 47:
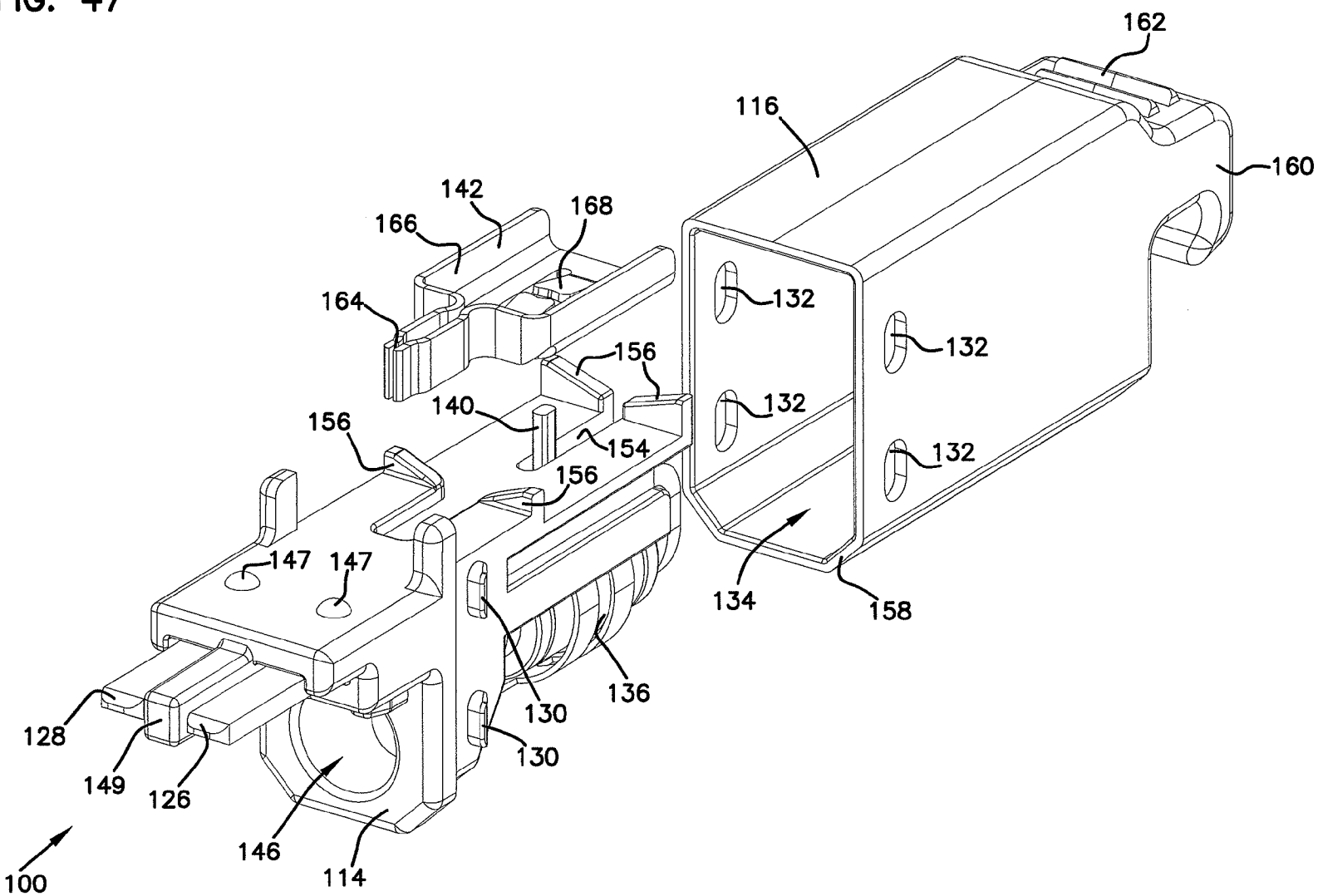
FIG. 47 is a right side partially exploded view of the overvoltage protection plug of FIG. 37, illustrating connection of a grounding plate within the plug.
Figure 48:
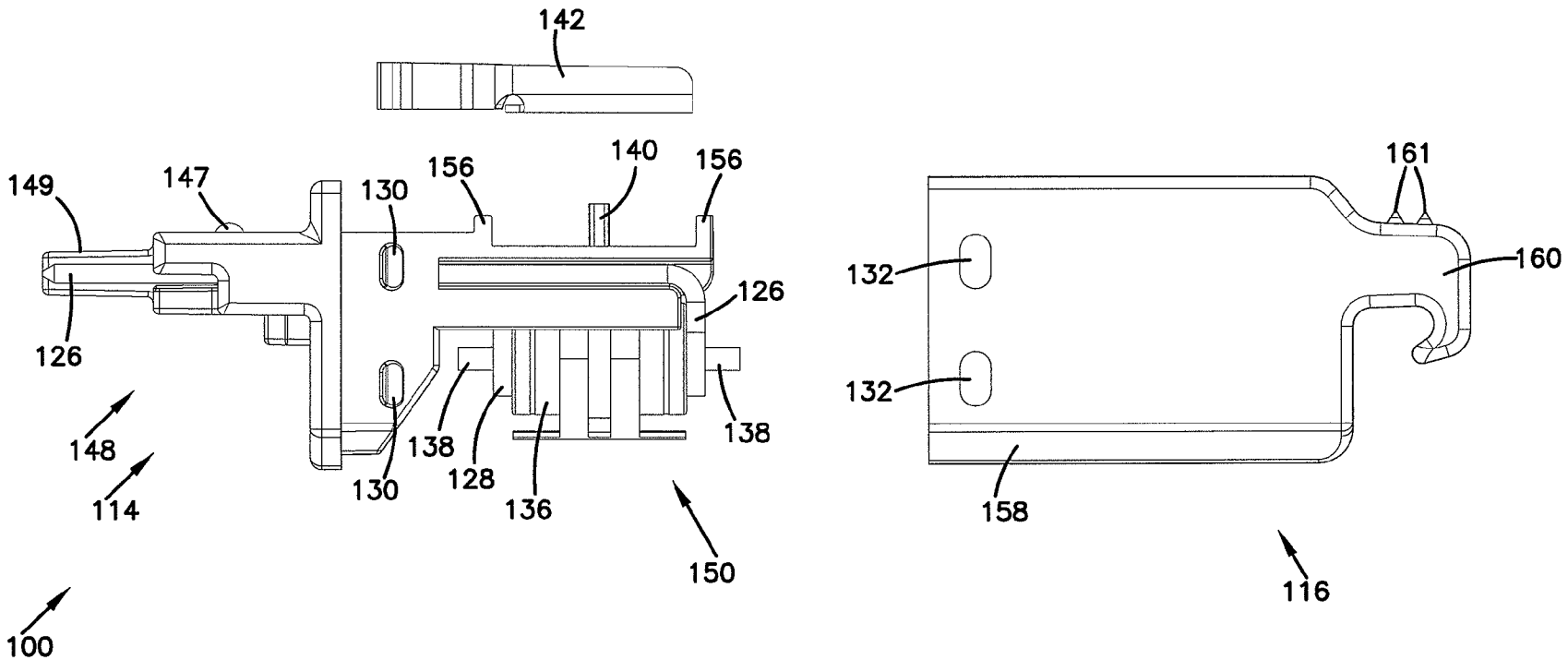
FIG. 48 is a right side plan view of the overvoltage protection plug of FIG. 47.
Figure 49:
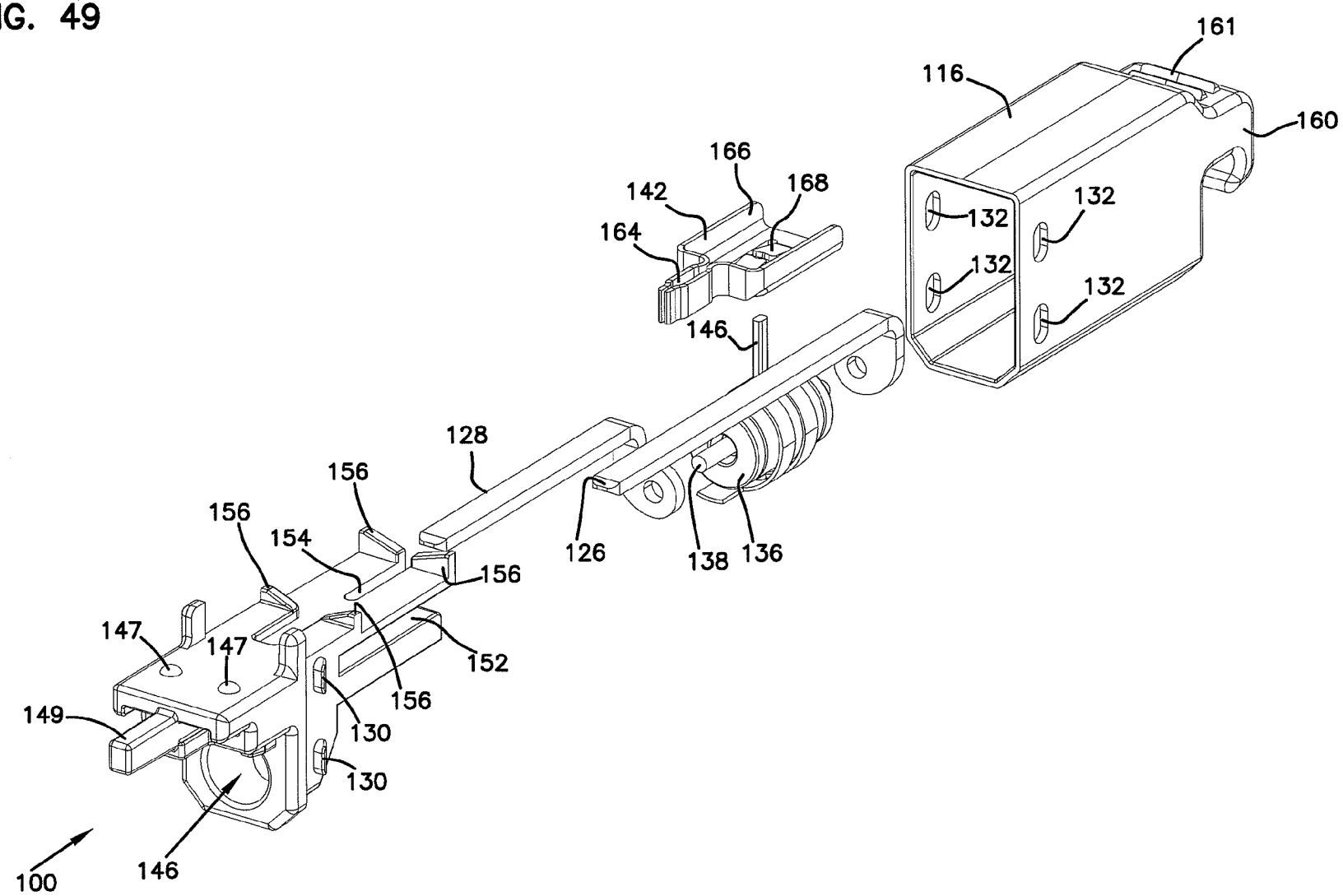
FIG. 49 is a right side perspective exploded view of the overvoltage protection plug of FIG. 37.
Figure 50:
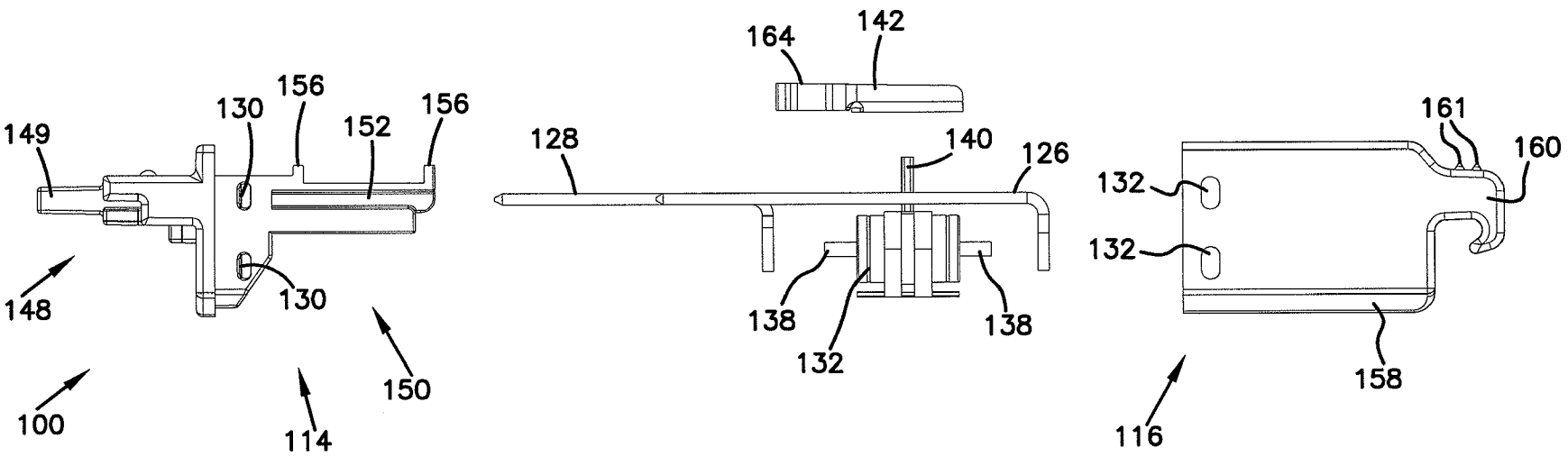
FIG. 50 is a right side plan exploded view of the overvoltage protection plug of FIG. 49.
Figure 51:
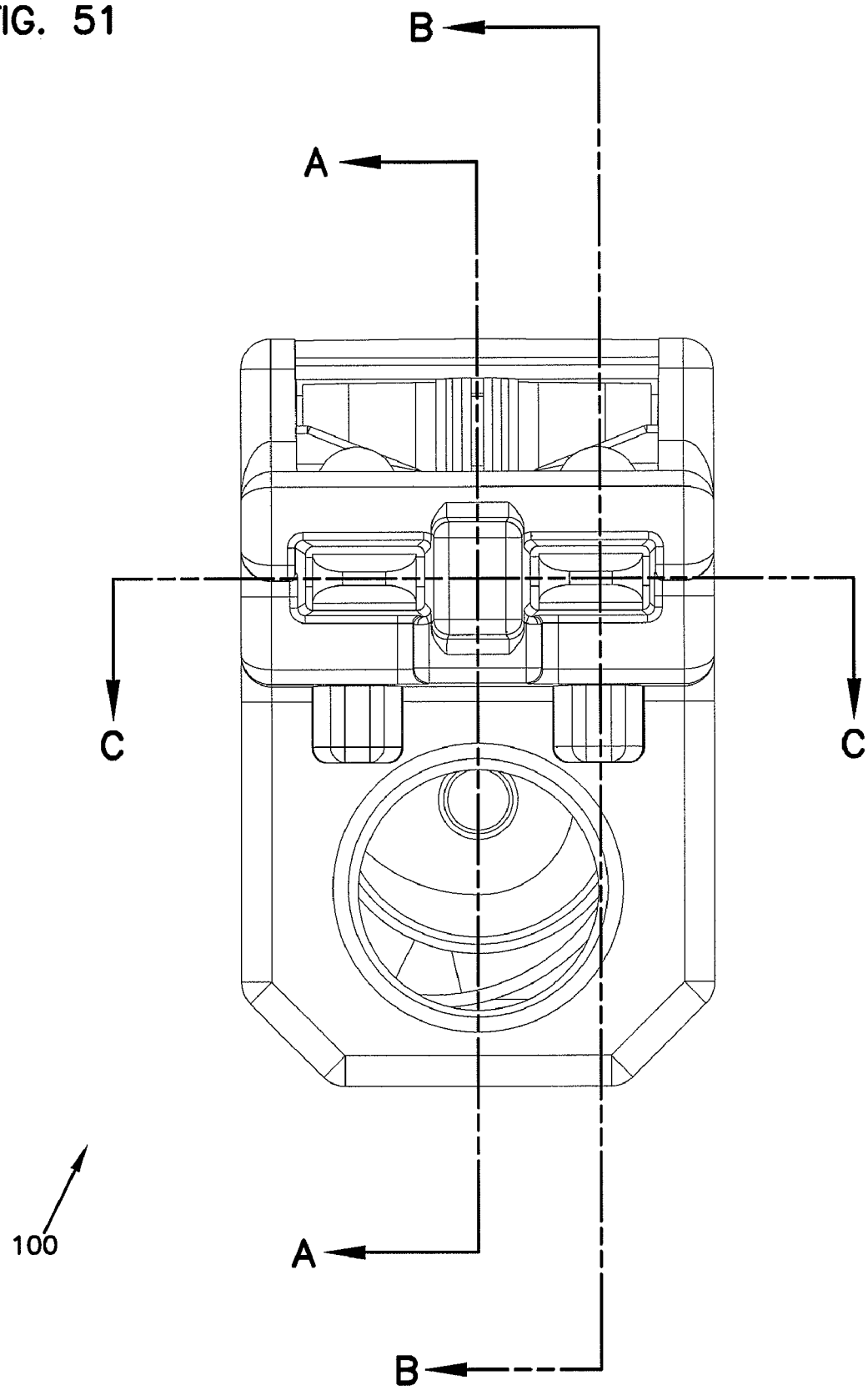
FIG. 51 is an insertion side plan view of the overvoltage protection plug illustrating cross-sectional axes for FIGS. 52-54.
Figure 52:
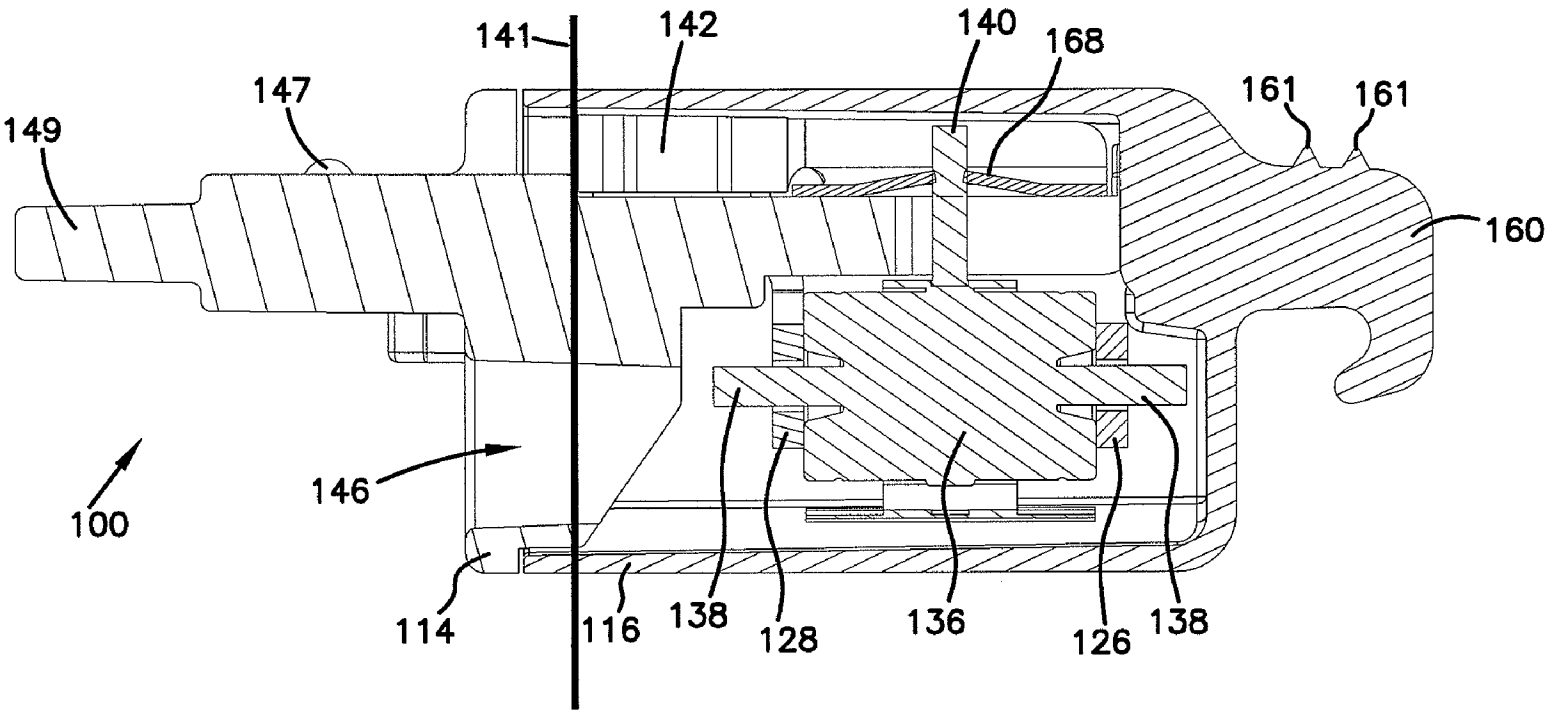
FIG. 52 is a cross-sectional view of the overvoltage protection plug of FIG. 51 along axis A.
Figure 53:
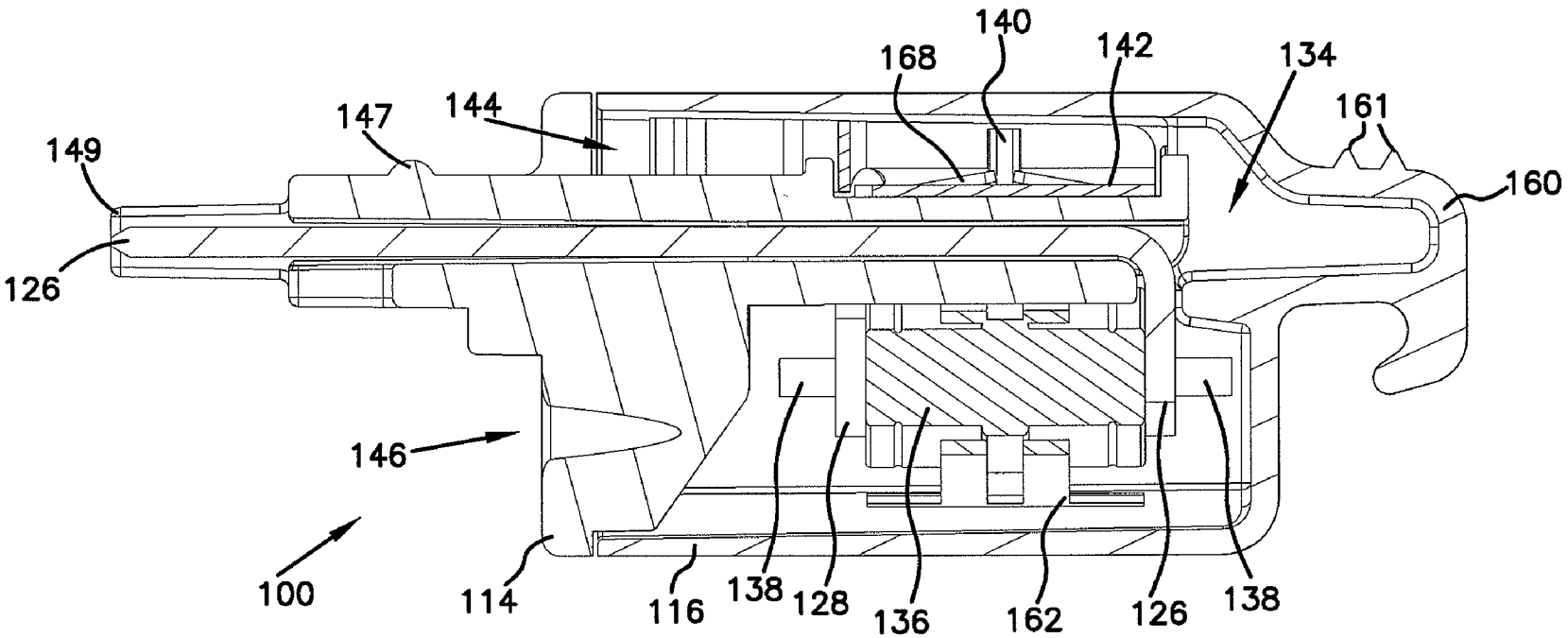
FIG. 53 is a cross-sectional view of the overvoltage protection plug of FIG. 51 along axis B.
Figure 54:
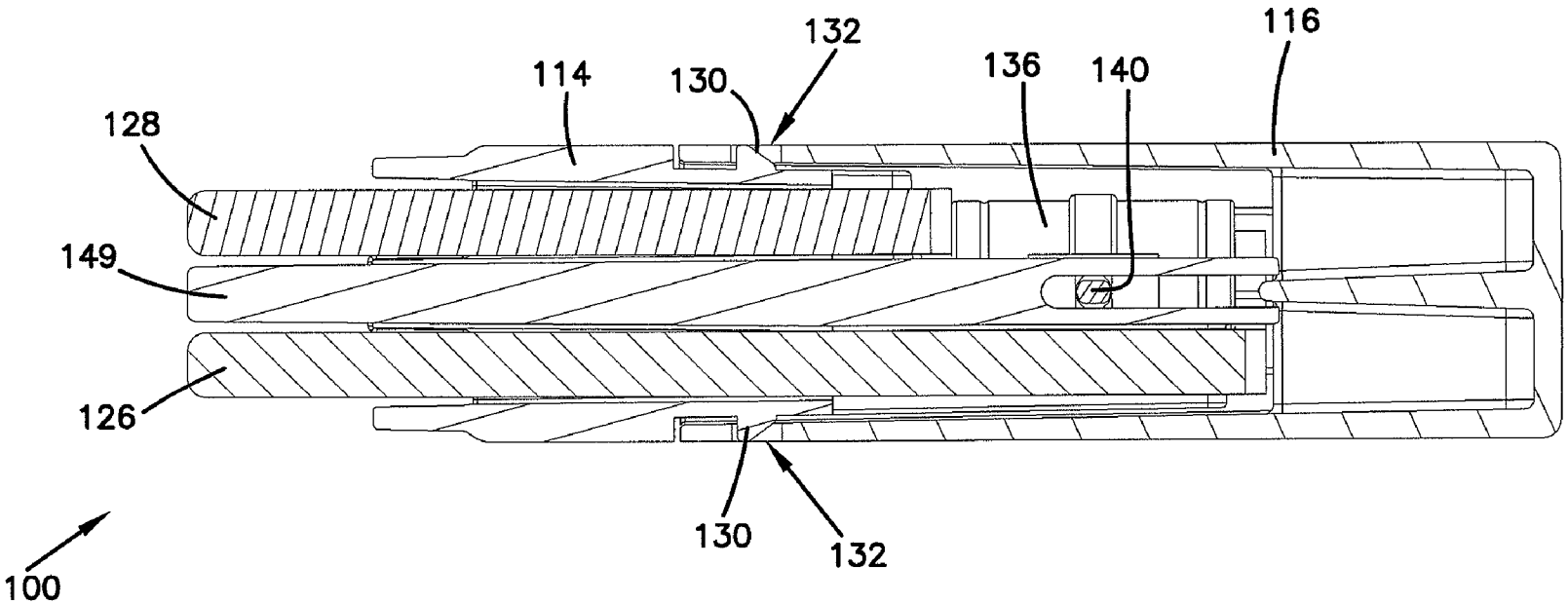
FIG. 54 is a cross-sectional view of the overvoltage protection plug of FIG. 51 along axis C.
Figure 55:
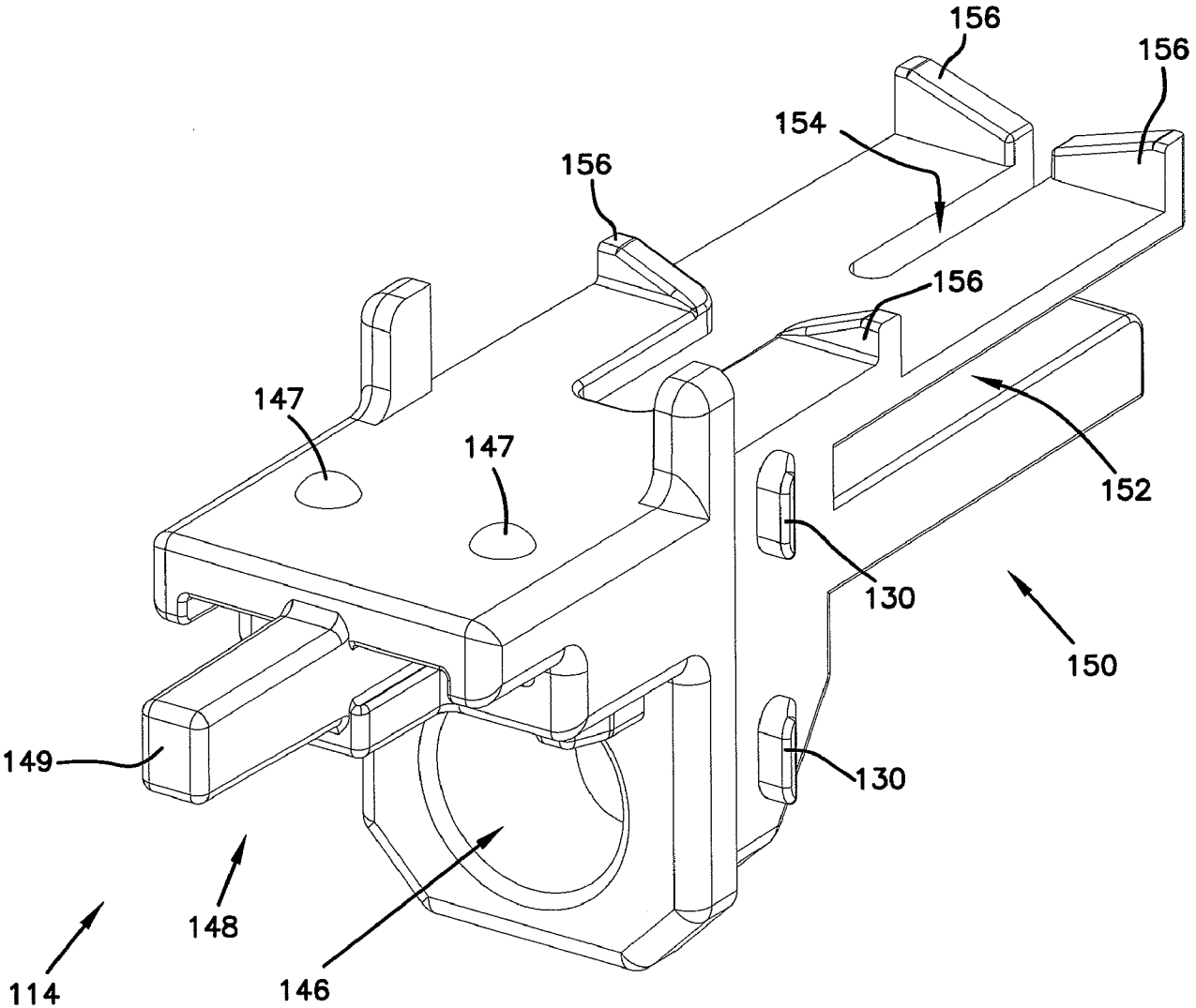
FIG. 55 is a right side perspective view of a chassis useable in the overvoltage protection plug of FIG. 37.
Figure 56:
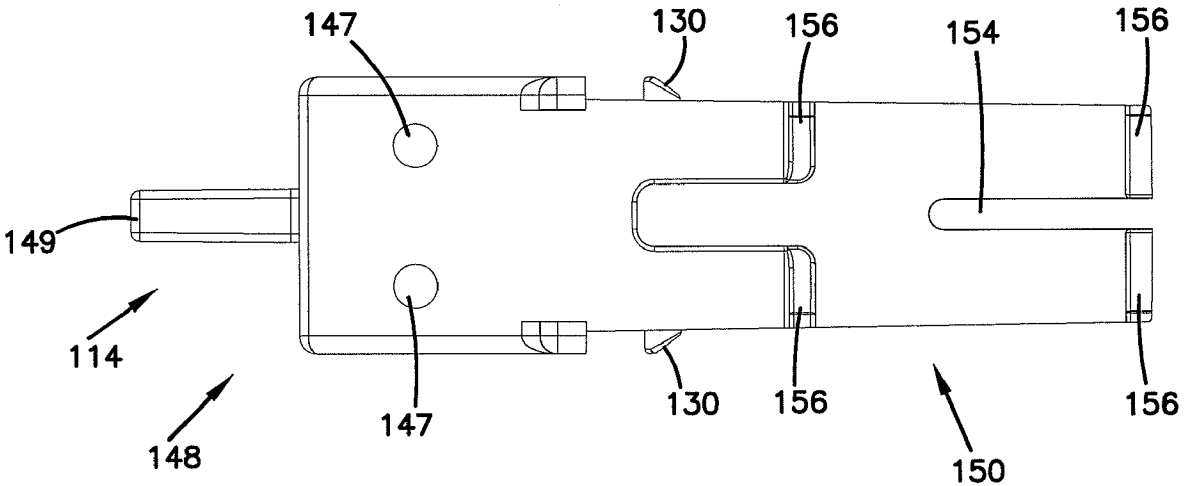
FIG. 56 is a top plan view of the chassis of FIG. 55.
Figure 57:
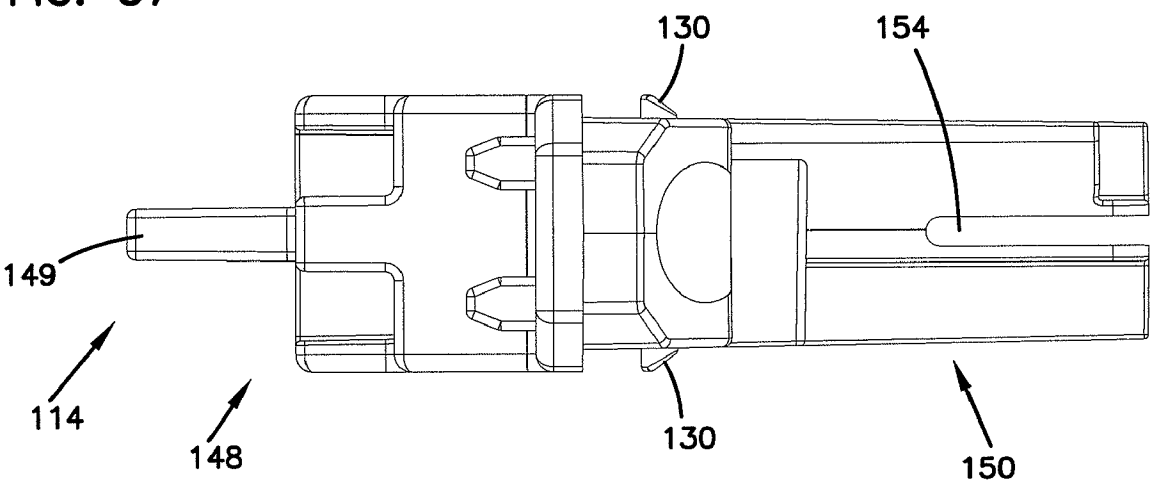
FIG. 57 is a bottom plan view of the chassis of FIG. 55.
Figure 58:
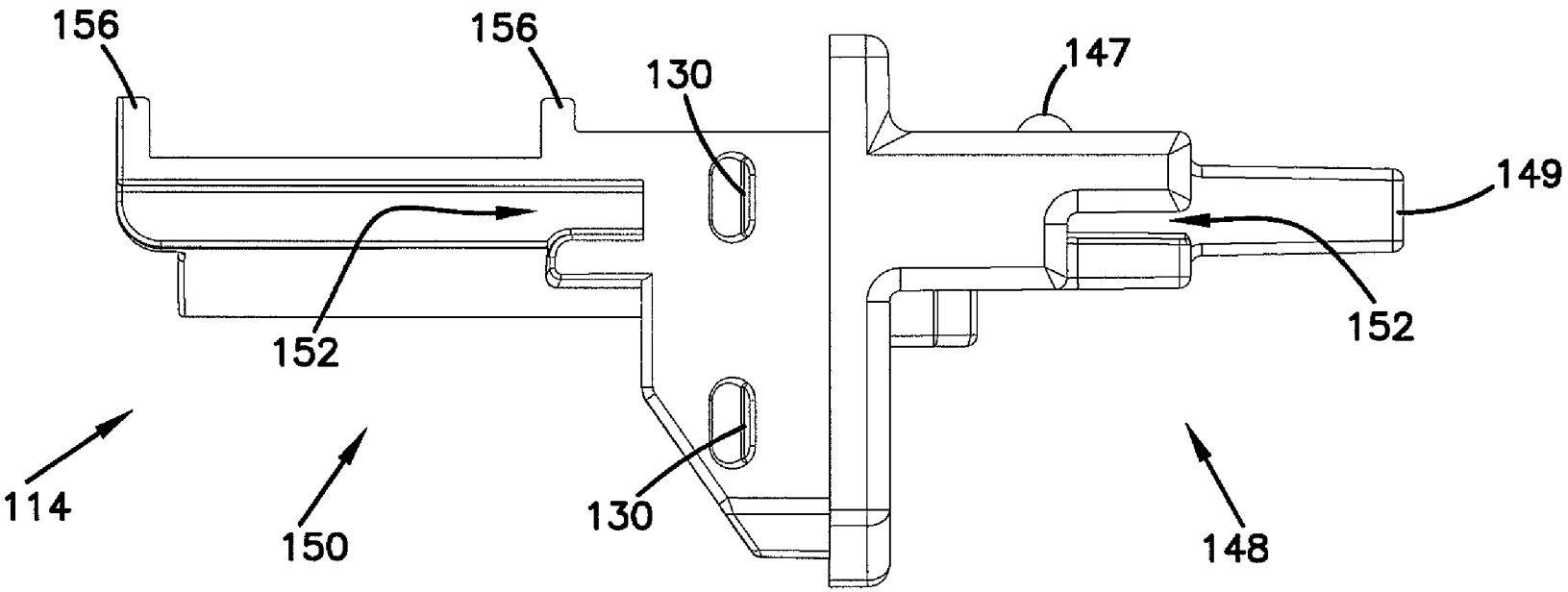
FIG. 58 is a left side plan view of the chassis of FIG. 55.
Figure 59:
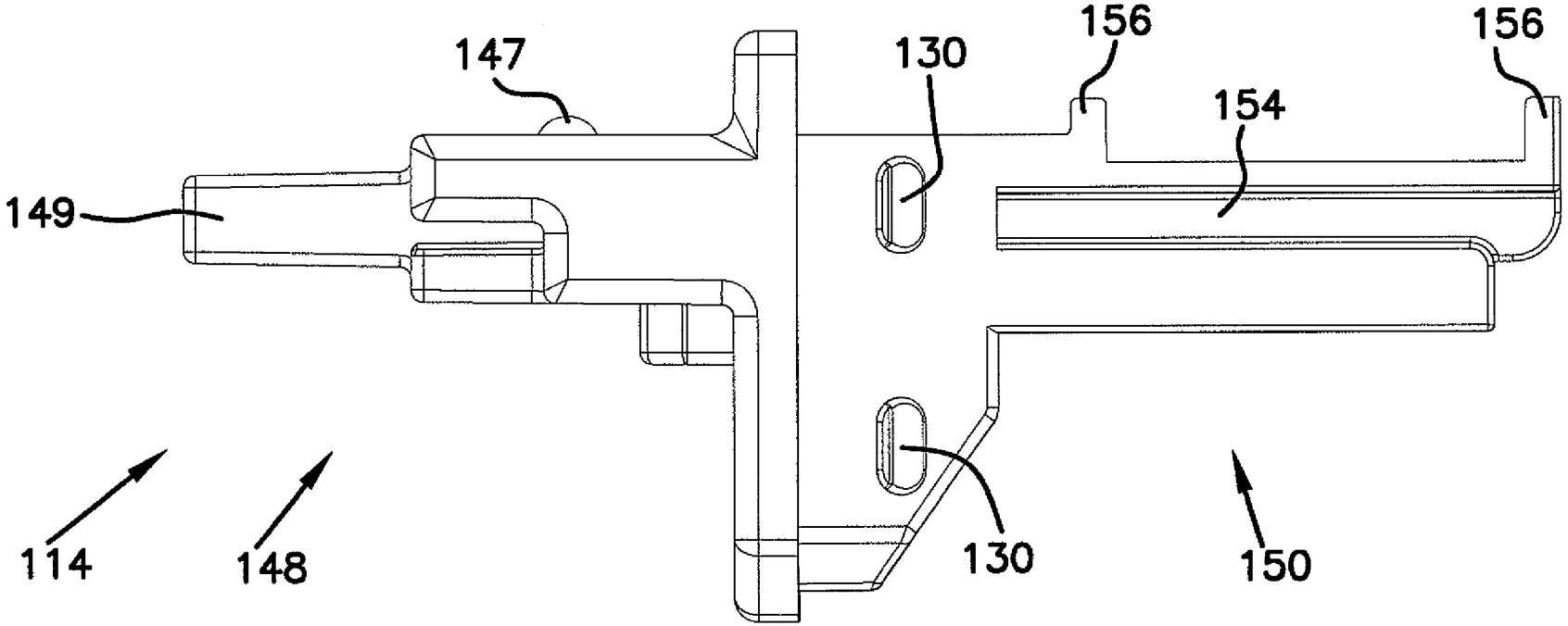
FIG. 59 is a right side plan view of the chassis of FIG. 55.
Figure 61:
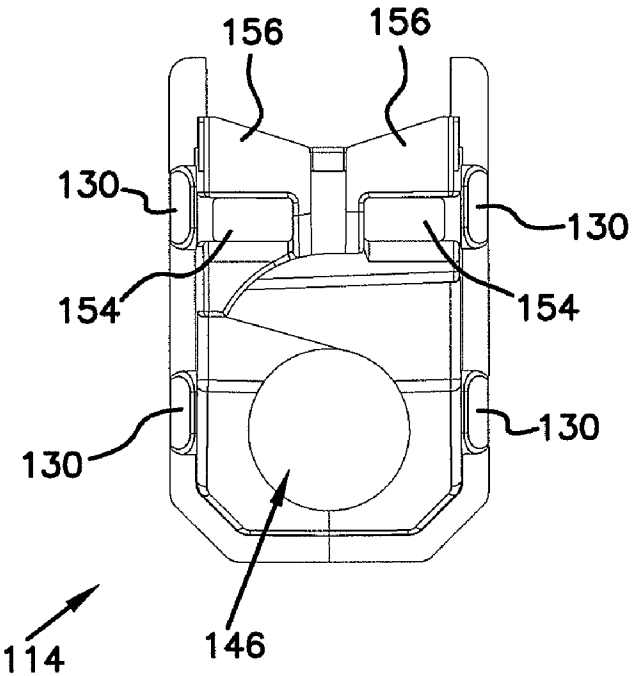
FIG. 61 is an internal side plan view of the chassis of FIG. 55.
Figure 60:
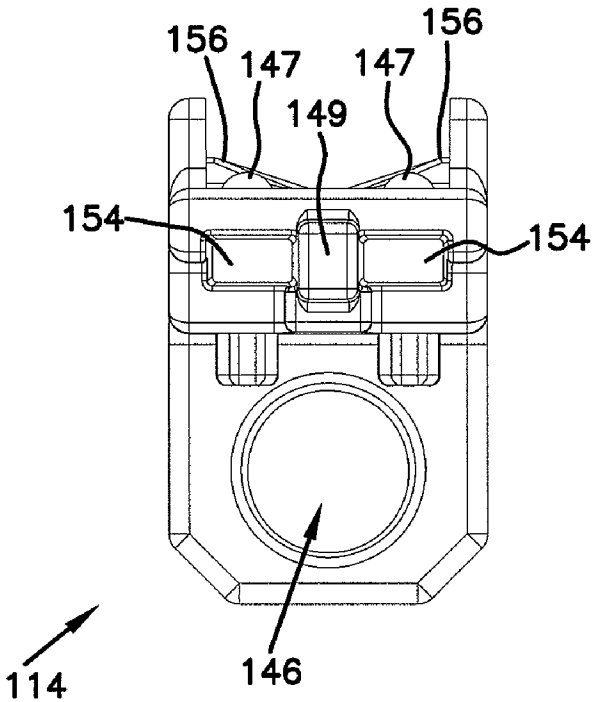
FIG. 60 is an insertion side plan view of the chassis of FIG. 55.
Figure 62:
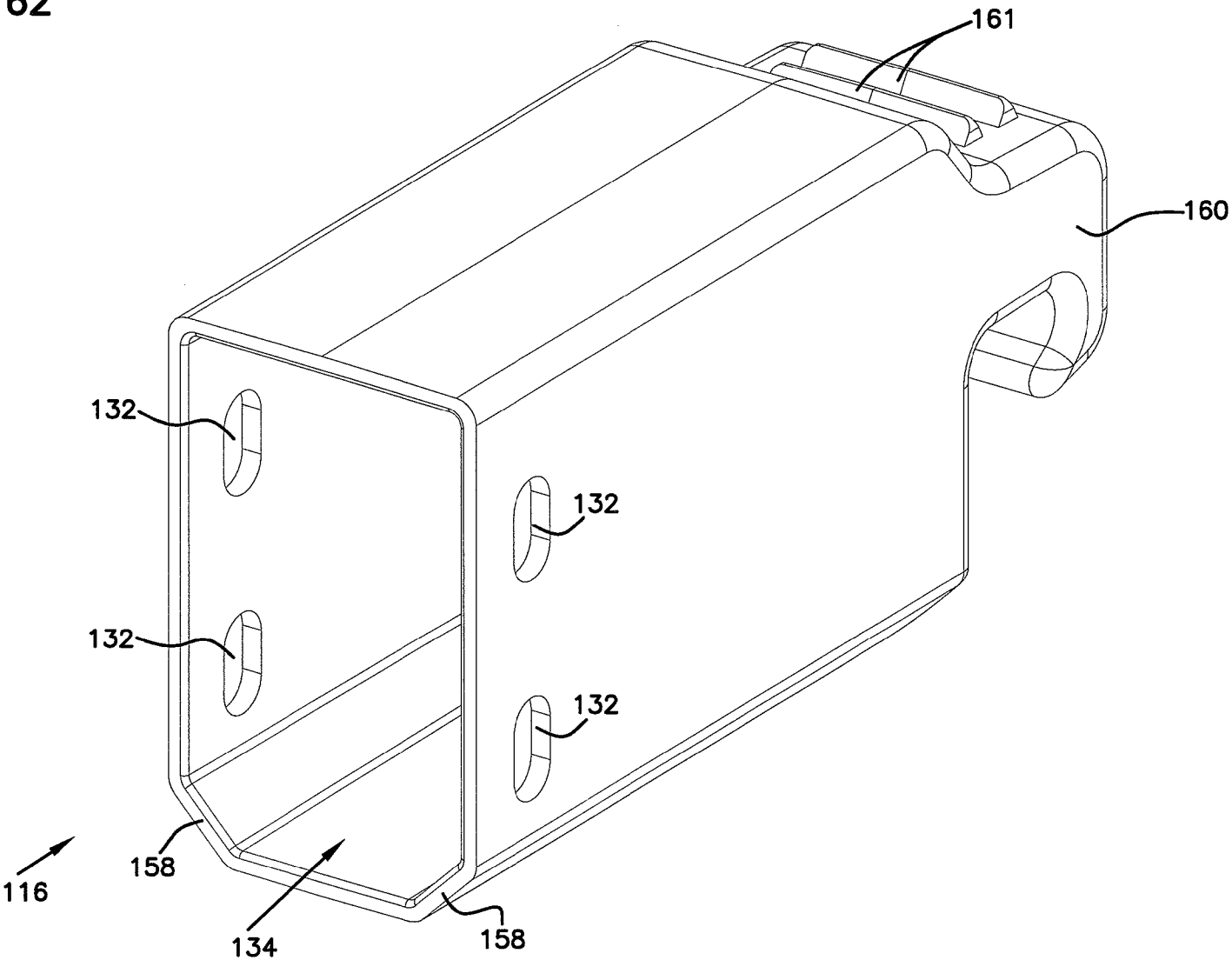
FIG. 62 is a right side perspective view of a housing useable in the overvoltage protection plug of FIG. 37.
Figure 63:
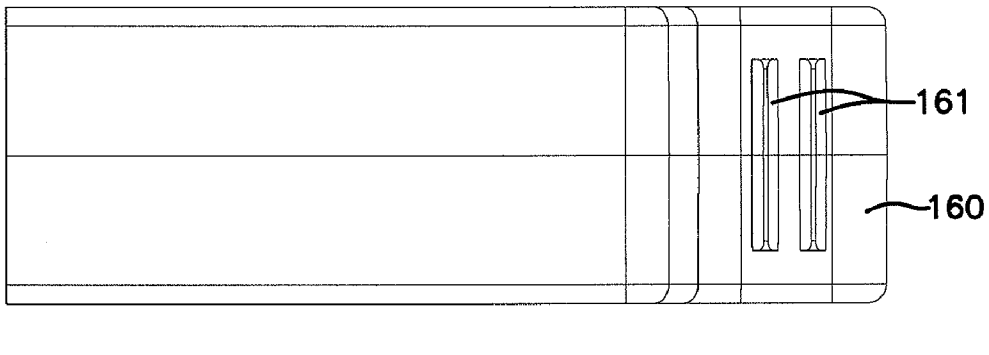
FIG. 63 is a top plan view of the housing of FIG. 62.
Figure 64:
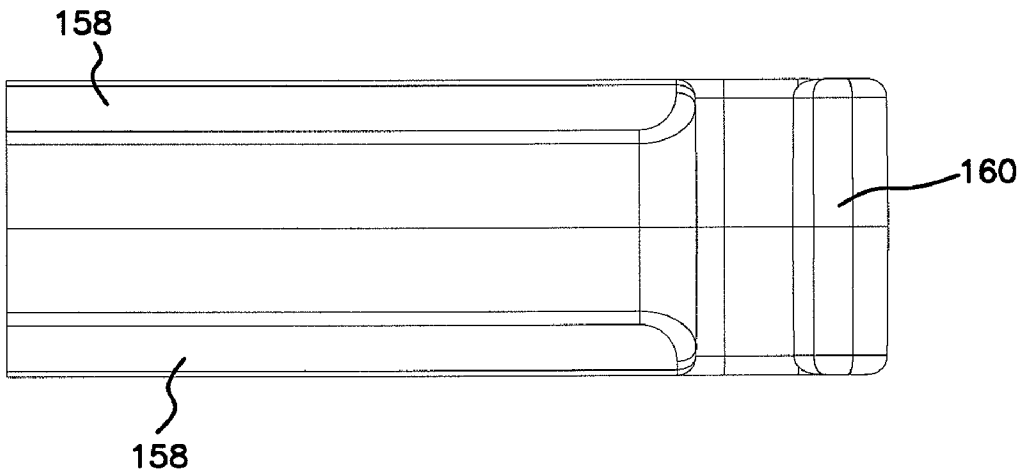
FIG. 64 is a bottom plan view of the housing of FIG. 62.
Figure 65:
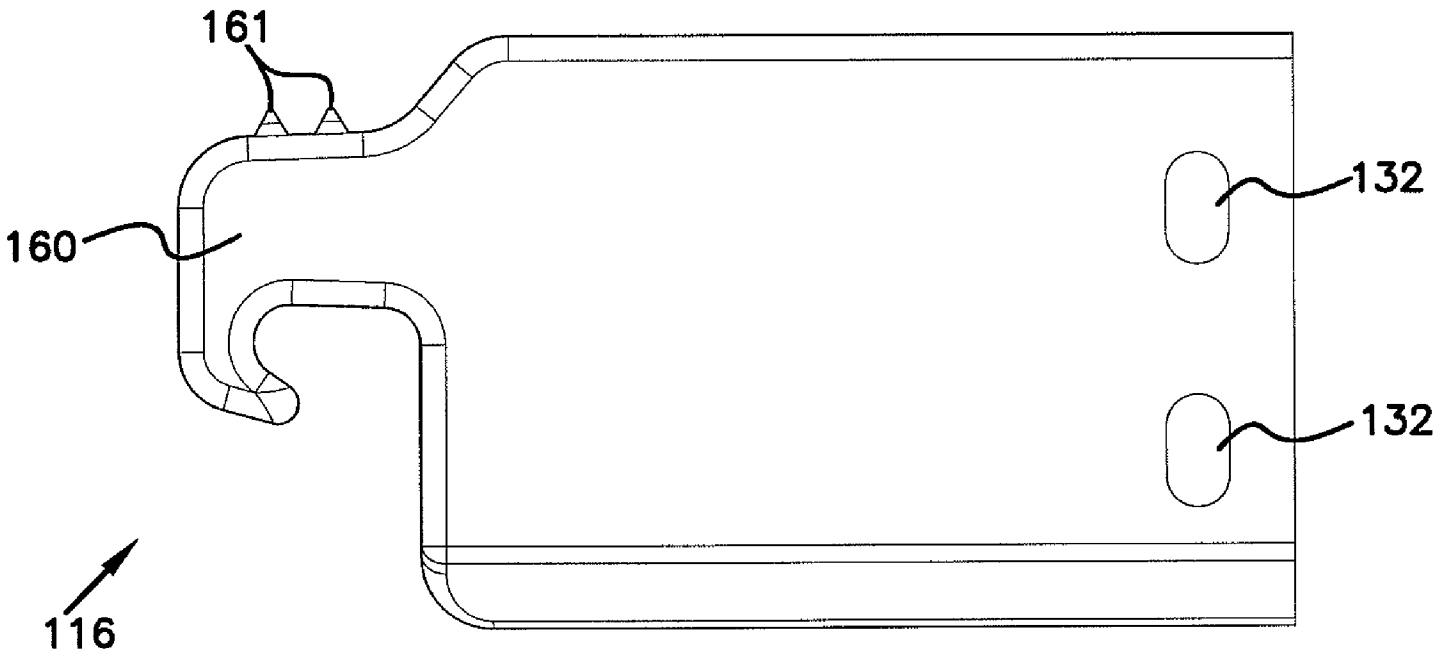
FIG. 65 is a left side plan view of the housing of FIG. 62.
Figure 66:
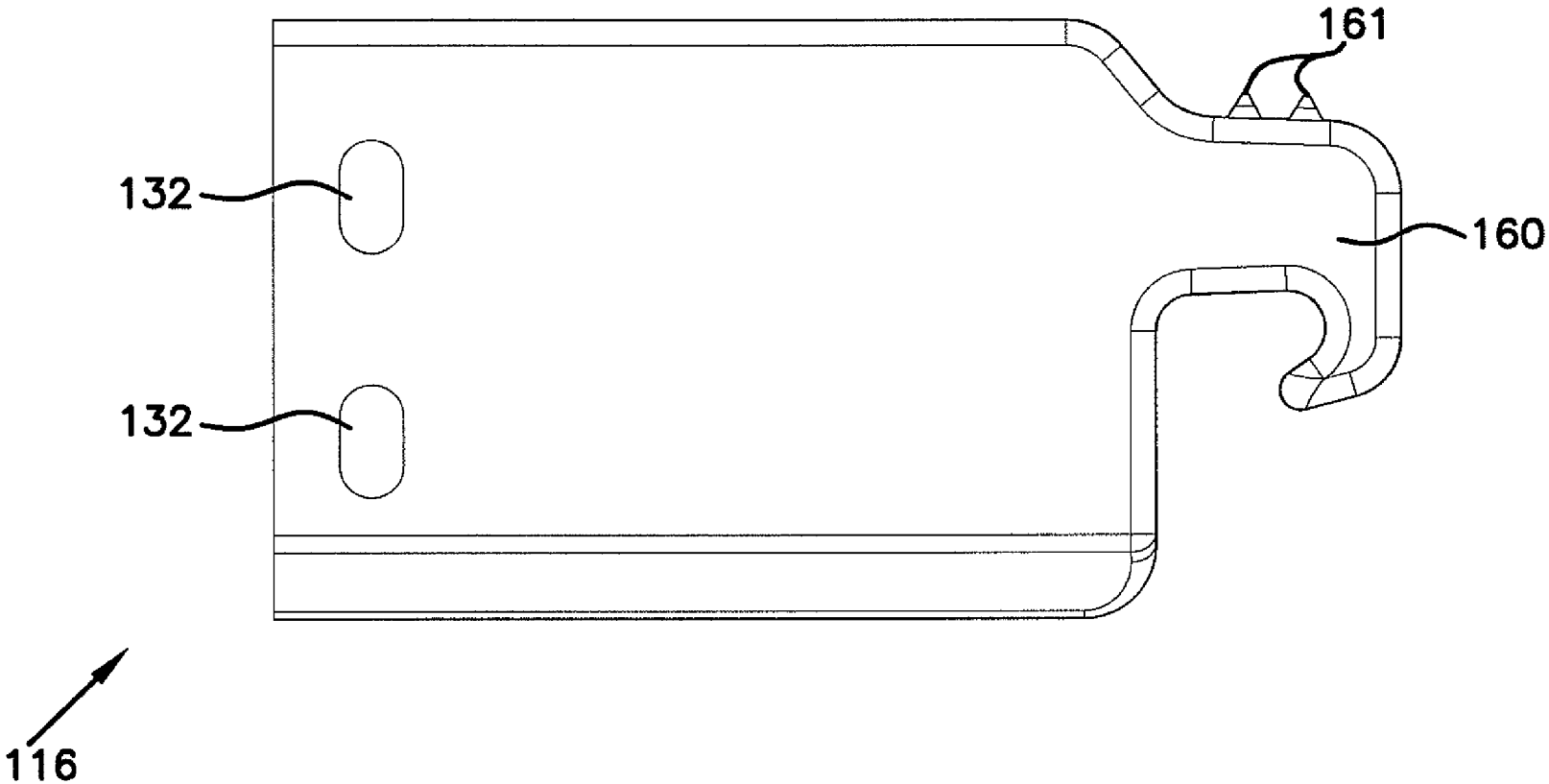
FIG. 66 is a right side plan view of the housing of FIG. 62.
Figure 68:
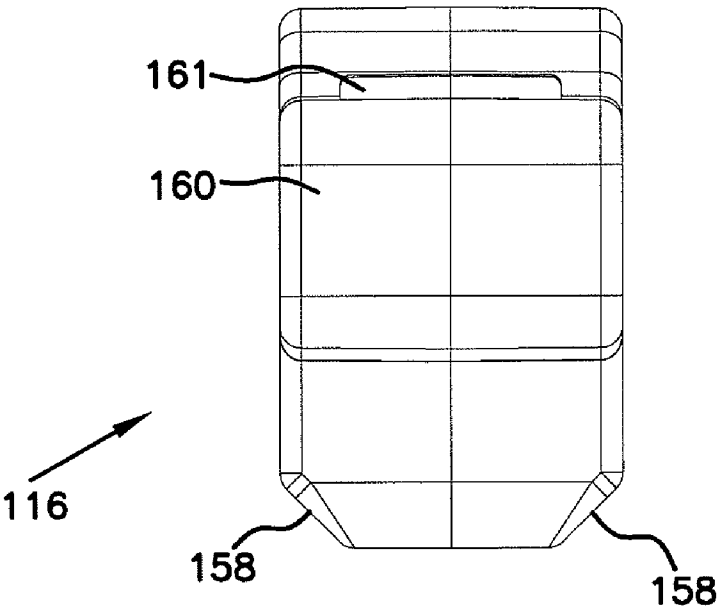
FIG. 68 is a handle side plan view of the housing of FIG. 62.
Figure 67:
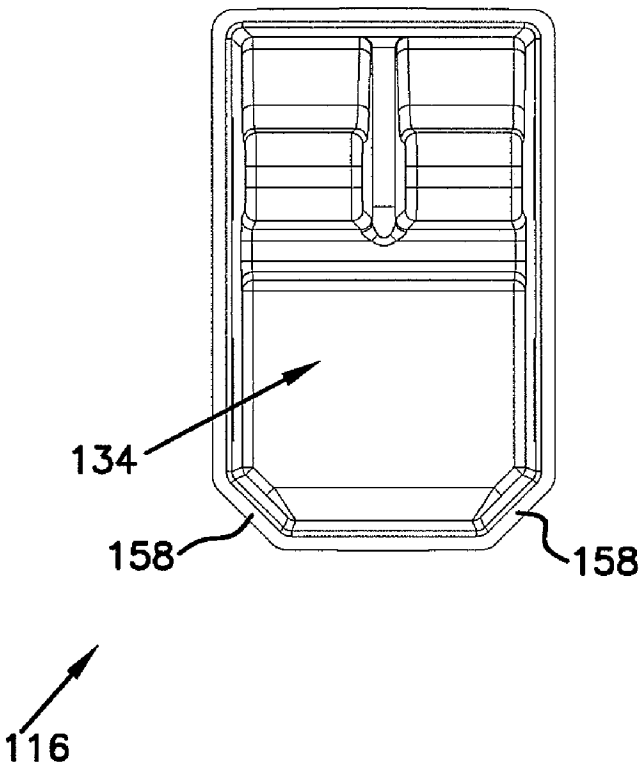
FIG. 67 is an insertion side plan view of the housing of FIG. 62.
Figure 69:
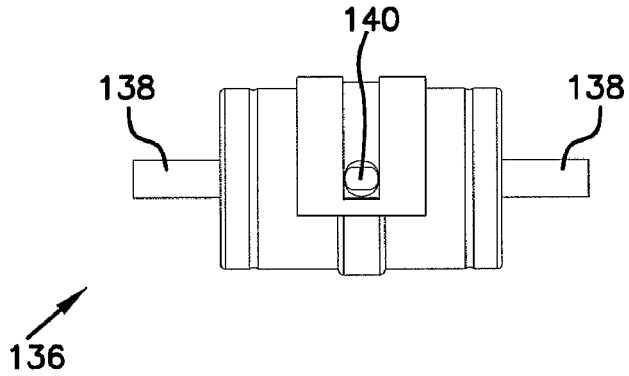
FIG. 69 is a top plan view of a gas tube useable as an overvoltage protection device in the overvoltage protection plug of FIG. 37.
Figure 70:
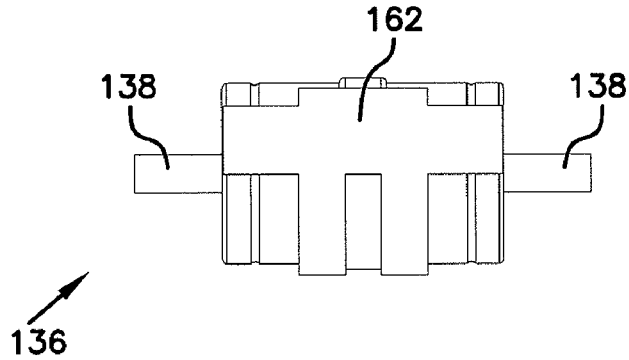
FIG. 70 is a bottom plan view of the gas tube of FIG. 69.
Figure 71:
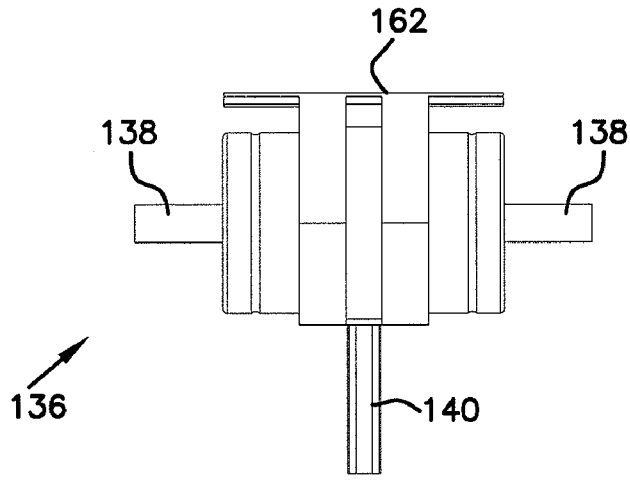
FIG. 71 is side plan view of the gas tube of FIG. 69.
Figure 73:
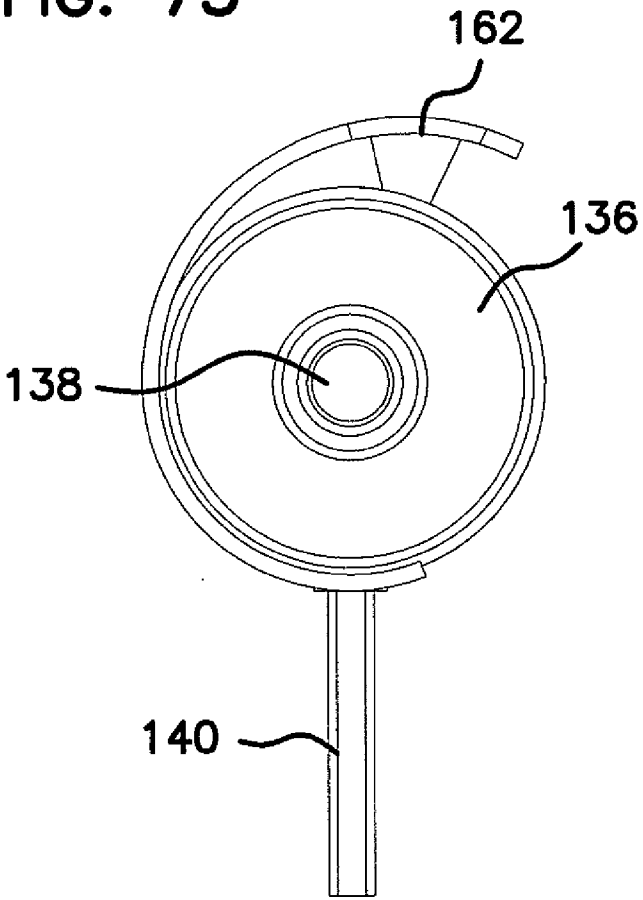
FIG. 73 is a side plan view of the gas tube of FIG. 69, opposite the side shown in FIG. 72.
Figure 72:
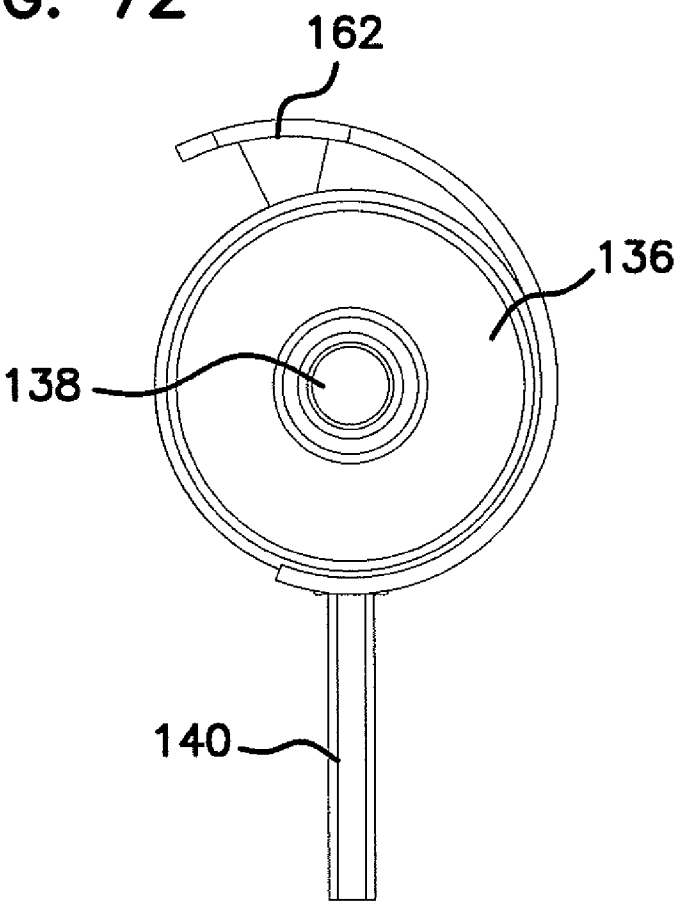
FIG. 72 is a further side plan view of the gas tube of FIG. 69, perpendicular to the view of FIG. 69.
Figure 74:
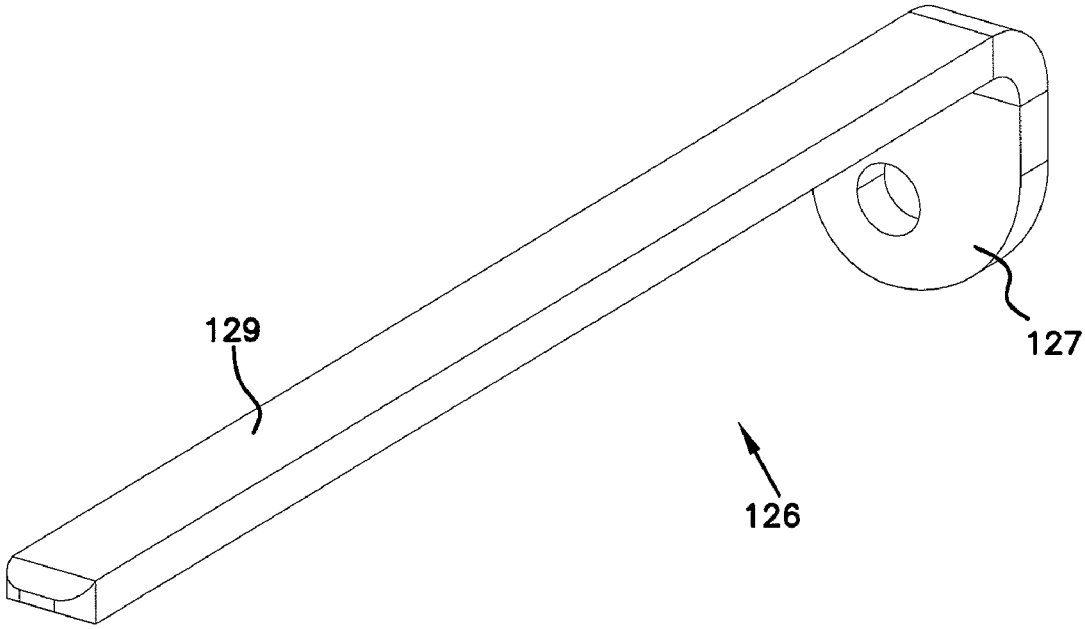
FIG. 74 is a perspective view of an electrical contact useable in the overvoltage protection plug of FIG. 37.
Figure 81:
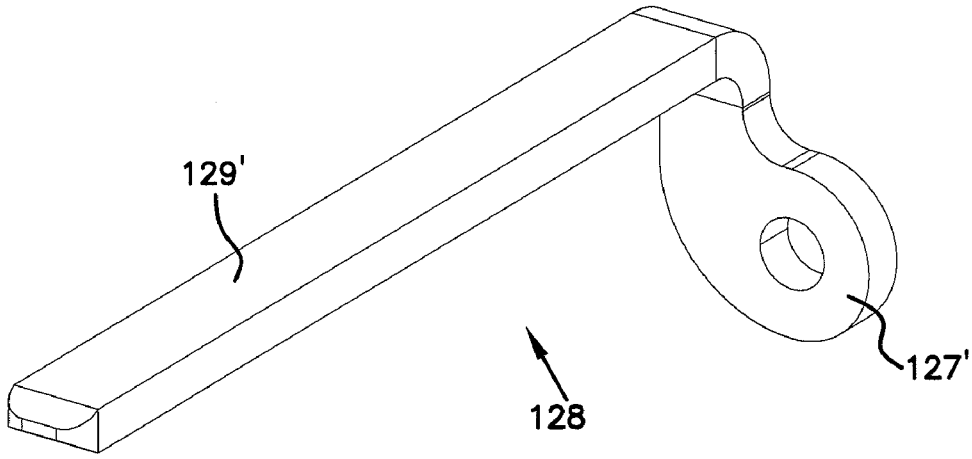
FIG. 81 is a perspective view of a second electrical contact useable in the overvoltage protection plug of FIG. 37.
Figure 75:
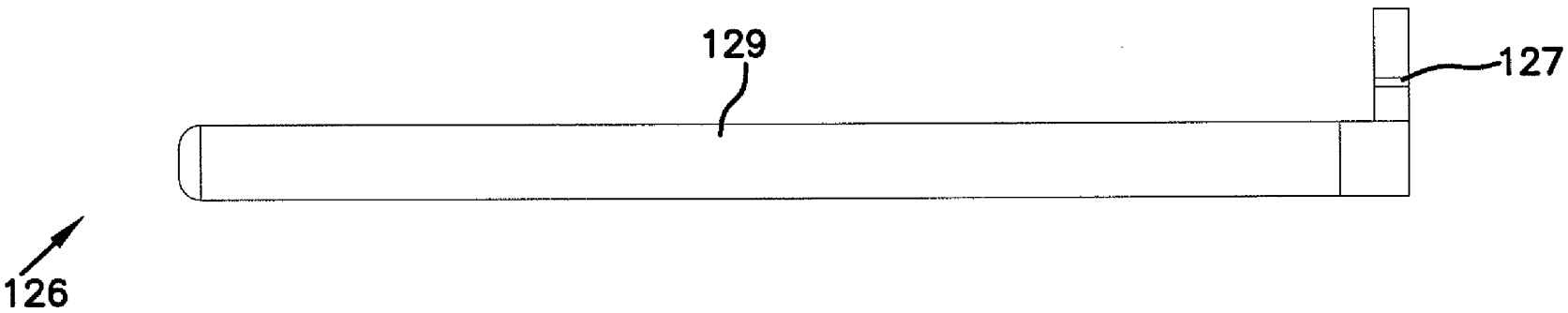
FIG. 75 is a top side plan view of the electrical contact of FIG. 74.
Figure 76:
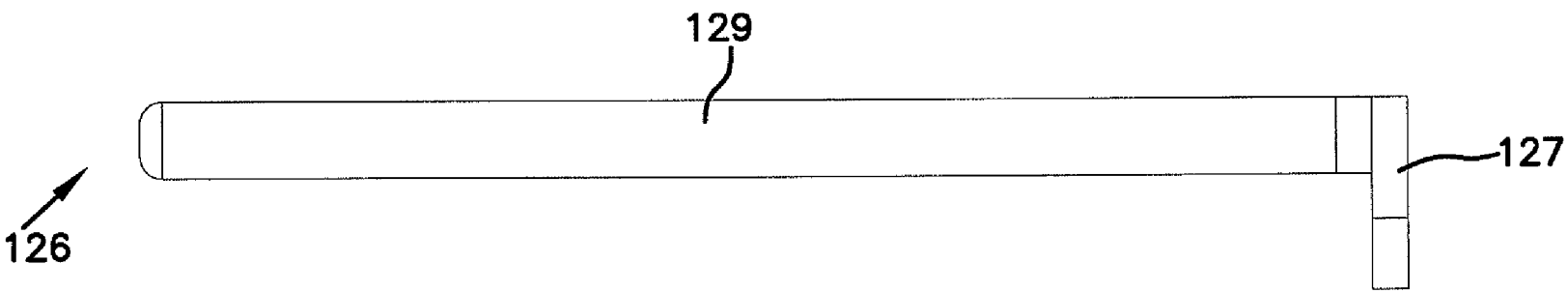
FIG. 76 is a bottom side plan view of the electrical contact of FIG. 74.
Figure 77:
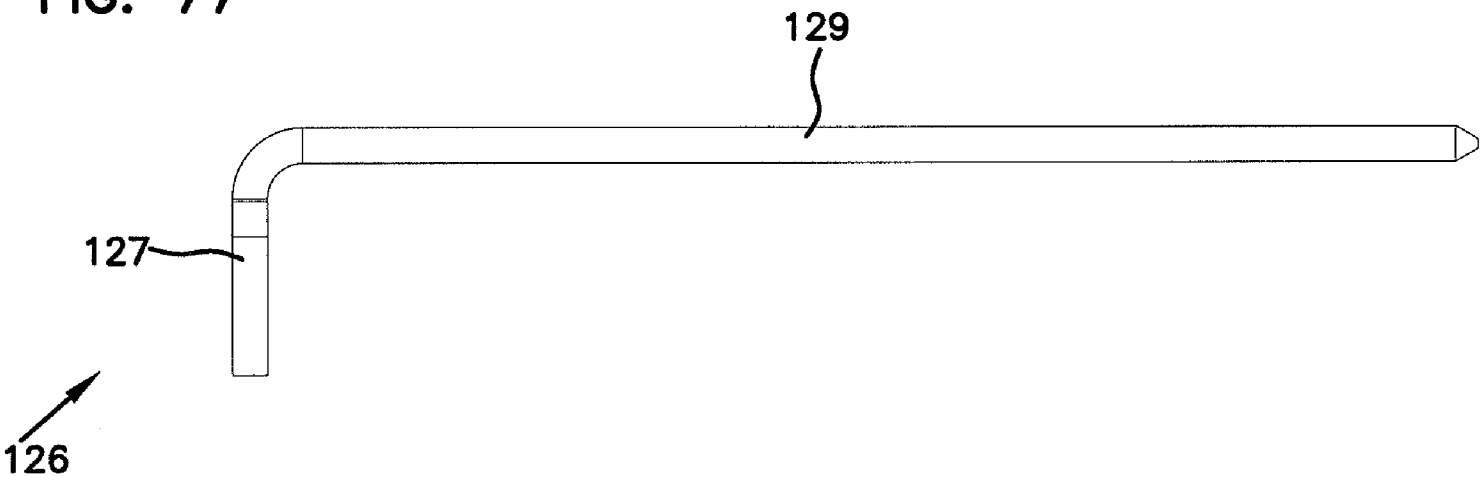
FIG. 77 is a left side plan view of the electrical contact of FIG. 74.
Figure 78:
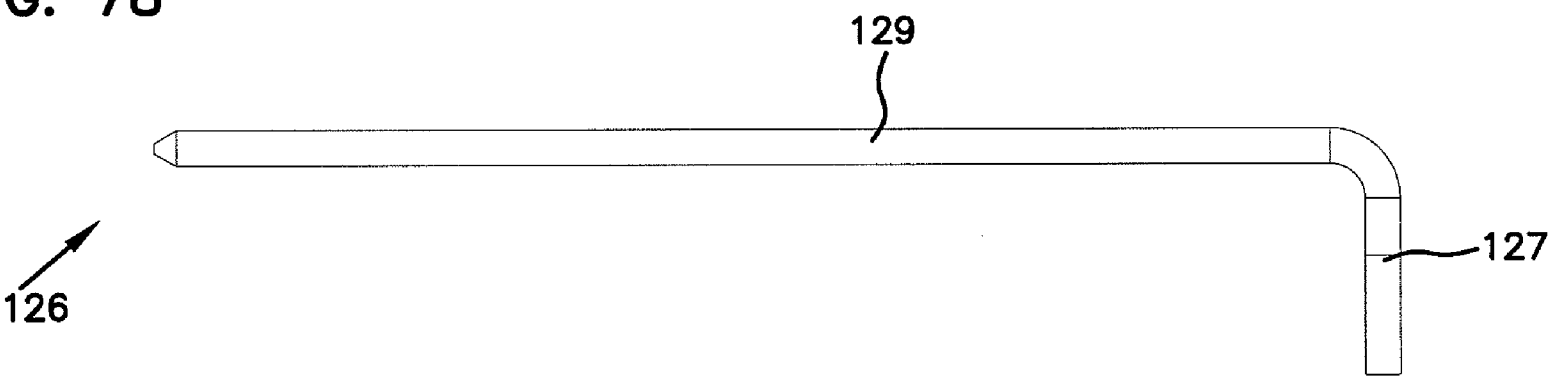
FIG. 78 is a right side plan view of the electrical contact of FIG. 74.
Figure 80:
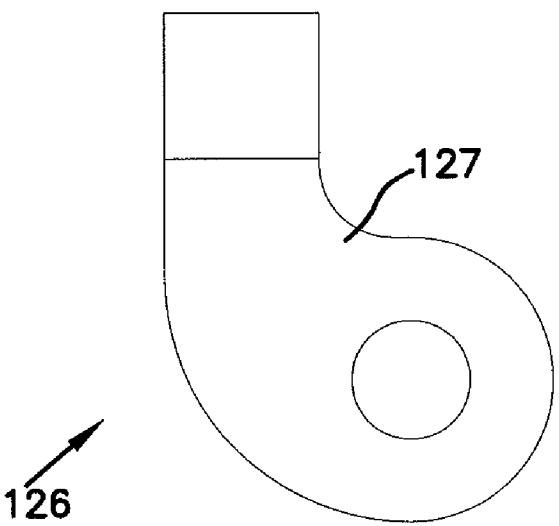
FIG. 80 is a further side plan view of the electrical contact of FIG. 74, opposite the insertion side.
Figure 79:
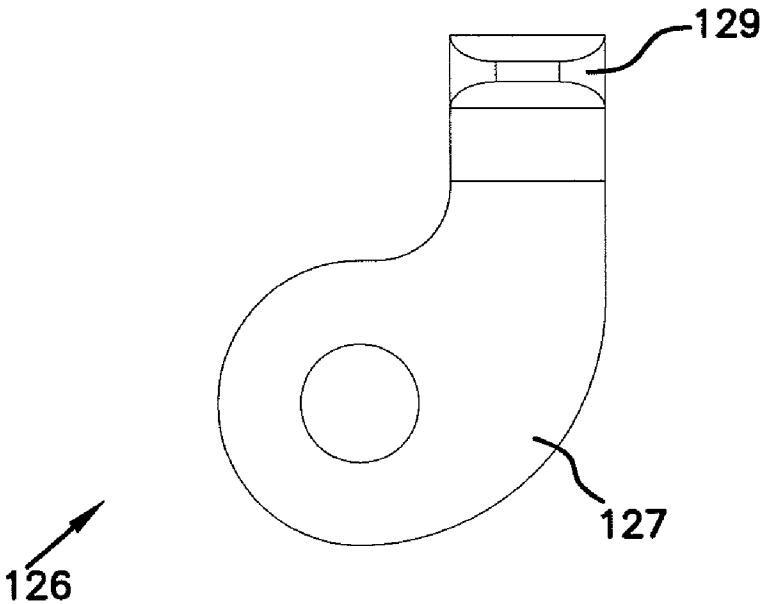
FIG. 79 is an insertion side plan view of the electrical contact of FIG. 74.
Figure 82:
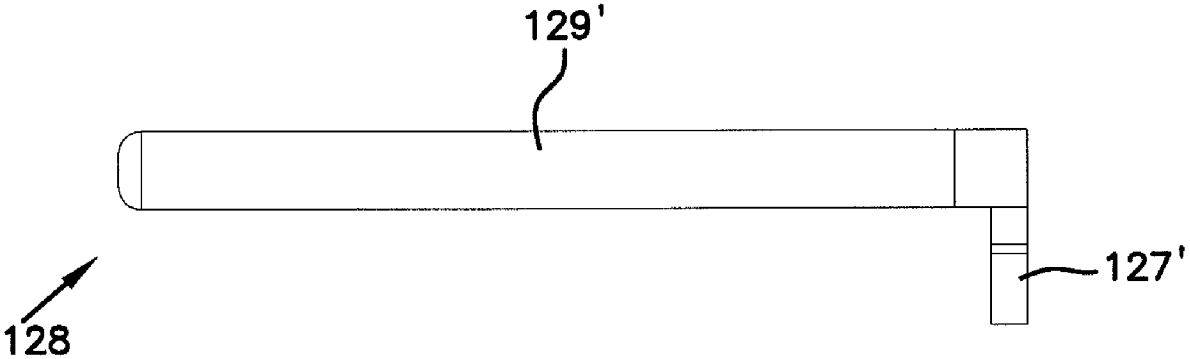
FIG. 82 is a top side plan view of the electrical contact of FIG. 81.
Figure 83:
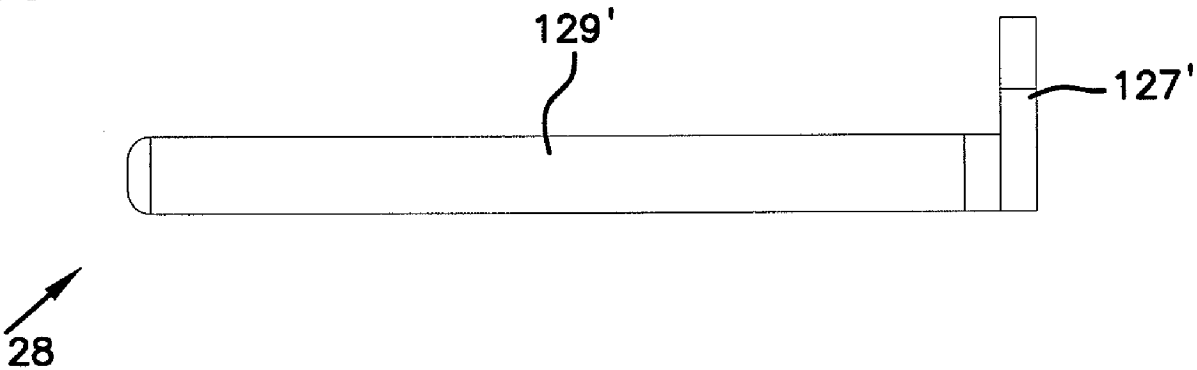
FIG. 83 is a bottom side plan view of the electrical contact of FIG. 81.
Figure 84:
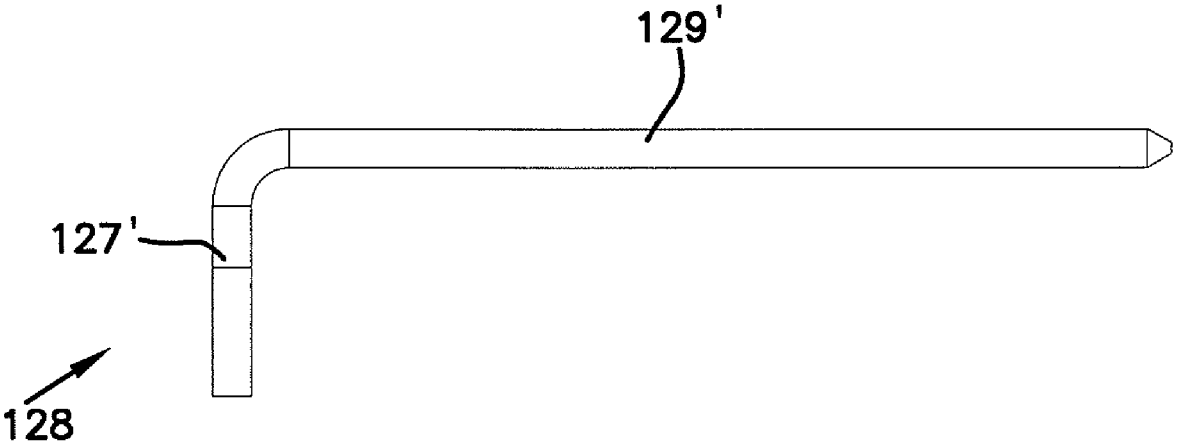
FIG. 84 is a left side plan view of the electrical contact of FIG. 81.
Figure 85:
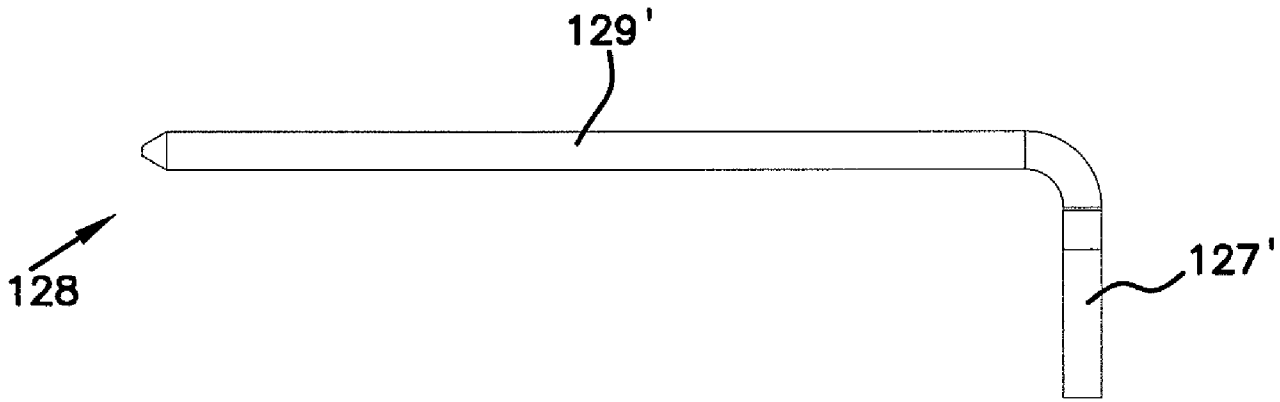
FIG. 85 is a right side plan view of the electrical contact of FIG. 81.
Figure 87:
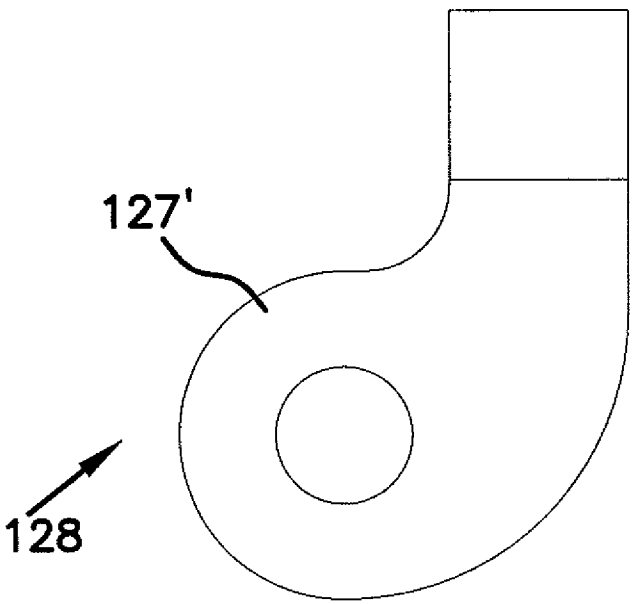
FIG. 87 is a further side plan view of the electrical contact of FIG. 81, opposite the insertion side.
Figure 86:
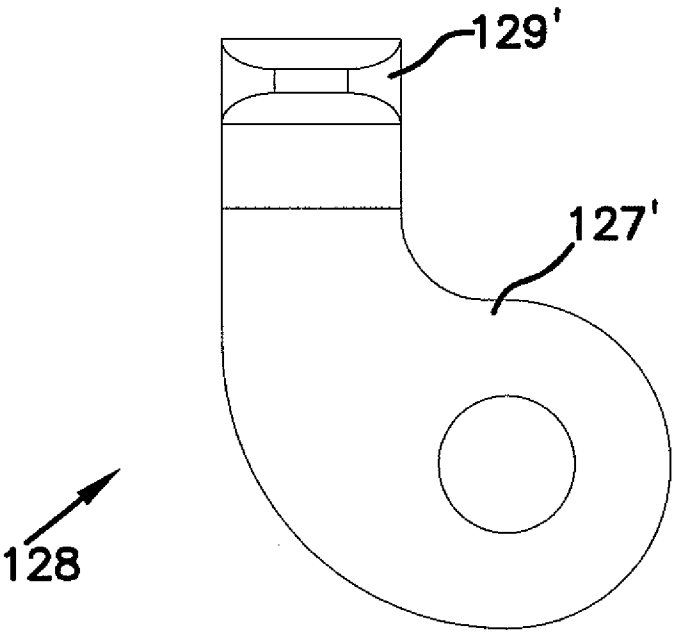
FIG. 86 is an insertion side plan view of the electrical contact of FIG. 81.
Figure 88:
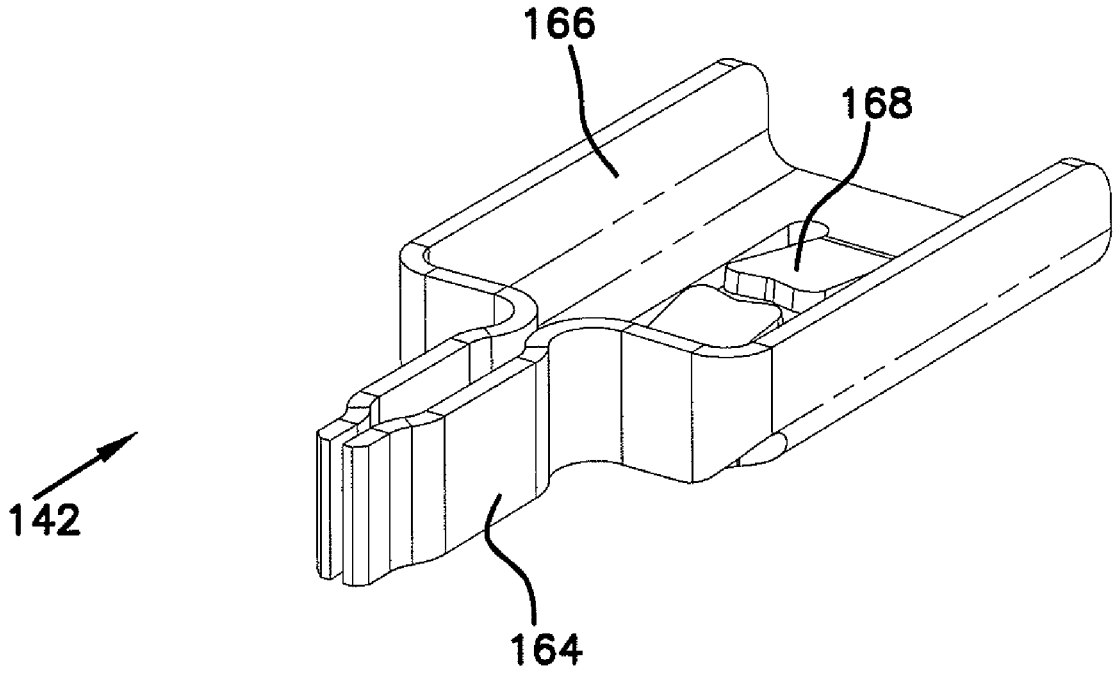
FIG. 88 is a perspective view of a grounding plate useable in the overvoltage protection plug of FIG. 37.
Figure 89:
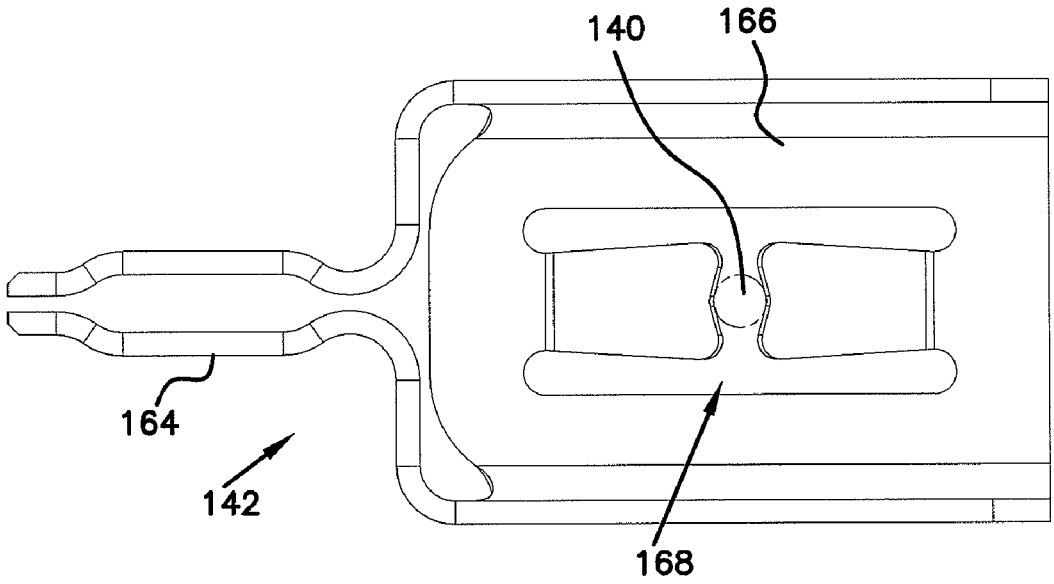
FIG. 89 is a top plan view of the grounding plate of FIG. 88.
Figure 90:
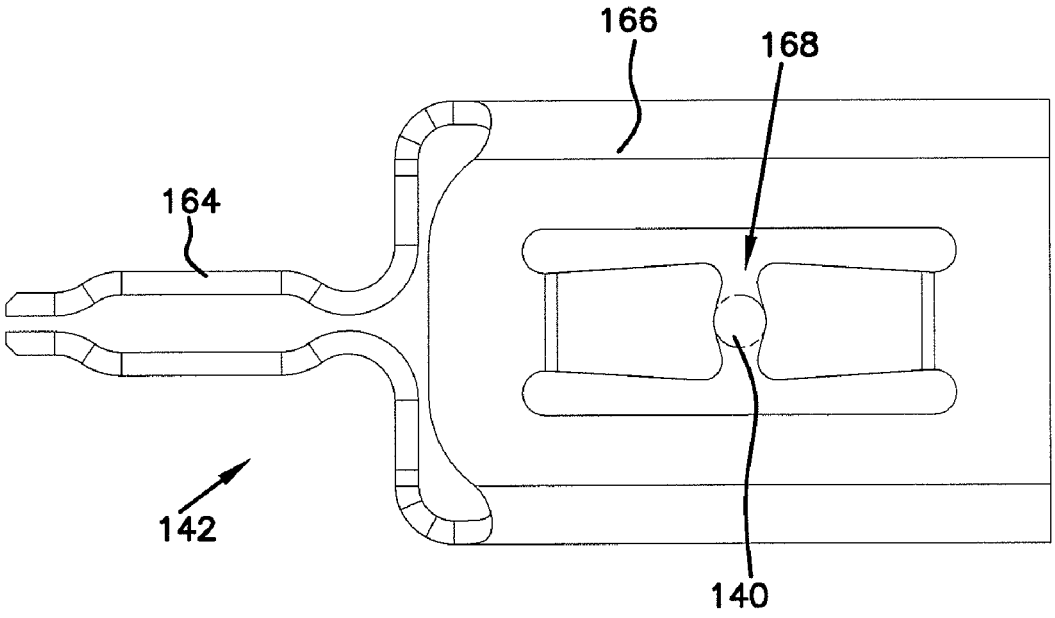
FIG. 90 is a bottom plan view of the grounding plate of FIG. 88.
Figure 91:
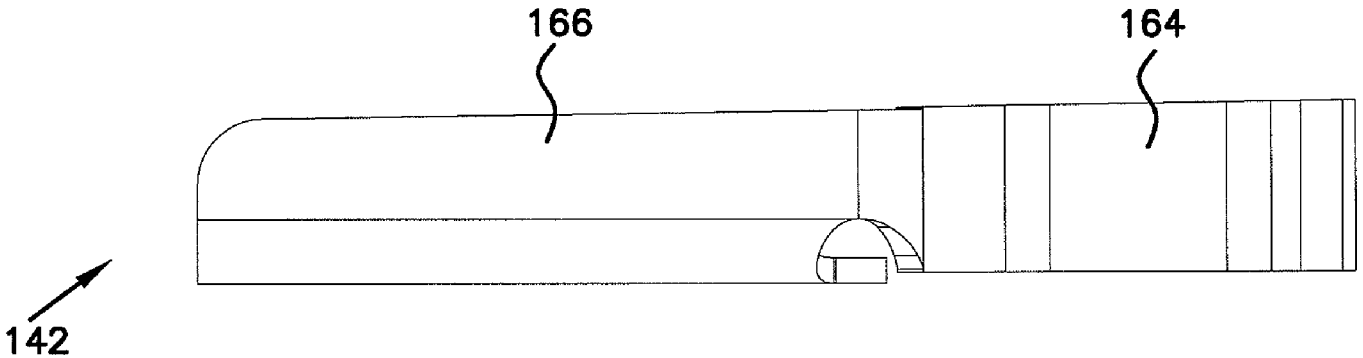
FIG. 91 is a left side plan view of the grounding plate of FIG. 88.
Figure 92:
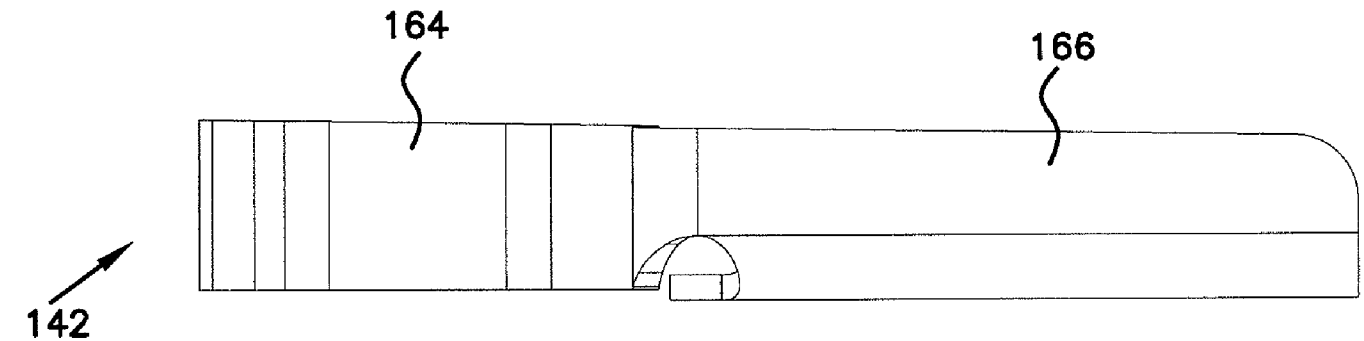
FIG. 92 is a right side plan view of the grounding plate of FIG. 88.
Figure 93:
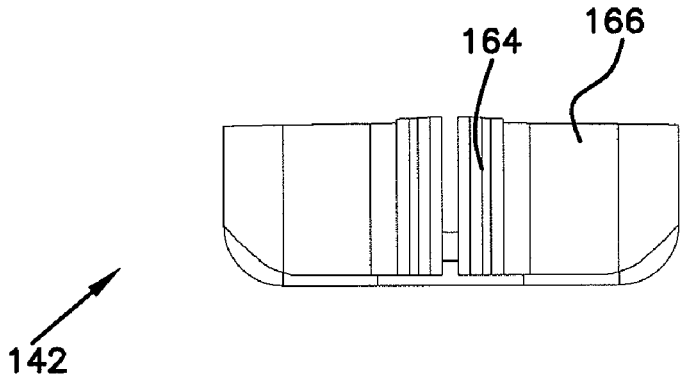
FIG. 93 is an insertion side plan view of the grounding plate of FIG. 88.
Figure 94:
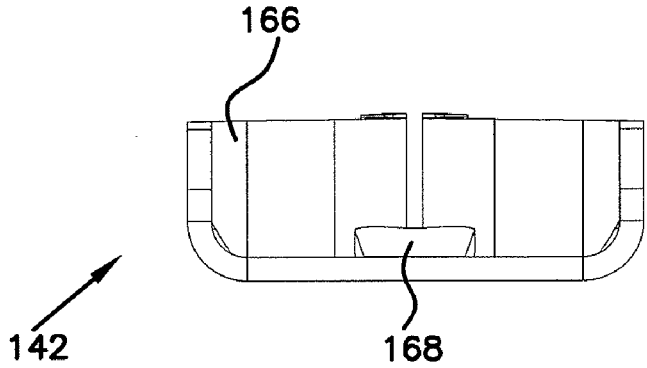
FIG. 94 is a further side plan view of the grounding plate of FIG. 88, opposite the insertion side.

Each socket 30 is sized and shaped to at least partially receive a housing of an overvoltage protection plug 100 inserted into the socket, such as the plug described in conjunction with FIGS. 37-94. In certain embodiments, each socket 30 is shaped to allow insertion of an overvoltage protection plug 100 in a specific orientation, to ensure that the overvoltage protection plug connects to the contacts 32 and a grounding bar 34 of the protection block. In examples of such embodiments, each socket 30 can be generally rectangular, and have an angled corner at one or more corners of the socket that matches an angled corner (e.g. the angled corner 41 of the cover, described below in conjunction with FIGS. 8-14) of the overvoltage protection plug 100. In this way, each overvoltage protection plug is inserted in the same orientation into the protection block 10.

The overvoltage protection plugs 100 received by the protection block 10 of the present disclosure can be any of a variety of small form factor protection plugs, such as could be inserted into a Krone-style connection block. One example of such an overvoltage protection plug is described below, in conjunction with FIGS. 37-94. An additional example of an overvoltage protection plug is described in U.S. patent application Ser. No. 11/712,234, filed Feb. 28, 2007, and entitled "Overvoltage Protection Plug", the entire disclosure of which is hereby incorporated by reference in its entirety.

In certain embodiments, the overvoltage protection plug used in the protection block can include one or both of overvoltage and overcurrent protection capabilities. For example, the overvoltage protection plug can also include fuses connected between opposed pairs to ensure that the current does not exceed a threshold value. Other arrangements and protection schemes are possible as well.

The contacts 32 extend toward the cover 14 through the base 16 and are exposed at the front 26 through the sockets 30 in the cover for connection to the overvoltage protection plugs. The contacts 32 are arranged in opposed linear pairs, with two pairs of contacts per socket (i.e. a total of four contacts per socket). The pair of opposed contacts 32 are normally open, in that they are disconnected from each other in the absence of a device (e.g. an overvoltage protection plug 100) separately connecting each of the opposed pairs in the socket 30. In the embodiment shown, the contacts 32 do not extend through the cover, and remain within a periphery of the block 10 as defined by the housing 12.

When an overvoltage protection plug 100 is inserted into a socket 30, electrical contacts on the overvoltage protection plug 100 complete a circuit between the opposed contacts, allowing telecommunications signals to pass through the two completed circuits of the differential pair. The contacts 32 electrically connect to pins 33 which are arranged in a second region. In the embodiment shown, the contacts 32 connect to pins 33 on a rear 28 of the base 16. In use, the pins 33 are electrically connected to signal wires, such as by wire wrapping the signal wires to the posts. The signal wires can be bundled and lead away from the protection block 10.

The pins 33 are optionally sealed to the rear 28 of the base 16, alongside the signal wires, under a plastic or other nonconductive filling element. In such an embodiment, the filling element can be poured into the rear 28 of the base 16, which includes a perimeter portion 17 that extends beyond the length of the pins 33 to contain the filling element.

Preferably, the pins 33 and contacts 32 are unitary, and are inserted through the base for connection to signal wires and overvoltage protection plugs 100. However, in other embodiments, the pins 33 and contacts 32 can be electrically connected by wires, soldering, or other methods.

A grounding plate 36 is attached to the housing 12 by the screws 15 located along the right side 24 of the housing. The grounding plate 36 electrically connects to a plurality of grounding bolts 38 and a plurality of the grounding bars 34 (shown in FIG. 7 and FIGS. 31-33, below). The bolts 38 provide locations for connecting one or more grounding wires to the block 10. The grounding bars 34 electrically connect to the grounding plate 36, and extend from the grounding plate across the protection block 10 from the left side 18 to the right side 20. The grounding bars 34 thereby provide a grounding connection location at each socket 30, allowing the circuitry of the overvoltage protection plugs 100 to electrically connect through a grounding bar 34 associated with the socket. The grounding bars 34 are in turn electrically connected to the grounding plate 36, and to the bolts 38 for a ground connection external to the protection block 10.

In the embodiment shown, the grounding bars 34 are connected to the grounding plate 36 at a press-fit connection locations, as described below in conjunction with FIGS. 31-36. In such an embodiment, the grounding bars do not need to be soldered to the grounding plate 36, while being retained in connection by the housing 12. The press-fit connection between the grounding bars 34 and grounding plate 36 are, due to the configuration of the block 10, able to provide a reliable connection and handle sufficient current load to a ground connection to support at least the 200-pair block in the configuration shown.

Referring now to FIGS. 8-14, the cover 14 is described in greater detail. The cover 14 is preferably formed from a plastic material, and includes a plurality of openings 40 aligned with the contacts 32 to form sockets 18. In the embodiment shown, the openings 40 include angled corners 41 at adjacent corners, dictating an orientation for insertion of the overvoltage protection plugs 100. The cover 14 includes a hollow cavity 42 that, when the cover is attached to a base 16, forms a hollow area within the interior of the protection block 10. This hollow cavity 42 can be filled, for example, by a gel or other substance providing waterproofing of the contacts 32, posts 31, grounding bars 34, and other electrical components in the block 10.

Portions of the cover 44 forming the openings 40 extend into the base 16 when the cover 14 is attached to the base. The portions of the cover 44 form three walls around each opening 40, forming an insertion portion for each socket 30. The side of the opening 40 that the portion 44 does not surround receives an extension of the grounding bar 34 for connection to the overvoltage protection plug 100. The portion of the cover 44, when the cover 14 is attached to the base 16, is inserted into the base, preferably causing any gel or liquid in the base to rise in level to cover components in the hollow cavity 42.

Referring now to FIGS. 15-21, the base 16 is described in greater detail. The base 16 is generally rectangular, and is sized complementarily to the cover 14. The base 16 includes one or more mounting structures 50 along its sides. In the embodiment shown, the mounting structures are cylindrical and extend from the left side 18 and right side 20 of the housing 12 (and therefore the base 16). Also on the right side 20, an indented portion 52 receives the grounding plate 36. Holes 54 receive the grounding bolts 38.

Figure 15:
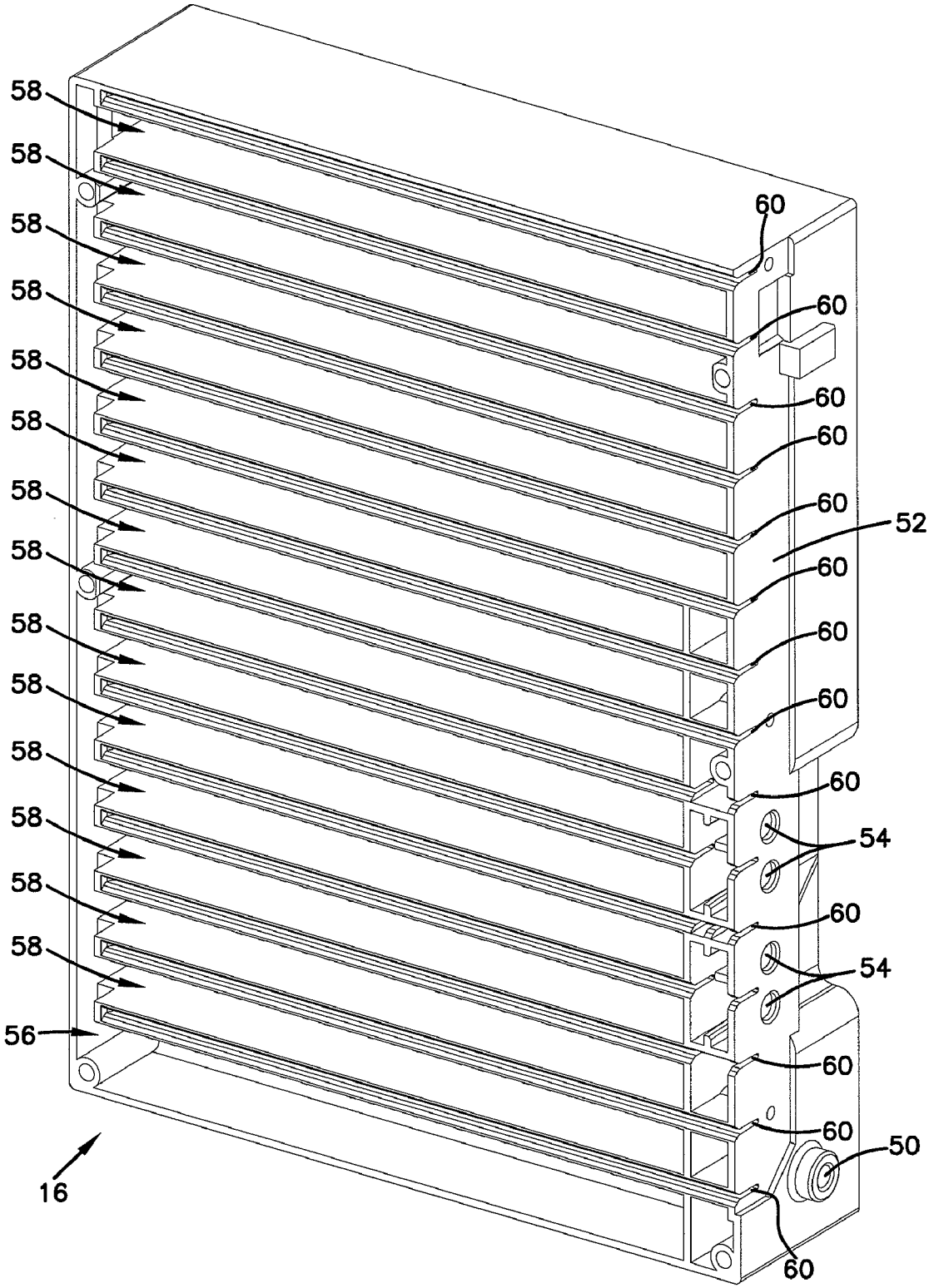
FIG. 15 is a front perspective view of a base used in the protection block of FIG. 1.
Figure 17:
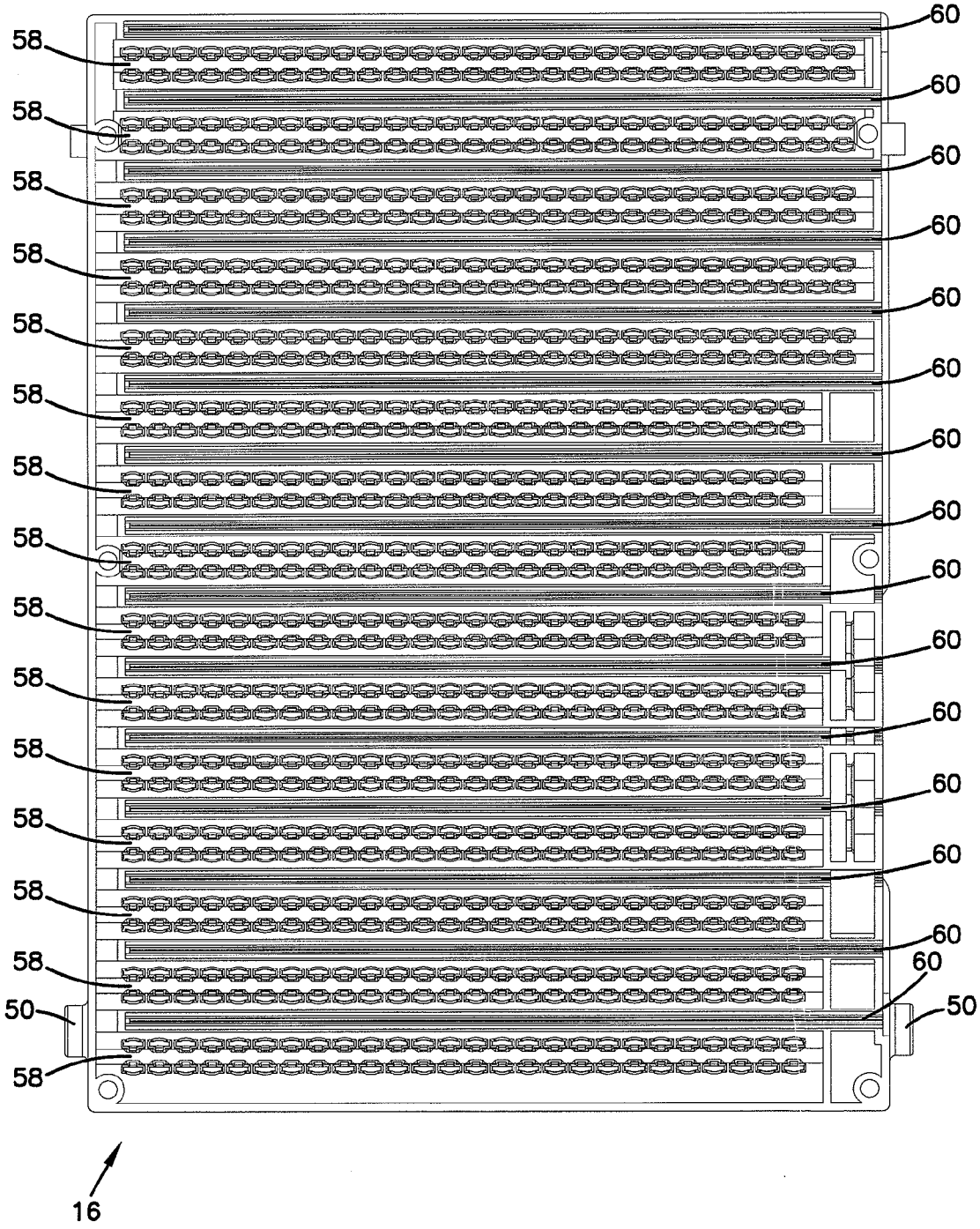
FIG. 17 is a front plan view of the base of FIG. 15.

An interior portion 56 of the base 16 (i.e. which resides in the interior of the housing 12, as shown in FIGS. 15 and 17) includes a plurality of contact support rows 58 arranged to receive contacts 32. The rows 58 correspond to pairs of insertion holes in the base 56 for receiving the contacts 32. Slots 60 are aligned with each row 58, and allow grounding bars 34 to be inserted through the slots for electrical connection to the grounding plate 36. In the embodiment shown, fifteen rows 58 are included in the base 16, and are associated with the fifteen slots 60. The base 16 is sufficiently wide to allow up to fourteen sockets (and therefore twenty eight normally open contact pairs), resulting in 48 holes for contacts 32 and pins 33 per row 58. The base 16 therefore can include up to 210 socket locations. The remaining interior portion 56 of the housing 12 is hollow to receive gel or other substance to assist with environmental protection of the contacts and other electrical components in the protection block 10.

Figure 16:
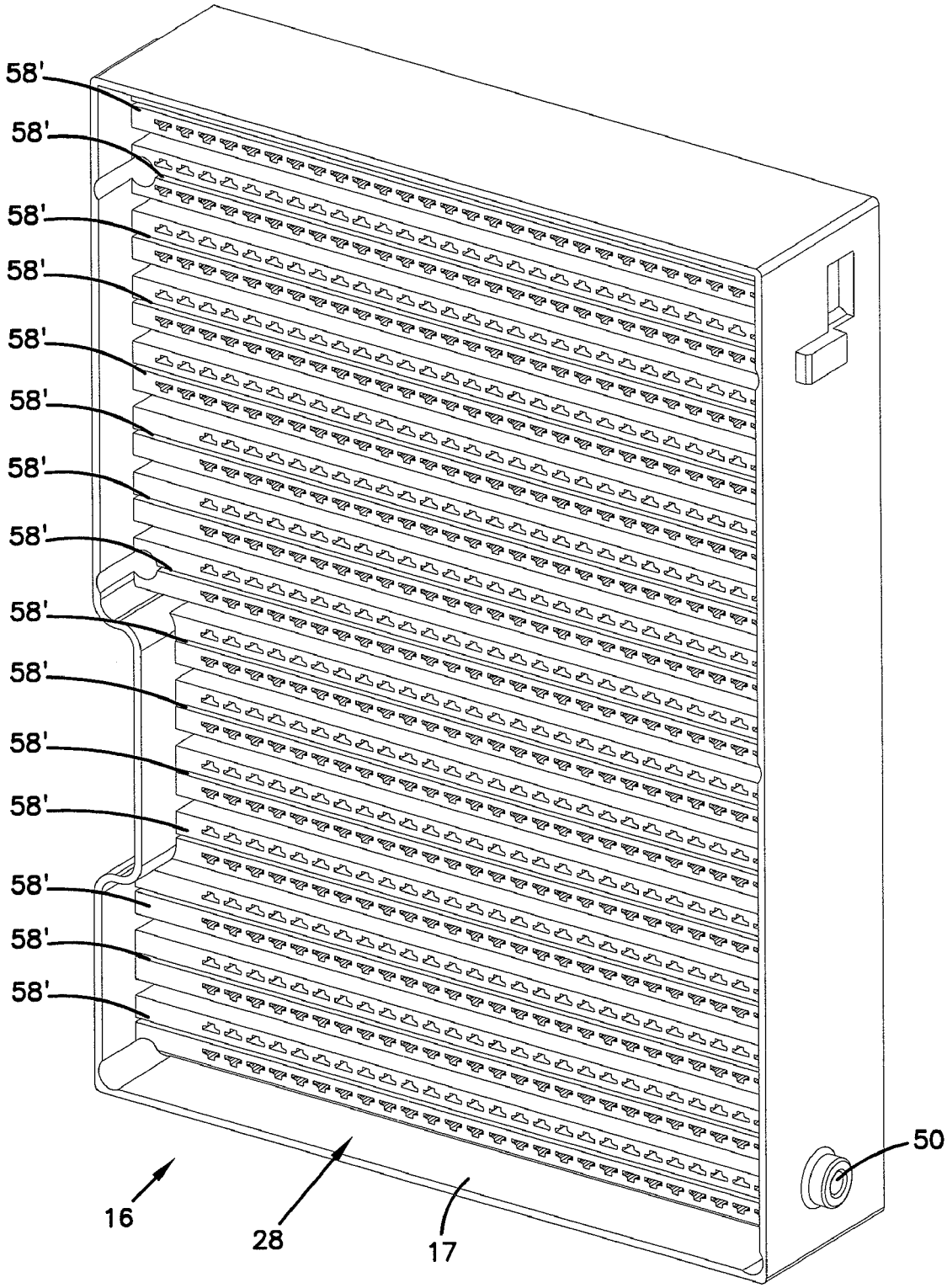
FIG. 16 is a rear perspective view of the base of FIG. 15.
Figure 18:
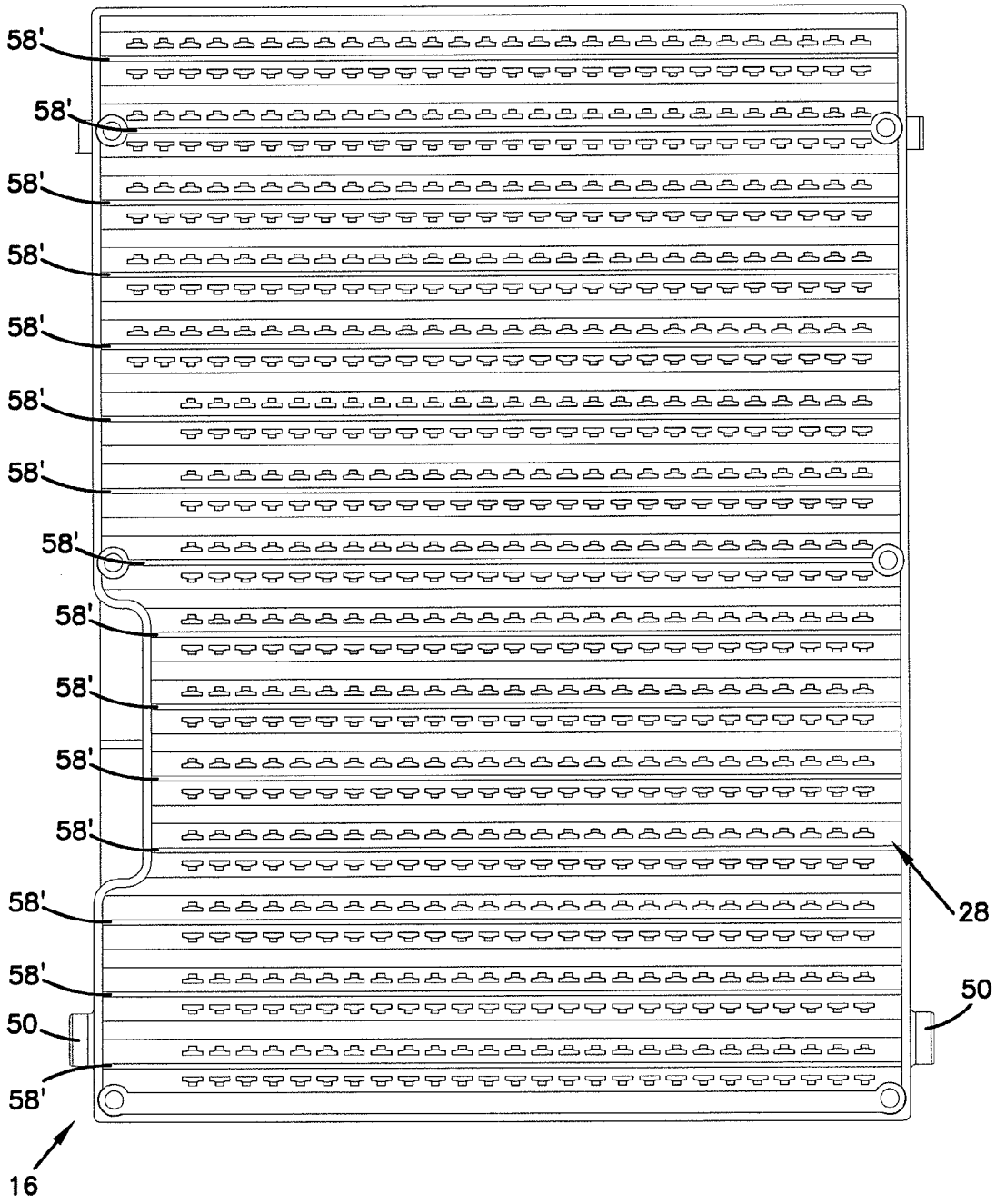
FIG. 18 is a rear plan view of the base of FIG. 15.
Figure 21:
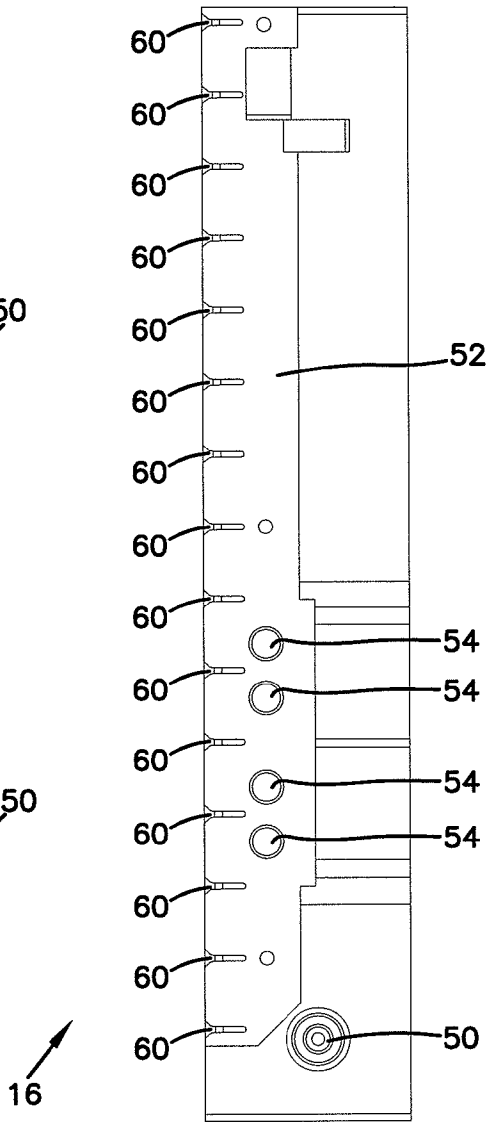
FIG. 21 is a right side plan view of the base of FIG. 15.
Figure 19:
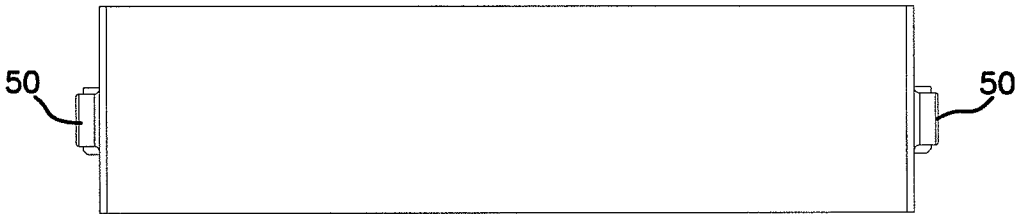
FIG. 19 is a top side plan view of the base of FIG. 15.
Figure 20:
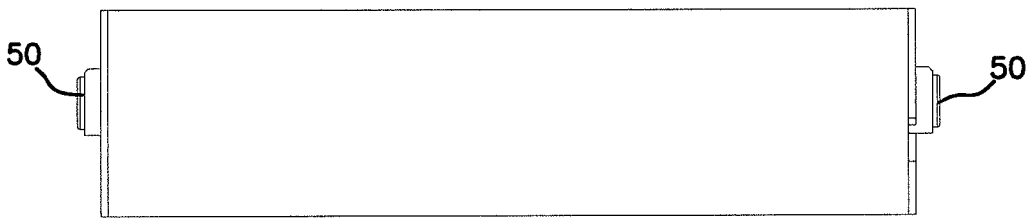
FIG. 20 is a bottom side plan view of the base of FIG. 15.
Figure 22:
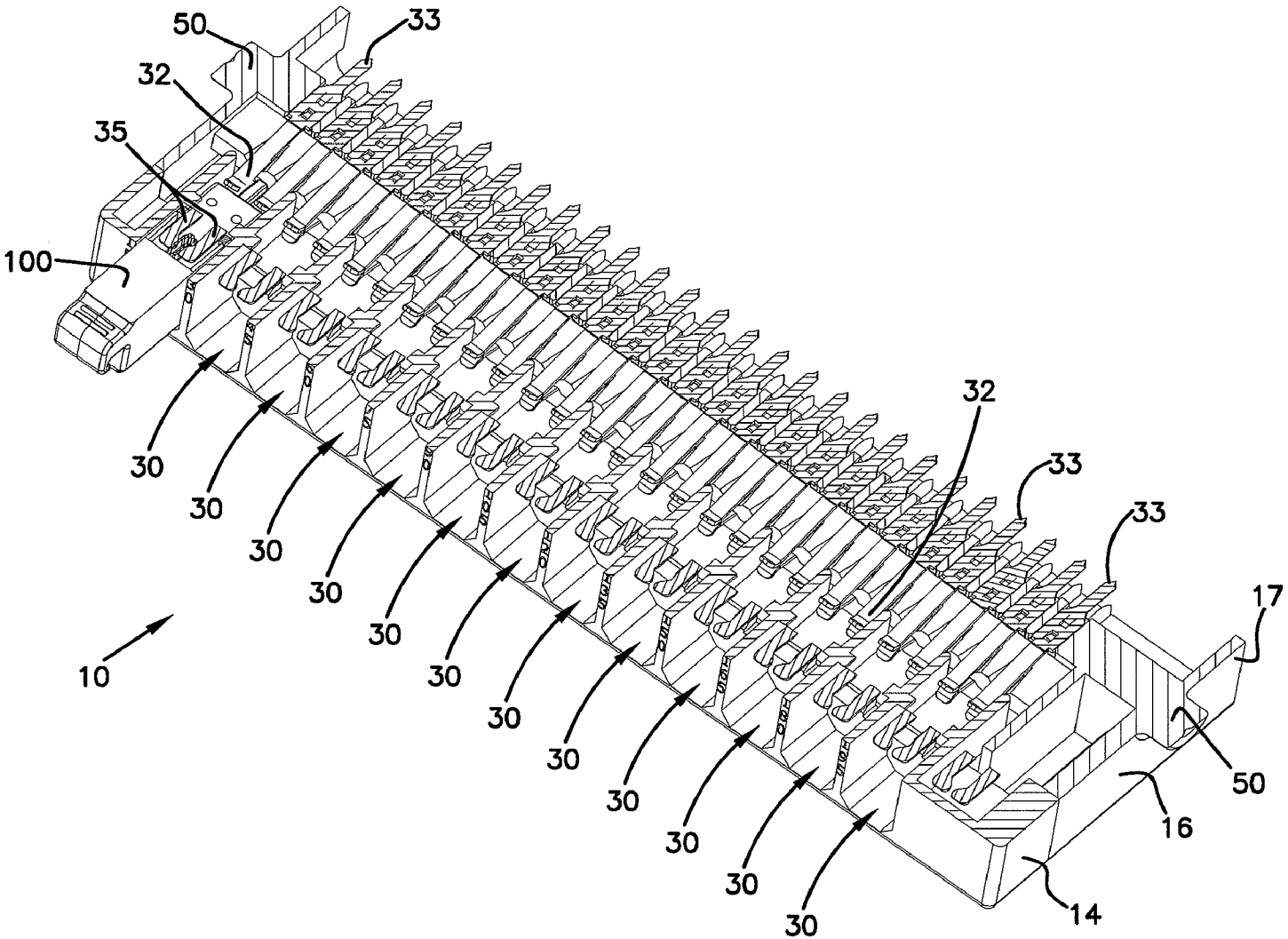
FIG. 22 is a perspective cross-sectional view of the protection block and plug of FIG. 1.
Figure 25:
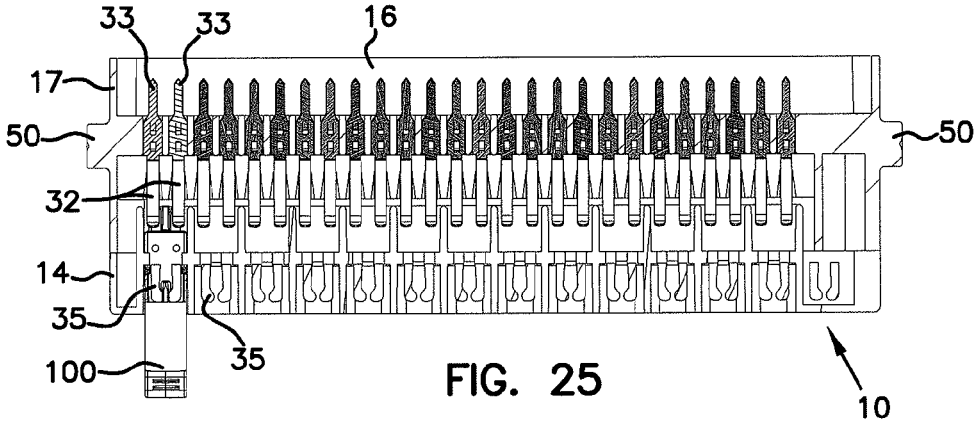
FIG. 25 is a side cross-sectional view of the protection block and plugs of FIG. 1.
Figure 23:
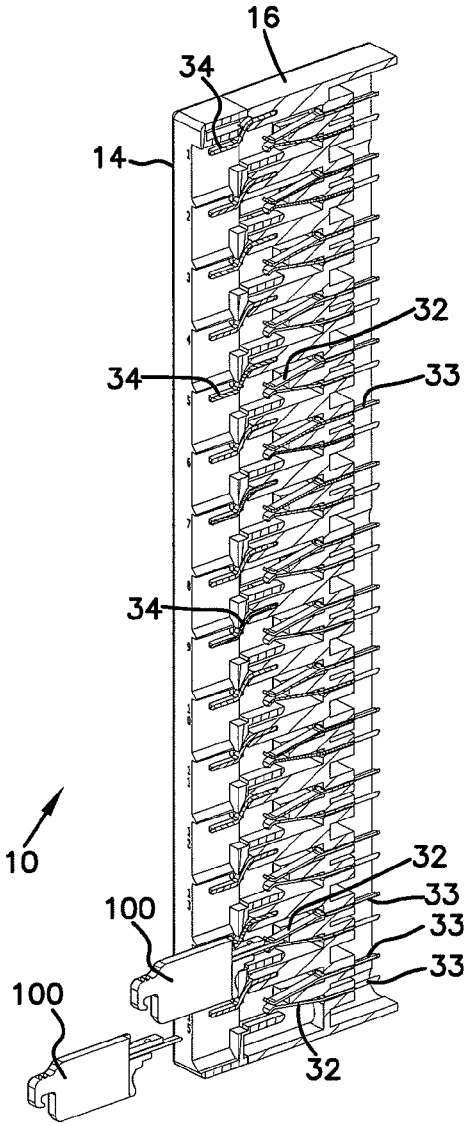
FIG. 23 is a further cross-sectional view of the protection block and plug of FIG. 1.
Figure 24:
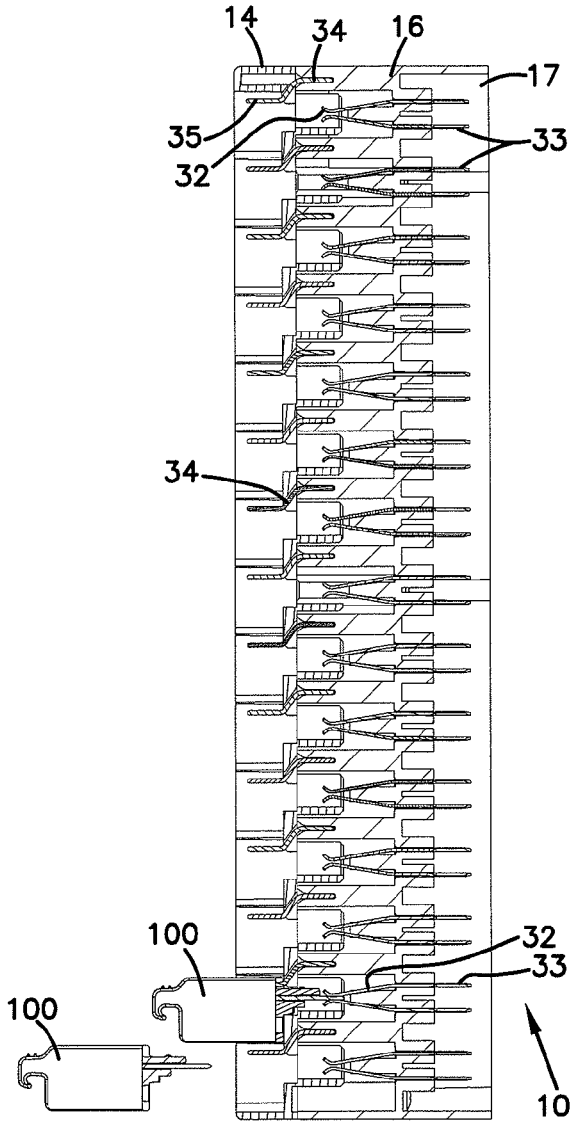
FIG. 24 is a further plan cross-sectional view of the protection block and plugs of FIG. 1, along an axis perpendicular to that of FIGS. 22-23.

The surface of the base 16 forming the rear 28 of the housing 12 (as shown in FIGS. 16 and 18) includes corresponding rows 58', through which pins 33 extend. The pins 33 and contacts 32 extend through the body of the base 16. In a possible embodiment, the pins 33 and contacts 32 are unitary, and are inserted through the base 16. As previously described, a perimeter portion 17 of the base extends rearward of the rows 58' (and posts 33 inserted therein) to form a cavity for receiving a sealing, protective filling element.

Figure 26:
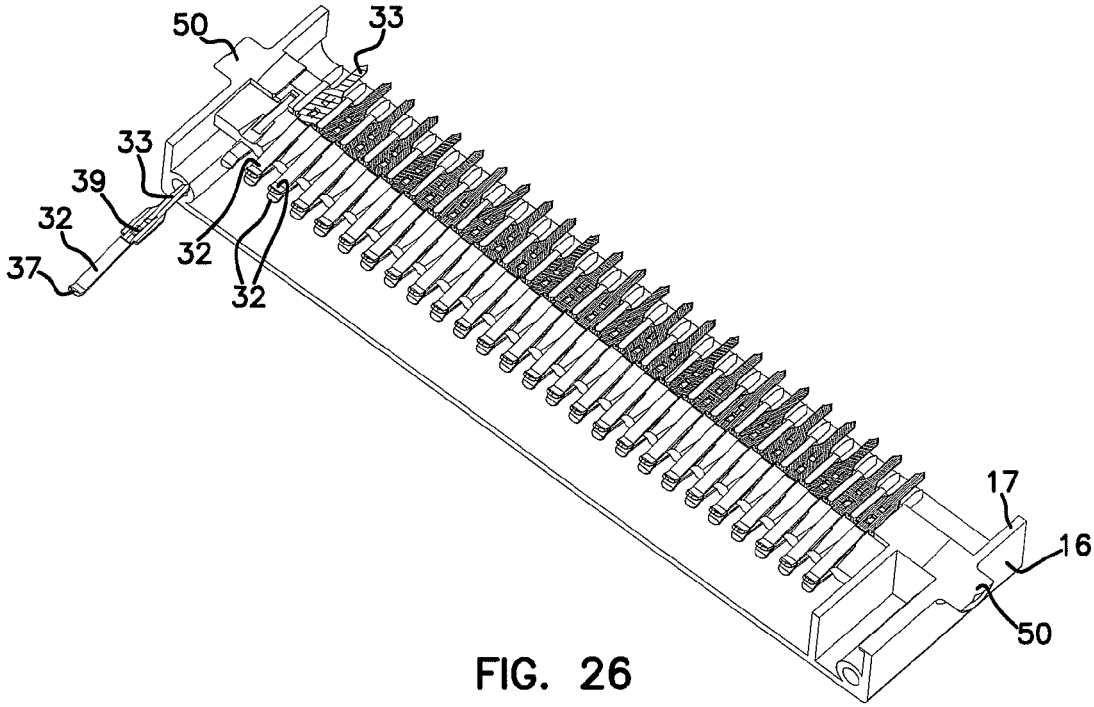
FIG. 26 is a perspective cross-sectional view illustrating a row of contacts in the protection block of FIG. 1, with the cover removed.
Figure 27:
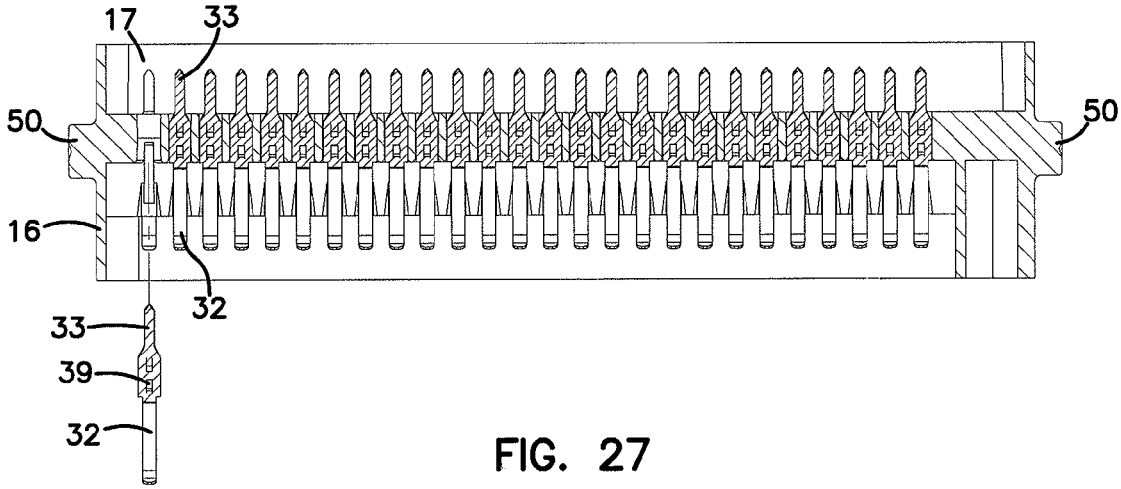
FIG. 27 is a side cross-sectional view of the row of contacts in the protection block of FIG. 26.

FIGS. 22-27 illustrate the connection made between the overvoltage protection plug 100 and the contacts 32 in the block 10. In the embodiment shown, the contacts 32 are unitary with the pins 33 extending from the rear 28 of the block 10, and are inserted into the base 16 through holes in the rows 58 (as shown in FIGS. 26-27). When inserted, the opposed pairs of contacts do not contact, but reside in a normally open configuration. When an overvoltage protection plug 100 is inserted, electrical contacts on the plug connect to each of the four contacts 32 associated with the socket 30 into which the plug is inserted. The telecommunications circuit (defined by signal lines connected to the pins, in this case a pair of signal lines) is completed and thereby activated by passing the signal through the overvoltage protection plug 100. A portion of the plug 100 electrically connects with a pair of extensions 35 from the ground bars 34, with each pair of extensions inserted partially into the plug 100 and connecting to a ground connection within the plug. The ground bars 34 therefore allow each of the plugs 100 inserted into the protection block 10 to have a common ground with the block.

Figure 28:
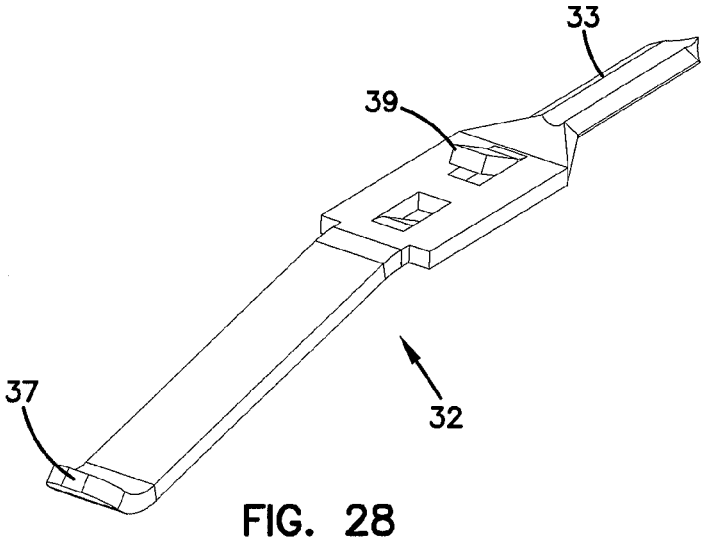
FIG. 28 is a perspective view of a contact used in the protection block of FIG. 1.
Figure 29:
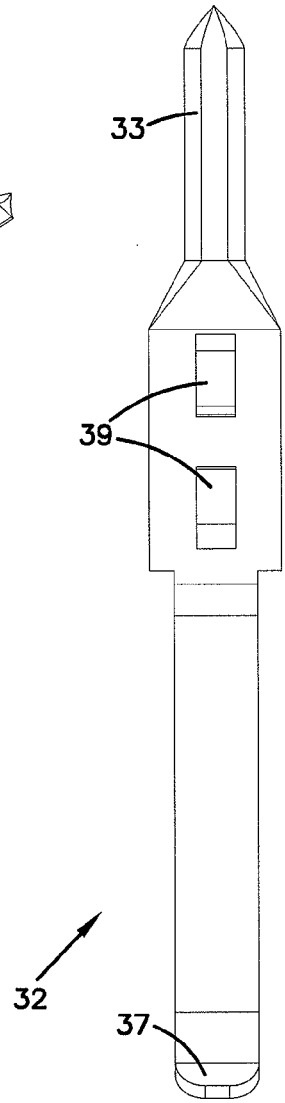
FIG. 29 is a front plan view of the contact of FIG. 28.
Figure 30:
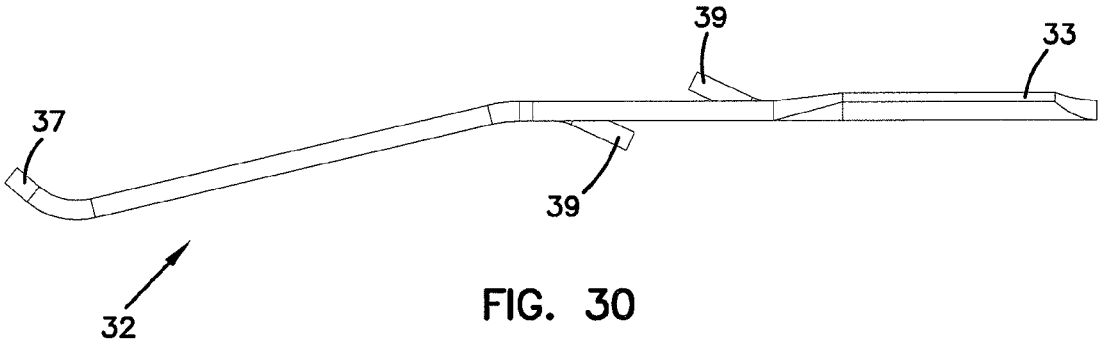
FIG. 30 is a side plan view of the contact of FIG. 28.

FIGS. 28-30 illustrate details of a contact 32 used to connect to an overvoltage protection plug 100 in a socket 30. The contact includes a curved portion that allows the contacts to be inserted into the holes of the rows 58 (which are spaced apart to allow the pins to be wire wrapped on the rear 28) while bringing the opposed contact pairs into close proximity. A tip portion 37 of the contact 32 is bowed in a direction away from the opposed contact, so that the inserted portion of the overvoltage protection plug 100 is guided into the area between the contacts 32 to electrically connect to both opposed contacts.

The contacts 32 are generally conductive (e.g. metallic or otherwise conductive), and are capable of making an electrical connection with corresponding contacts of an overvoltage protection plug when physical contact is made between conductive portions of each contact. In the embodiment shown, the contact 32 includes a pin 33 formed as a portion of the contact and used to electrically connect to signal lines on the rear 28 of the block 10. In such an embodiment, the contact 32 is inserted through the base 16 in the manner shown in FIGS. 26-27. A wedge 39 controls the depth of insertion of the contact 32 into the base 16 by maintaining a uniform depth of insertion of all contacts into the base. The wedge 39 also supports the contact within the hole in which it is inserted. In other embodiments, the pin 33 is separate from and electrically connected to the contact 32.

Figure 31:
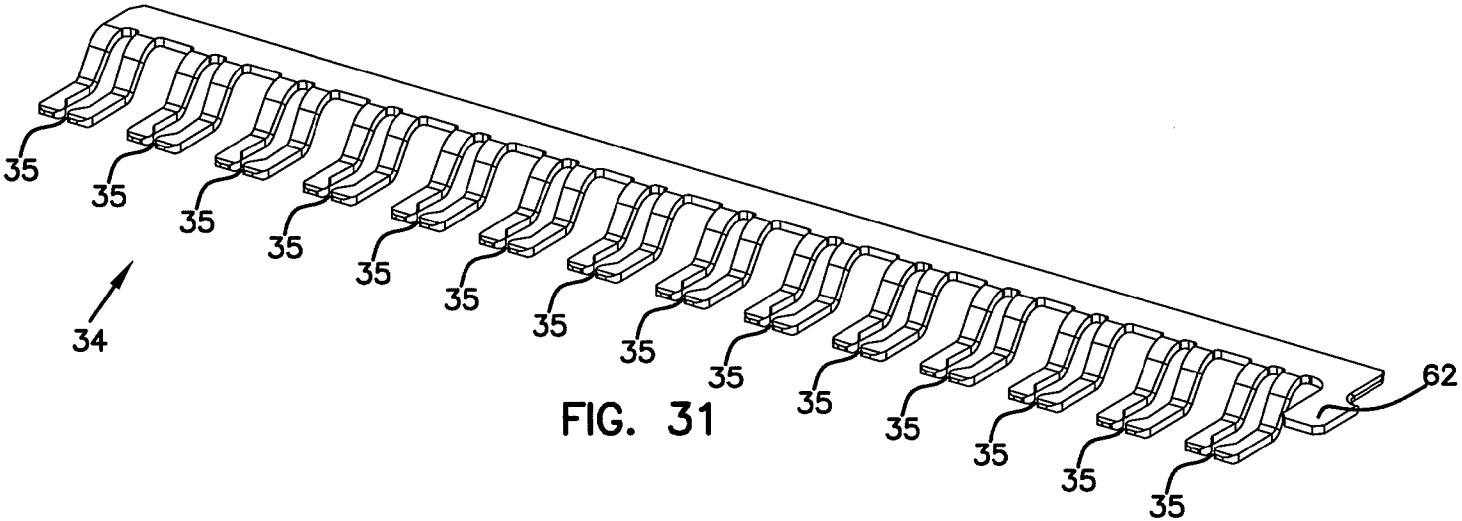
FIG. 31 is a perspective view of a grounding bar incorporated into the protection block of FIG. 1.
Figure 32:
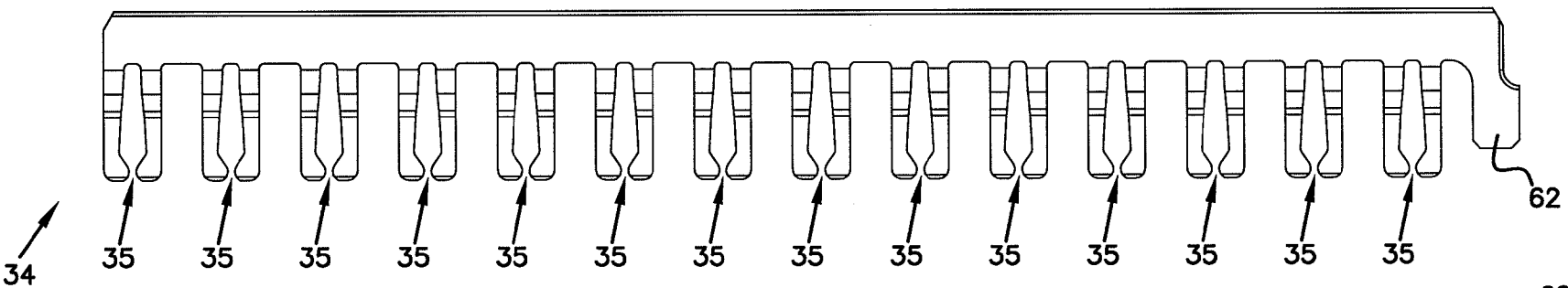
FIG. 32 is a top plan view of the grounding bar of FIG. 31.
Figure 33:
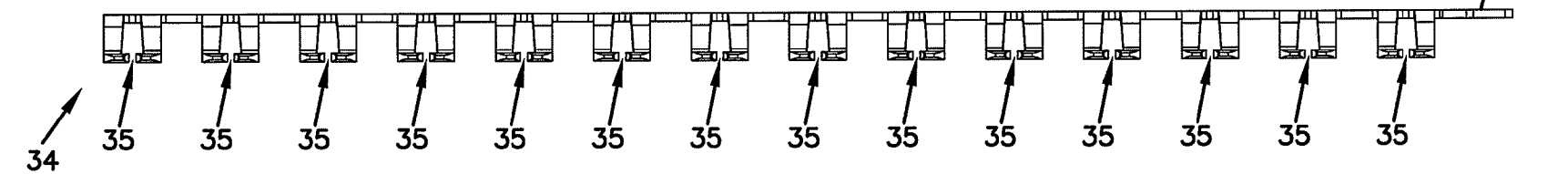
FIG. 33 is a side plan view of the grounding bar of FIG. 31.

FIGS. 31-33 illustrate details of a grounding bar 34 used to provide a grounding connection to a row of sockets. The grounding bar 34 is a generally conductive material, such as metal (e.g. copper, stainless steel) or other conductive component capable of high-amperage conduction to a ground point. The grounding bar 34 is generally linear, and is inserted into the slot 60 in the base 16.

The grounding bar 34 includes a plurality of extension pairs 35 that insert into a portion of an overvoltage protection plug 100 to provide a common ground connection to the block 10 and plug 100. The extension pairs 35 are offset from the portion of the grounding bar 34 inserted into the slots 60 of the base 16, to align the extension pairs with a portion of the sockets 30 for insertion into overvoltage protection plugs 100 when such plugs are inserted into the sockets. In the embodiment shown, the ground bar includes 14 extension pairs 34, corresponding to one extension pair per socket 30. A flange 62 on one side of the ground bar 34 extends to the right side 20 of the protection block 10, and electrically connects to a grounding plate 36.

Figure 36:
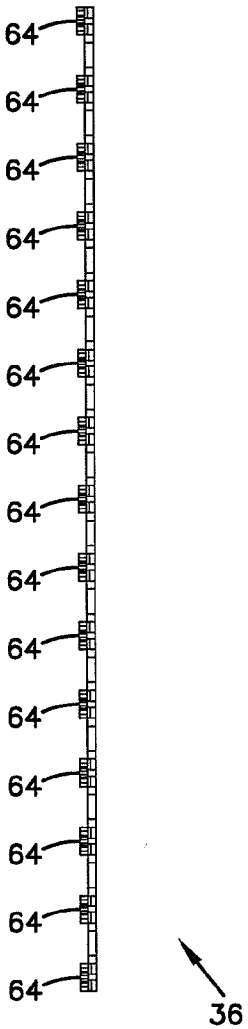
FIG. 36 is a front plan view of the grounding plate of FIG. 34.
Figure 35:
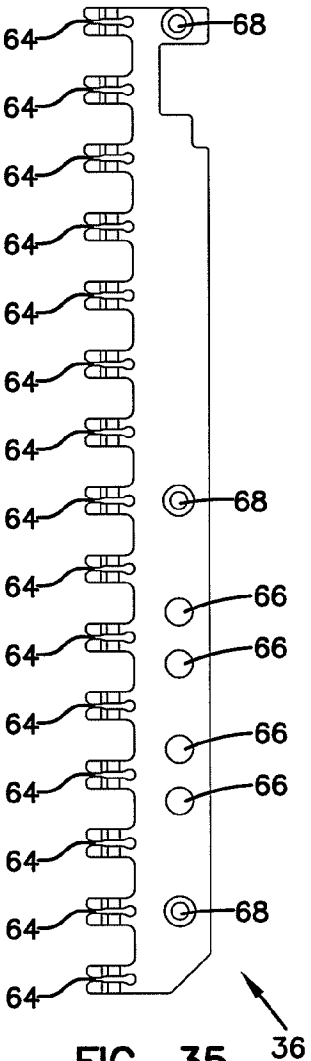
FIG. 35 is a side plan view of the grounding plate of FIG. 34.
Figure 34:
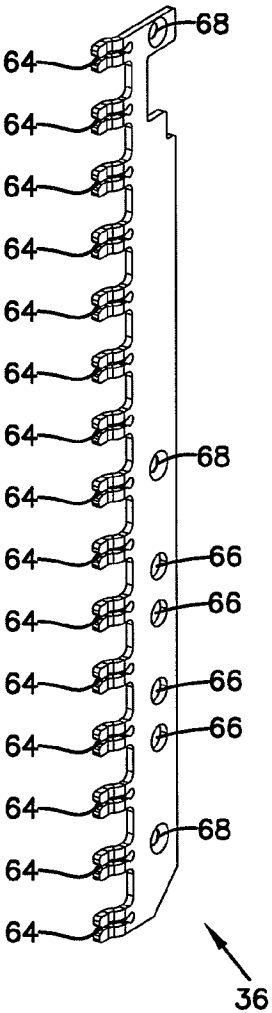
FIG. 34 is a perspective view of a grounding plate used in the protection block of FIG. 1.

FIGS. 34-36 illustrate details of a grounding plate 36 used for connecting grounding bars 34 to a common ground connection at grounding bolts 38. The grounding plate 36, like the grounding bars 34, is generally a metal (e.g. copper, stainless steel) or other conductive component capable of high-amperage conduction to a ground point. The grounding plate can be formed from a different material than the grounding bars 34, while maintaining a reliable electrical connection between the two materials.

The grounding plate 36 is substantially planar, and includes extension pairs 64 that extend toward the front 26 of the block 10 when the grounding plate is installed on the right side 20 of the block. Each extension pair defines a slot through which the flange 62 of each grounding bar 34 is inserted. Insertion of the flange 62 through the slot in the extension pairs 64 of the grounding plate 36, through a press-fit connection, electrically connects each grounding bar 34 to the grounding plate. Bolts 38 passing through holes 66 in the grounding plate 36 electrically connect to the grounding plate as well, and provide a location for connecting a grounding wire to the protection block 10. Additional holes 68 in the grounding plate receive screws 15 used for attaching the grounding plate 26 to the housing 12 (as well as for connecting the cover 14 to the base 16 to form the housing).

Referring now to FIGS. 1-36 generally, the protection block 10 can be mounted within a telecommunications system, such as a group of switching, routing, and signal conditioning components for routing data signals within a network. In various embodiments, the protection block 10 can be mounted in place of a 100-element 5-pin protection block. Telecommunications wires are generally connected to the pins 33 on the rear 28 of the protection block 10, such as by either direct wire wrap or connection to a wiring connector that is in turn wire wrapped or soldered to the pins. The telecommunications wires can represent, in certain embodiments, input and output wires for differential pairs, such as are used in data and voice communications. One or more overvoltage protection plugs 100 can be inserted into the sockets 30 of the block 10, to connect the normally open contacts of the block, thereby activating and protecting the telecommunications circuit associated with that socket 30. The protection block can be grounded to a cabinet or other grounded device by electrically connecting a grounding bolt 38 to a grounding connection external to the block 10. As overvoltage events occur and "burn out" or otherwise cause failure of overvoltage protection plugs 100, those plugs can be removed from the block 10 and replaced, as necessary.

Although the current disclosure discusses in detail the arrangement of overvoltage protection plugs with respect to a protection block or a specific size (the "307 block"), other sizes of blocks can be used as well with corresponding numbers of sockets for receiving overvoltage protection plugs. For example, the protection block can be used in locations (indoor, outdoor, entrance terminal, etc.) where other standardized-size blocks are used, to provide a different number of connection locations within these standard footprint protection block areas, as compared to existing 5-pin blocks. For example, in certain embodiments, the protection block can correspond to a connection block that is about 16.25 inches high, and of sufficient width to receive 100 groups of 5-pin terminals. This type of block, also called a "302-block" is available in a variety of specific models used for outside the plant applications (e.g. panel applications). Or, the connection block can be a "310-block", which provides room for 100 protection locations in a footprint of approximately 9⅜ inches by approximately 4 inches by approximately 7 inches. In a further embodiment, the block can correspond to a "303 block" used to receive 100 5-pin connectors in a housing approximately 19.2 inches by approximately 4.29 inches. In other embodiments, the protection block can correspond to a smaller package useable at entrance terminals, such as can be found in the "ST265" or "ST260" sized blocks, which are configured to receive six five-pin connectors in a block approximately 6 inches by 3.2 inches by 2.72 inches, or 12-25 five-pin connectors in a block approximately 10 inches by approximately 3.836 inches by approximately 3.05 inches, respectively. In still other embodiments, the protection block can correspond to a middle-sized block arranged to receive 50-100 five pin connectors, useable for entrance terminals or other analogous applications, such as the "ST188" and "ST189" sized blocks. Further block sizes can be used as well, such as the "110ANA" block size used in indoor applications and which can be configured in 6, 10, and 25 5-pin socket capacities, and are sized at approximately 3.5 inches by approximately 4.1 inches by approximately 2.6 inches (6 socket), approximately 3.9 inches by approximately 4.5 inches by approximately 2.6 inches (12 socket), or approximately 10 inches by approximately 3.9 inches by approximately 2.6 inches (25 socket). Other block sizes can be use as well to be configured to specific applications in a telecommunications enclosure, in various additional embodiments.

Through use of blocks arranged according to the present disclosure, the density of overvoltage protection plugs that can be inserted into a block is increased. This space savings is due, at least in part, to the smaller dimensions of the sockets used in the block, and the corresponding dimensions of the overvoltage protection plugs used in conjunction with the block. For example, in each of the example embodiments in which the size and arrangement of the protection block is altered, replacement of the 5-pin protection element socket with the sockets (and plugs) described herein allows increased density of connections in a similar sized protection block. Preferably, and as is possible in certain embodiments, replacement of the 5-pin protection element with the sockets and plugs described herein at least doubles the capacity of the protection block of a corresponding size, based on this improved density. In such embodiments, it is also possible that certain portions of the block remain unoccupied by sockets, allowing room within a standard-sized block to be used for other purposes, such as incorporation of circuitry, display information, or other elements. An example of such a configuration is highlighted in the 307 block size that is described above in conjunction with FIGS. 1-36.

Referring now to FIGS. 37-94, details regarding an overvoltage protection plug 100 are disclosed. The plug 100 provides overvoltage protection for telecommunications circuits, such as due to lightning strikes, power surges, or other unexpected events occurring within the telecommunications circuits. The plug 100 is configured for insertion into a protection block such as the block 10 described herein. The plug 100 can also be configured for insertion into a connection block, such as a Krone-style connection block used in telecommunication interconnection systems, which include an array of connection locations and can be arranged in a number of adjacent rows. Additional details regarding plug 100 are described in U.S. Provisional Patent Application No. 61/056,328 filed May 27, 2008 which is hereby incorporated by reference in its entirety.

The plug 100 includes a body 112 formed from a chassis 114 and a housing 116. The body 112 has a top 113, bottom 115, right and left sides 118, 120, respectively. The body 112 also defines an insertion side 122 and a handle side 124 at opposite sides along its length. The size of the body 112 is minimized, at least with respect to the dimensions from the top 113 to bottom 115 and right to left (sides 118 and 120, respectively). This maximizes the circuit density in which the plug can be located. In one possible embodiment, the body 112 is approximately 0.31 inches wide by approximately 0.49 inches tall by approximately 1.44 inches long.

In the embodiment shown, two conductive contacts 126, 128 extend through the body at the insertion side 122, and are positioned to make contact with and electrically connect to electrical contacts in a high contact density connection block, such as a Krone-style connection block. Example Krone-style blocks useable in conjunction with the plug 100 are disclosed in German Patent No. DE3728368 and German Patent Application No. DE10001553. Additional details are described in U.S. Pat. Nos. 7,147,412; 7,008,243; 5,494,461; 5,163,855; 5,033,974; and 4,871,330, the disclosures of which are hereby incorporated by reference in their entireties.

The chassis 114 and housing 116 interconnect to form the body 112 via a snap-fit arrangement, in which tabs 130 arranged on a portion of the chassis inserted into the housing fit within openings 132 in the housing. Other arrangements for interconnecting the chassis 114 and housing 116 are possible as well, such as use of an adhesive, fastener, or other structure. Additional details of the chassis and housing are discussed below in conjunction with FIGS. 55-68.

Referring now also to FIGS. 45-54, further details regarding the overvoltage protection plug 100 are disclosed. As shown, the plug 100 includes an interior volume 134 in which electrical components, such as circuit protection components, can be housed. In the embodiment shown, the plug 100 includes a gas tube 36 residing within the interior volume 134. The gas tube 136 is generally a three pin gas tube, having two signal leads 138 and a grounding pin 140. The gas tube 136 generally activates upon detection of overvoltage events occurring between the conductive contacts. When the gas tube 136 activates, an electrical connection forms due to electrical excitement of the gas within the gas tube, connecting one or both of the signal leads 138 of the gas tube (connected to the electrical contacts) to the grounding pin 140, thereby neutralizing the overvoltage event. Additional details regarding the gas tube are described below in conjunction with FIGS. 69-73.

The gas tube 136 is electrically connected to the conductive contacts 126, 128. In the embodiment shown, the conductive contacts 126, 128 can be electrically connected to the signal leads 138 of the gas tube via a soldered connection; however, solderless connection arrangements are possible as well.

The gas tube 136 also electrically connects to a grounding plate 142. The grounding plate 142 is held apart from the gas tube 136 by a portion of the chassis 114, which allows the grounding pin 140 of the gas tube 136 to slide through the chassis to a mounting position. A grounding opening 144 in the body 112 allows external access to the grounding plate, to allow electrical connection of the grounding plate to a ground bar, such as a grounding bar associated with a connection block.

A gel access opening 146 extends through the body 112 as well. The gel access opening 146 allows access to the interior volume 134 of the plug 100. A gel can be added into the interior volume 134 to environmentally protect components within the interior volume 134. The gel access opening 146 generally allows gel to be provided into the interior volume 134 to a predetermined volume, such as the predetermined fill level 141 shown in FIG. 52. As the temperature of the gel increases due to operation of the overvoltage protection plug 100, the gel access opening 146 also allows the gel to expand through the opening. In the embodiment shown, the gel access opening 146 passes through the chassis 114 at the insertion side 122 of the plug 100; in other embodiments, the gel access opening 146 can be located at another location on the body 112, such as through a portion of the housing 116.

Referring now to FIGS. 55-58, further details are disclosed regarding the chassis 114 useable in the example overvoltage protection plug. The chassis 114 includes an insertion portion 148 that is configured to be inserted into a protection block. The insertion portion 148 includes a plurality of protrusions 147 configured to interconnect with a connection block and retain the overvoltage protection plug 100 within the block. The chassis 114 also includes an interior portion 150 that resides within the housing 116 and is configured to allow mounting of electrical components, such as the gas tube 136, grounding plate 142, and conductive contacts 126, 128. The interior portion 150 includes tabs 130 along a perimeter portion arranged to interconnect with the openings 132 in the housing to form a snap-fit construction. In the embodiment shown, two tabs 130 are located on the left and right sides of the chassis 114; however, more or fewer tabs can be included on the chassis 114 as well.

The chassis 114 includes slots 152 extending through the chassis 114 from the interior portion 150 toward left and right sides of the insertion portion 148. The slots 152 are sized to receive the conductive contacts 126, 128, which are exposed at the insertion portion 148 external to the body 112 while electrically connecting to the gas tube 134 within the interior volume 134. The insertion portion 148 also includes a central guide extension 149 that physically and electrically separates the conductive contacts 126, 128.

The chassis also includes a central pin receiving slot 154 normal to the slots 152 and arranged to accept insertion of the grounding pin 140 of the gas tube 136, for connection to the grounding plate 142. Tabs 156 on a top side of the chassis 114 define a mounting location for the grounding plate, and retain the grounding plate 142 in place when the overvoltage protection plug 100 is assembled. In the embodiment shown, the chassis 114 includes the gel access opening 146 located below the insertion portion 148, as previously described.

Referring now to FIGS. 59-68, aspects of the housing 116 are described in greater detail. The housing 116 defines a portion of the body 112 including at least a portion of the left and right sides 118, 120 of the body as well as the handle side 124 of the body. The housing 116 defines the interior volume 134, and includes an opening 135 that is sized to receive the chassis 114 and associated internal electrical components (e.g. a gas tube 136, grounding plate 142, and conductive contacts 126, 128). In the embodiment shown, the housing 116 is generally rectangular, but includes angled corners 158 connecting the bottom side 115 to the left and right sides 118, 120, respectively, to ensure consistent, proper orientation of the overvoltage protection plug when inserted into a socket or connection block. An example connection block used in conjunction with such a keyed housing is disclosed above in FIGS. 1-36.

The housing 116 includes tab receiving openings 132 near the opening 135 that are configured to receive the tabs 130 of the chassis to form a snap-fit connection. The openings 132 are generally numbered and positioned in a manner complementary to the tabs 130, such that each tab has a corresponding opening.

The housing 116 defines a handle 160 shaped to be manually gripped for insertion and removal of the overvoltage protection plug 110 from a socket, connection block, or other insertion location. The handle 160 includes a plurality of ridges 161 to assist with manual gripping of the plug 100. The handle 160 can also be shaped to accept use of a punch down tool for insertion or removal of the plug 100. For example, the handle can include a hook-shaped portion for receiving a portion of such a tool. The punch down tool (not shown) can be used to insert or remove the overvoltage protection plug 100, due in part to the sizing and positioning of the handle 160 at the handle portion of the housing 116, extending rearwardly from the plug. As described above, an example punch down tool can be any of a variety of tools include a gripping portion (for example, a hook), such as a punch down tool distributed by ADC Krone GmbH. An example punch down tool is described in U.S. Pat. No. 4,434,542, the disclosure of which is hereby incorporated by reference in its entirety.

Referring now to FIGS. 69-73, additional details of the gas tube 136 are shown. The gas tube 136 is a three-pin gas tube, and, as previously mentioned, includes two signal leads 138 and a grounding pin 140. The gas tube 136 is generally cylindrical, and the signal leads 138 extend from opposing ends of the cylinder. The grounding pin 140 extends from a central location along the cylindrical shape of the gas tube 136.

The gas tube 136 can be any of a variety of sizes. In various embodiments, the gas tube 134 is a gas discharge tube rated to meet electrical specifications of Underwriter's Laboratories, Telcordia, or another electrical safety specification appropriate to the region in which the plug 100 is used. Such gas discharge tubes can be any of a number of gas tubes manufactured by Bourns or other gas discharge tube manufacturer. In the embodiment shown, the gas tube has a diameter of approximately 5 mm. However, other sizes of gas tubes may be used as well to ensure that the necessary electrical specifications are met for use of the plug 100.

Optionally, the gas tube 136 includes a melt element 162 along the length of the tube. The melt element operates to permanently connect the signal leads 138 to the grounding pin 140 if a prolonged overvoltage event is detected. In the case of such an event, the gas tube 136 is activated for a long period of time, causing the temperature of the gas tube to rise, melting the melt element and causing a short circuit between the signal leads 138 and the grounding pin 140.

Now referring to FIGS. 74-87, features of the conductive contacts 126, 128 are described. A first conductive contact 126, shown in FIGS. 74-80, connects from the signal lead 138 of the gas tube 136 that resides within the housing 116 nearer to the handle 160, and extends through the chassis 114 to be exposed along the right side of the insertion portion. The conductive contact 126 includes a connection portion 127 configured for electrical connection to a signal lead 138 from the gas tube 136, and a lead portion 129 configured to extend through the slot 154 in the chassis. The second conductive contact 128, shown in FIGS. 81-87, includes a corresponding connection portion 127' and lead portion 129' connects from the signal lead 138 of the gas tube 136 that is nearer to the insertion portion through the chassis, and is exposed along the left side of the insertion portion. The conductive contacts 126, 128 can be soldered or otherwise electrically connected to the signal leads 138 using the connection portions 127, 131.

FIGS. 88-94 illustrate additional details of the grounding plate 142 mounted to the chassis 114 within the body 112. The grounding plate 142 includes a grounding extension 164 connected to a connection portion 166, which includes a connection location 168 for electrically connecting the grounding plate to the grounding pin 140 of the gas tube 136. In the embodiment shown, the connection portion is substantially rectangular, to be held in place by the tabs 156 on the top side of the chassis. In the embodiment shown, the connection location 168 includes an H-clip configuration, forming a solderless electrical connection to the grounding pin 140 of the gas tube 136. However, in other embodiments a soldered connection could be used instead.

Referring now to the disclosure of FIGS. 37-94 generally, to construct an overvoltage protection plug 100 such as is disclosed herein, an example process follows. A manufacturer can mount a gas tube to a chassis, such as by sliding one or more pins of the gas tube (e.g. the grounding pin 140 or signal leads 138) into a slot of the chassis arranged to accommodate the gas tube. Metallic leads, such as the conductive contacts 126, 128, are electrically connected to the signal leads 138 of the gas tube 136, and inserted through slots in the chassis to extend toward an insertion side of the chassis. For example, the conductive contacts 126, 128 can be soldered to the signal leads 138 of the gas tube 136.

A grounding plate 142 is electrically connected to the grounding pin 140 of the gas tube 136. The grounding plate is installed over the grounding pin, optionally such that a portion of the chassis 114 resides between the grounding plate 142 and the gas tube 136.

The interior portion 150 of the chassis 114, including the installed gas tube 136, grounding plate 142, and portions of the conductive contacts 126, 128, is inserted into the housing 116 to form a snap-fit connection, forming the overvoltage protection plug 100. The interior volume of the formed plug 100 can be filled with a gel, such as by inserting the gel through a gel access opening in the body 112 of the plug. The gel surrounds the grounding plate 142, conductive contacts 126, 128, and gas tube 136, to environmentally protect the electrical components from moisture or other harmful external conditions.

In operation, the overvoltage protection plug 100 is inserted into a connection block, thereby connecting two sets of contacts for a differential signal pair routed through the connection block. The overvoltage protection plug 100 detects overvoltage events, representing instances in which the voltage difference across the differential pair exceeds an acceptable, preset threshold value. When the voltage difference exceeds this threshold value (as determined by the specific voltage characteristics of the selected gas tube), one or both of the signal leads of the gas tube are shorted to the grounding pin of the gas tube, as described above in conjunction with FIGS. 69-73, thereby protecting an overall differential signaling circuit.

One example of a similar overvoltage protection plug that has analogous functionality is described in U.S. patent application Ser. No. 11/712,234, filed Feb. 28, 2007, and entitled "Overvoltage Protection Plug", the entire disclosure of which is hereby incorporated by reference in its entirety.

Although certain particular methods of construction and operation of an overvoltage protection plug are described herein, other methods of construction and operation are possible as well. Furthermore, the various steps described to construct an overvoltage protection plug are not required to be performed in a specific order, and no order is imputed by this description.

Furthermore, it is noted that, although in the foregoing description of the overvoltage protection plug 100 terms such as, "top", "bottom", and "side" and words related thereto are used for ease of description and illustration, no restriction is intended by use of such terms. The plug 100 can be positioned in any orientation.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A protection block comprising:

(a) a rectangular housing having a front, a rear, and top, bottom, left, and right sides;

(b) a plurality of sockets in a first discrete region of the housing, the plurality of sockets arranged in a two-dimensional array in the front of the housing, each of the plurality of sockets associated with two pairs of opposed, normally open contacts, wherein each of the plurality of sockets is configured to receive an overvoltage protection plug that separately connects each of the two pairs of contacts;

(c) a plurality of electrical connections in a second discrete region of the block separate from the first discrete region, the plurality of electrical connections electrically connected to the contacts;

(d) a grounding bar associated with one or more of the sockets and positioned for electrical connection to a ground connection of an overvoltage protection plug when inserted into a socket.

2. The circuit protection block of claim 1, wherein the sockets are sized to receive at least a portion of a housing of an overvoltage protection plug.

3. The circuit protection block of claim 1, wherein the plurality of sockets each are arranged to receive an overvoltage protection plug which is useable in a Krone-style connection block.

4. The circuit protection block of claim 1, wherein each of the contacts connects to a corresponding pin on the rear of the housing.

5. The circuit protection block of claim 4, wherein each pin is electrically connected to a corresponding signal wire.

6. The circuit protection block of claim 5, wherein the pins and signal wires are sealed under a plastic coating on the rear of the protection block.

7. The circuit protection block of claim 1, wherein the housing is at least partially filled with gel.

8. The circuit protection block of claim 7, wherein the gel at least partially covers the contacts.

9. The circuit protection block of claim 1, wherein the grounding bar electrically connects to a grounding plate, the grounding plate electrically connected to a ground connection external to the circuit protection block.

10. The circuit protection block of claim 9, wherein the grounding bar electrically connects to the grounding plate via a solderless press-fit connection.

11. The circuit protection block of claim 1, wherein one or more of the plurality of sockets has a keyed shape that dictates an orientation for insertion of the overvoltage protection plug.

12. The circuit protection block of claim 11, wherein the keyed shape includes an angled corner.

13. The circuit protection block of claim 1, further comprising at least one mounting protrusion formed on a side of the housing.

14. The circuit protection block of claim 1, wherein the housing includes a base and a cover, the cover including openings exposing the contacts mounted in the base.

15. The circuit protection block of claim 1, wherein the rectangular housing is approximately 7.9 inches by approximately 5.8 inches in size.

16. The circuit protection block of claim 1, wherein the electrical connections are on a rear side of the housing.

17. A protection block comprising:

(a) a rectangular housing formed from a base and a cover and having a front, a rear, and top, bottom, left, and right sides;

(b) a plurality of sockets arranged in a two-dimensional array in the front of the housing, each of the plurality of sockets associated with two opposed pairs of normally open contacts, wherein each of the plurality of sockets is arranged to receive an overvoltage protection plug that separately connects each of the pairs of contacts;

(c) a plurality of pins extending from the rear of the housing, each of the plurality of pins electrically connecting to a contact; and (d) a plurality of grounding bars, each of the plurality of grounding bars associated with one or more of the sockets and positioned for electrical connection to a ground connection of an overvoltage protection plug when the overvoltage protection plug is inserted into one of the plurality of sockets;

(e) wherein the pins associated with the two opposed pairs of normally open contacts of a socket are electrically connected to differential signal wires of a telecommunications circuit.

18. The protection block of claim 17, wherein the grounding bar electrically connects to a grounding plate via a solderless press-fit connection, the grounding plate electrically connected to a ground connection external to the circuit protection block.

19. The protection block of claim 17, wherein the housing is at least partially filled with gel.

* * * * *